United States Patent [19]

Lindberg

[11] 4,286,263

[45] Aug. 25, 1981

[54] ILLUMINATED CHANGEABLE-DISPLAY SIGN

[76] Inventor: Allan W. Lindberg, 464 N. Taylor Ave., St. Louis, Mo. 63122

[21] Appl. No.: 67,174

[22] Filed: Aug. 16, 1979

[51] Int. Cl.[3] ..... G08B 5/36

[52] U.S. Cl. ..... 340/717; 73/359 R; 73/362 R; 340/718; 340/760; 368/64

[58] Field of Search ..... 340/717, 780, 792, 693, 340/636, 718, 782, 789; 368/64; 73/359 R, 362 R

[56] References Cited

U.S. PATENT DOCUMENTS

| | | | |
|---|---|---|---|
| 2,907,995 | 10/1959 | Justus | 340/780 X |
| 3,320,585 | 5/1967 | Hines | 340/717 X |
| 3,320,586 | 5/1967 | Wagner | 340/717 X |
| 3,384,888 | 5/1968 | Harnden et al. | 340/792 |
| 3,389,389 | 6/1968 | Minear | 340/792 X |
| 3,727,185 | 4/1973 | Jones et al. | 340/792 X |
| 4,017,724 | 4/1977 | Finger | 340/636 X |
| 4,138,670 | 2/1979 | Schneider et al. | 340/636 X |

*Primary Examiner*—David L. Trafton

*Attorney, Agent, or Firm*—Rogers, Eilers & Howell

[57] ABSTRACT

An illuminated changeable-display sign has lamps which are visible to viewers and which are arranged in rows and columns, has light emitting diodes which are visible to the operator of that sign and which are arranged in corresponding rows and columns, and has control circuitry which enables the data displayed by the LEDS to be exactly the same as or different from the data displayed by the lamps.

13 Claims, 23 Drawing Figures

ILLUMINATED CHANGEABLE-DISPLAY SIGN

FIELD OF THE INVENTION

Illuminated changeable-display signs are able to provide data in attractive and appealing form by causing that data to move progressively from right to left across the face thereof. Further, some of those signs are able to provide up-to-the-minute time and temperature data.

SUMMARY OF THE INVENTION

The present invention provides an illuminated, changeable-display sign which has display lamps that are arranged in rows and columns to permit selective display of alpha-numeric and other information by appropriate illumination of those lamps. That sign has an operator's control and display unit which corresponds exactly in number and in the row and column arrangement to the lamps of the sign. Each lamp of the sign has its own driver, so it can be illuminated continuously throughout the time it is supposed to be illuminated; but power is multiplexed to LEDS in the various rows of the operator's control and display unit by a single set of drivers. As a result, those LEDs can be illuminated with substantially fewer parts and with substantially less energy. It is, therefore, an object of the present invention to provide an illuminated, changeable-display sign with a driver for each display lamp thereof and with a corresponding number of LEDs, in an operator's control and display unit, which have just one set of drivers.

The circuitry which illumines or darkens the display lamps of the sign and the circuitry which illumines or darkens the LEDs of the operator's control and display unit receive the same control data at the same time; and hence those LEDs can faithfully and promptly display the same information which is being displayed by the display lamps of the sign. It is, therefore, an object of the present invention to provide an illuminated, changeable-display sign wherein the circuitry which illumines or darkens the display lamps of the sign and the circuitry which illumines or darkens the LEDs of an operator's control and display unit receive the same control data at the same time.

Each row of lamps of the sign has a shift register which supplies signals to the drivers for the lamps of that row; and data is stepped into the inputs of all of those shift registers at the same time. The driver for each lamp in each row will immediately respond to the state of the shift register stage to which it is connected; and hence the response to each change in the displayable data is full and immediate. It is, therefore, an object of the present invention to provide an illuminated, changeable-display sign wherein each row of lamps has a shift register which supplies signals to the drivers for the lamps of that row and wherein data is stepped into the inputs of all of those shift registers at the same time.

A time and temperature unit supplies information to the sign; and direct addressing of each digit of the time and temperature data is provided under control of a program. As a result, precise, immediate, and complete time and temperature information can be displayed on the sign whenever such information is desired. In addition, a crystal controlled clock and a backup battery will accurately keep the time information, and also will prevent the display of incorrect time, in the event the power which is supplied to the sign fails for short periods of time. It is, therefore, an object of the present invention to provide an illuminated changeable-display sign wherein a crystal controlled clock supplies time data, wherein a temperature unit supplies temperature data, wherein each digit of that time and temperature data is directly addressed under control of a stored program, and wherein a backup battery will keep that time and temperature data valid even though the power which is supplied to that sign may fail from time to time.

The time and temperature unit supplies data at a rate which is slower than the rate at which the program can read data which is stored in the memory for the sign. To keep slowly available data from being inaccurately clocked into the memory, the present invention provides a delay of a few microseconds in the clocking signals for that unit. That delay makes certain that even slowly-generated data will be accurately read and stored in the memory for the sign. It is, therefore, an object of the present invention to provide an illuminated, changeable-display sign wherein data which is to be displayed is initially stored in memory, wherein said data is generated at different rates of speed, and wherein a delay of a few microseconds is provided in the clocking signal for said data to enable it to be stored in memory accurately.

Whenever the information that is to be displayed by the sign is to be revised or modified, a microprocessor can automatically darken all of the lamps of the sign, and can thereby avoid an undesired displaying of incomplete and partly-modified data. The present invention makes this possible by providing gates, for the rows of lamps, that normally supply data to those rows, but which can be simultaneously inhibited to cause all of the lamps in the various rows to become dark. It is, therefore, an object of the present invention to provide an illuminated, changeable-display sign which has gates, for the rows of lamps, that normally supply data to those rows, but which can be simultaneously inhibited to cause all of the lamps in the various rows to become dark.

The sign which is provided by the present invention is constructed from a number of identical display modules. Each of those display modules has the same number of lamps arranged in the same number of rows and columns. Each of those display modules has an electronic package which can respond to input signals to effect the desired illumining and darkening of the lamps, and which can also supply an input signal to the next-succeeding display module. Each electronic package includes a separate shift register for each row of lamps thereon, and those shift registers coact with the shift registers of the other display modules to provide each overall row of lamps of the sign with its own overall shift register that has the same number of stages as the number of lamps in that row. It is, therefore, an object of the present invention to provide an illuminated, changeable-display sign that is constructed from a number of identical display modules, and wherein shift registers on those display modules coact to provide each overall row of lamps of the sign with its own overall shift register.

The circuitry which illumines or darkens the LEDs can accept data asynchronously by temporarily holding that data until it is to be read out. Such an arrangement permits the present invention to use a multiplexer without having to synchronize the operation of that multiplexer with the operation of the data-generating portions of that sign, and yet permits the display on the LED display to be the same as that of the lamps on the sign. Thus, if new data is supplied during the time the multiplexer is causing previously-inserted data to selectively illumine the LEDs, that newly-supplied data will be held until the conclusion of the selective illumining of the LEDs. It is, therefore, an object of the present invention to provide an illuminated, changeable-display sign wherein asynchronously-supplied data can be accepted by being held temporarily.

The sign provided by the present invention has a circuit which will sense any condition wherein both the main power has failed and the battery-backup power also has failed. Subsequently, when the main power is restored to the sign, that circuit will make apparent to the operator that the stored data is not valid. Thereupon, the operator will act to render that data valid once again.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purposes of illustration and do not limit the invention and that the invention will be defined by the appended claims.

DETAILED DESCRIPTION OF PREFERRED EMBODIMENT

Figure 1:
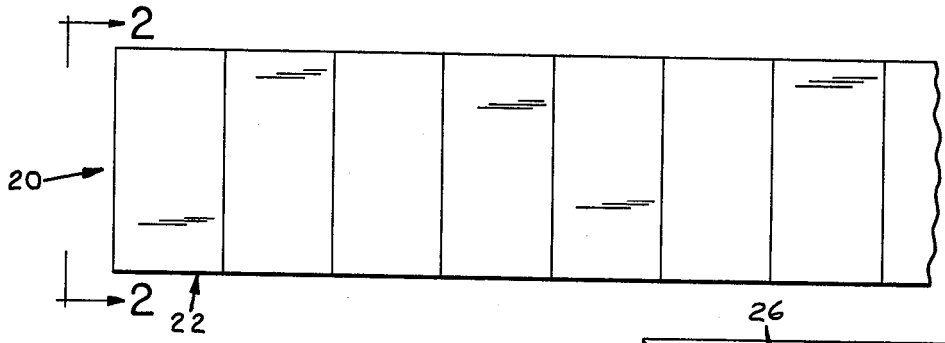
FIG. 1 is a broken front elevational view of a sign incorporating the principles and teachings of the present invention.
Figure 2:
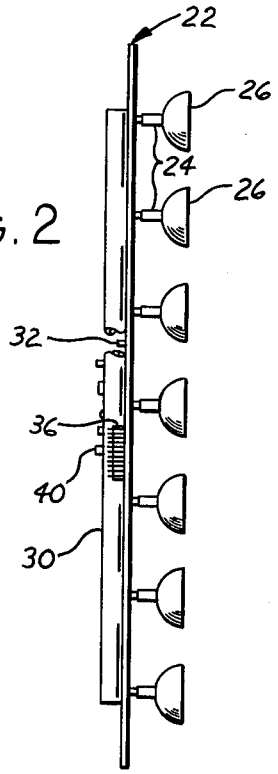
FIG. 2 is an elevational view, on a larger scale, of the left hand end of the sign of FIG. 1.
Figure 3:
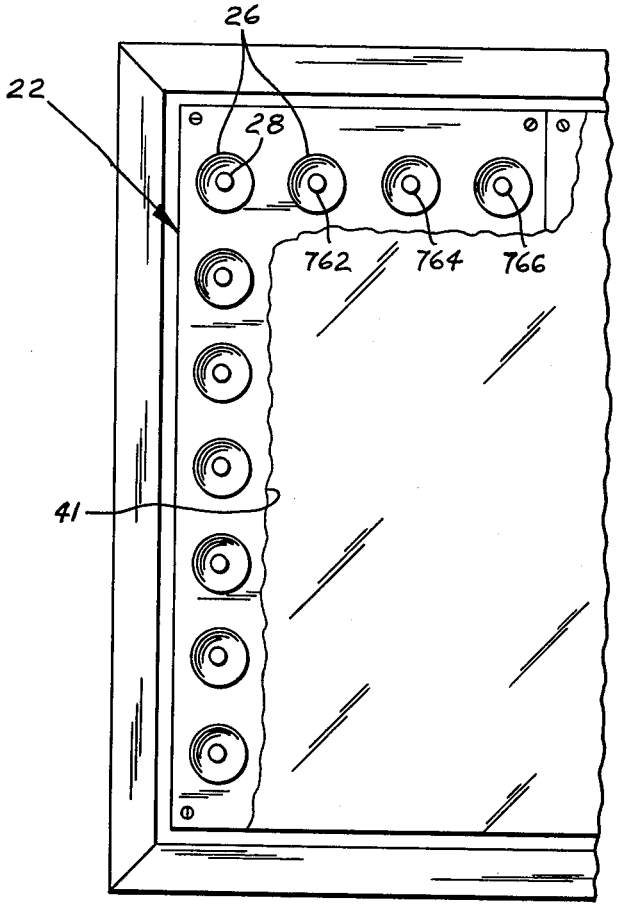
FIG. 3 is a partially broken-away front elevational view, on the scale of FIG. 2, of the display module of FIG. 2.
Figure 4:
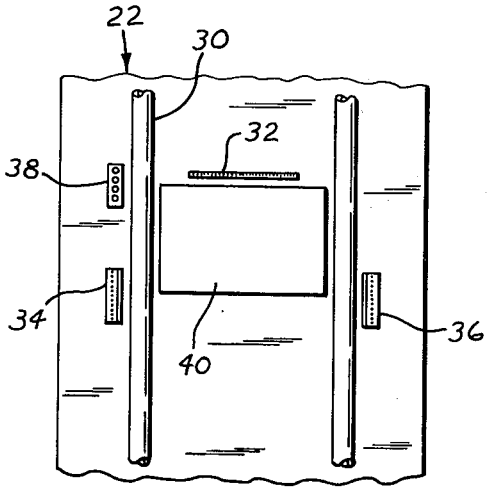
FIG. 4 is a rear elevational view of part of the display module of FIG. 2.

Referring to the drawing in detail, the numeral 20 generally denotes a sign in which the principles and teachings of the present invention are incorporated. That sign has sixteen display modules which are disposed in edge-to-edge relation to constitute the front of that sign; and it has an additional sixteen display modules, not shown, which are disposed in edge-to-edge relation to constitute the rear of that sign. One of those display modules is generally denoted by the numeral 22; and it has sockets 24 which are secured to, and which extend forwardly from, the front surface thereof. Reflectors 26 are secured to, and extend forwardly beyond, those sockets; and incandescent lamps are mounted within those sockets and reflectors. In the preferred embodiment of the present invention, twenty-eight sockets, reflectors and lamps are mounted on the front of display module 22; and they are arranged in seven vertically-spaced rows with four columns in each row. The sixteen display modules which constitute the front of the sign 20 coact to provide seven vertically-spaced rows of lamps that are arranged in sixty-four columns; and the sixteen display modules, not shown, which constitute the rear of that sign also provide seven vertically-spaced rows of lamps that are arranged in sixty-four columns. If desired, a sign could be constructed which had more, or fewer, than sixteen display modules for the front thereof; and that sign should have the same number of display modules for the rear thereof. Further, if desired, a one-sided sign could be constructed which had more, or fewer, than sixteen display modules for its one side.

The numeral 30 denotes two elongated reinforcing members which are secured to the rear face of the display module 22; and those members stiffen and reinforce that module. Pin-type male connectors 32, 34 and 36 are secured to, and extend rearwardly from, the display module 22; and a female connector 38 also is secured to, and extends rearwardly from, that module. The numeral 40 denotes the electronic package for the display module 22.

Each of the other display modules, which help form the front of the sign 20, will be identical to the module 22. The display modules, not shown, which form the rear of that sign will differ from the modules 22 by not having the electronic package 40. Those rear display modules will be paired with the front modules so they can be controlled by the electronic packages of those front modules. The front and rear display modules will be supported by a suitable frame, not shown; and suitable lens-like transparent covers 41 will be provided for the front and rear of that sign.

Figure 5:
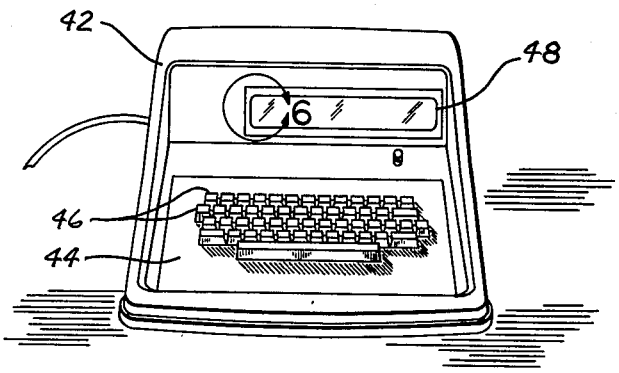
FIG. 5 is a front view of the operator's control and display unit for the sign of FIG. 1.
Figure 6:
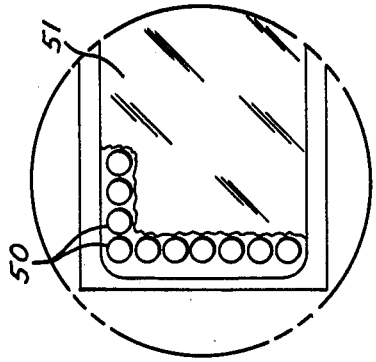
FIG. 6 is a partially broken-away view, on a larger scale, of part of the display of the operator's control and display unit of FIG. 5.

Referring particularly to FIG. 5, the numeral 42 denotes an operator's console and display unit which has a Keyboard 44 with a large number of keys 46. Those keys can be used to supply signals which correspond to alpha-numeric and other desired information which is to be displayed by the lamps of the sign 20. The numeral 48 denotes an Operator Display portion for the operator's control and display unit 42; and that Operator Display has a number of light emitting diodes 50 located behind a transparent cover 51. In the said preferred embodiment of the present invention, that Operator Display has seven vertically-spaced rows of light emitting diodes that are arranged in sixty-four columns. It will be noted that each lamp of the sign 20 has a correspondingly-arranged light emitting diode 50.

Figure 7:
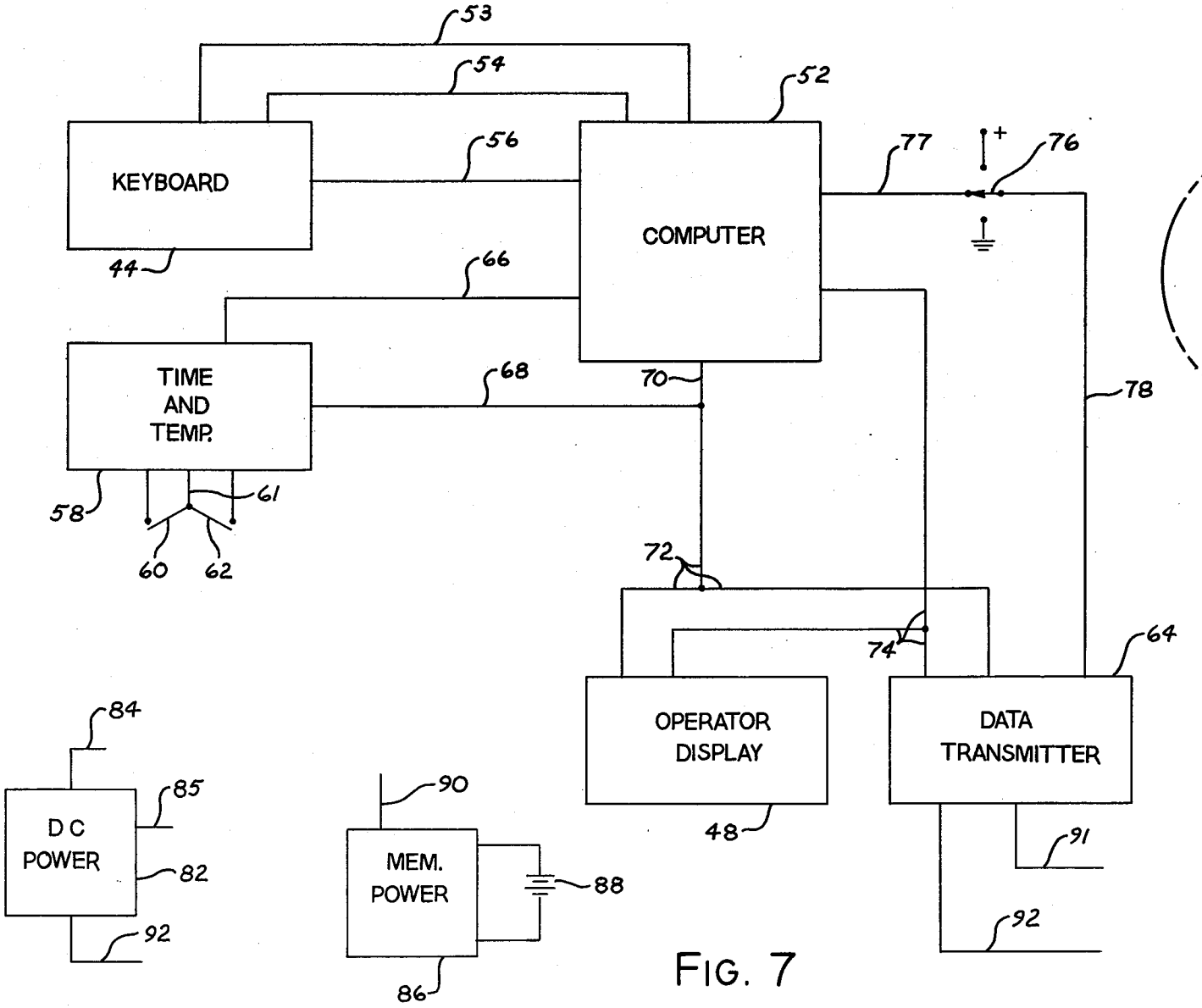
FIG. 7 is a block diagram of the control circuitry for the sign of FIG. 1.

Referring particularly to the block diagram of FIG. 7, the numeral 52 denotes a stored-program dedicated Computer. The numeral 54 denotes a conductor which extends from the Keyboard 44 to the Computer 52; and that conductor can supply a "repeat" signal to that Computer. The numeral 56 denotes an eight-conductor cable which extends from Keyboard 44 to the Computer 52; and that cable is wired to that Computer so it performs an "input only" function. The Keyboard 44 has a "break" key, not shown, which is wired directly to pin seven, which is the reset input, of microprocessor 110 of Computer 52 by a conductor 53. The Keyboard 44 and the Computer 52 are part of a loop which provides a test of the Keyboard status. If, at any time, that Computer were to go out of that loop, due to an erroneous entry from that Keyboard or to any other reason, the operator of the control and display unit 42 would be able to regain control of that Computer by closing the "break" key.

A Time And Temperature unit 58 has an hour-setting switch 60 and a minute-setting switch 62; and a conductor 61 connects the movable contacts of those switches to that unit. A seven conductor cable 66 extends from Computer 52 to that Time And Temperature unit to supply digit addressing information to that unit. The output of that Time And Temperature unit is connected, by an eight-conductor cable 68, to a bi-directional eight-conductor data bus 70 and to a branched eight-conductor cable 72 to supply digit data. The bi-directional eight-conductor data bus 70 is connected to Computer 52; and the branched eight-conductor cable 72 is connected to the Operator Display 48 of the operator's control and display unit 42, and to a Data Transmitter 64. A branched cable 74 extends from Computer 52 to the Operator Display 48 and also to the Data Transmitter 64 to supply display address information to that Operator Display and to that Data Transmitter. The numeral 76 denotes a three-position single-pole switch; and one of the fixed contacts of that switch is connected to pin nineteen of microprocessor 110 by a conductor 77. That pin and conductor serve as a display control output of Computer 52. Another fixed contact of that switch is connected to positive five volts, and the third fixed contact is connected to ground. The movable contact of switch 76 is connected to the Data Transmitter 64 by a conductor 78.

The numeral 82 denotes a Power Supply of standard and usual design which supplies five volts D.C. to a branched conductor 84 and ten volts D.C. to a branched conductor 85. The conductor 84 extends to all of the blocks of FIG. 7 to supply five volts to components of those blocks. The conductor 85 extends to the Operator Display 48 to supply ten volts to some components of that unit. A ground conductor 92 extends from Power Supply 82 to all of the blocks of FIG. 7; and that conductor extends from the Data Transmitter 64 to components on other views of the drawing.

The numeral 86 denotes a Memory Power unit which normally supplies five volts D.C. to various components of the circuitry for the sign 20 via a branched conductor 90. Included in those components are components of the Time And Temperature unit 58 and the RAM of Computer 52. As shown by FIG. 9E, that RAM has four sections which are denoted by the numerals 266, 268, 270 and 272. A battery 88 is connected to the Memory Power unit 86; but that battery normally does not supply power to that unit. However, in the event the source of power for the Power Supply 82 were to fail, the battery 88 would supply power to the Memory Power unit 86, and thereby enable that unit to continue to supply power via conductor 90.

Figure 13:
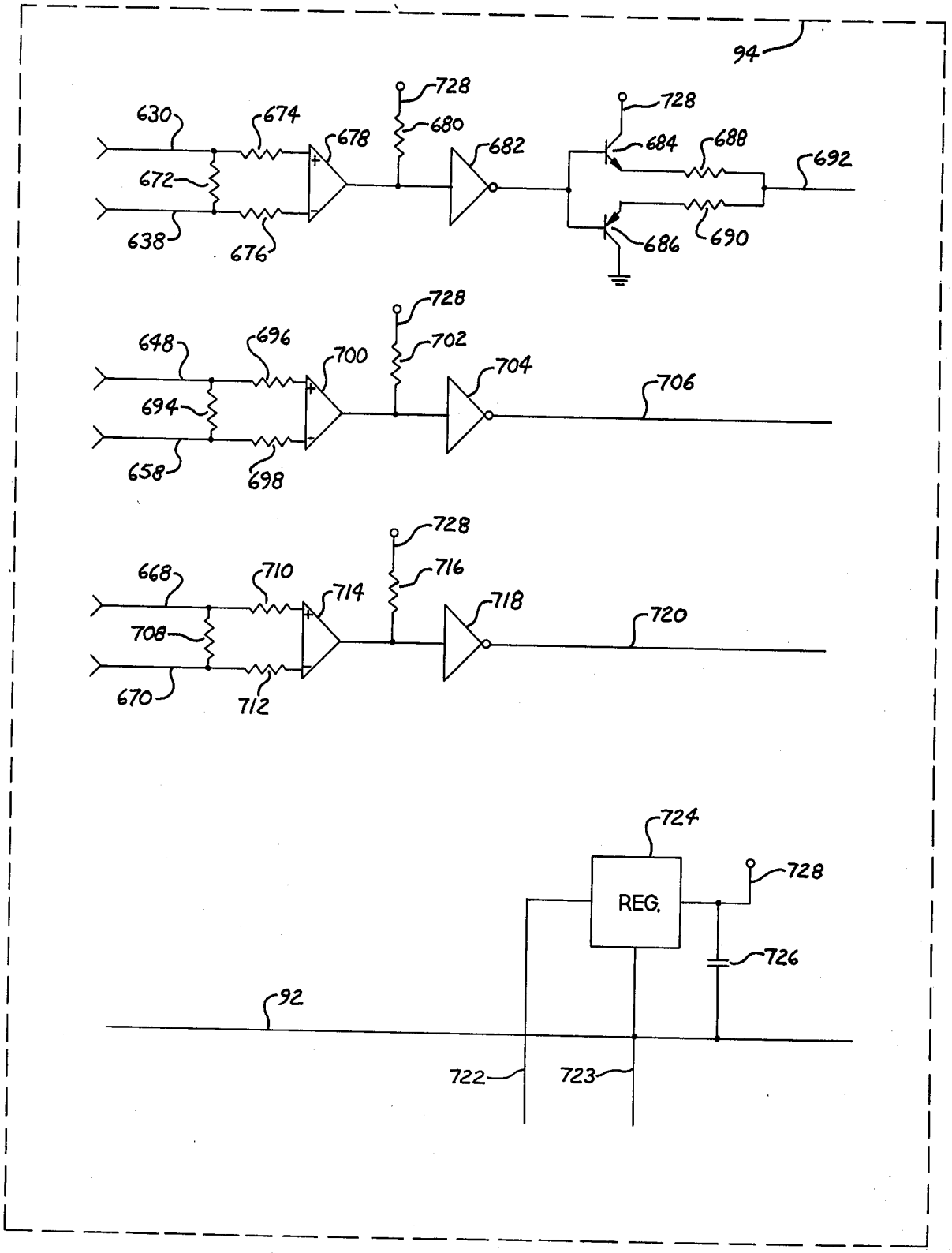
FIG. 13 shows representative circuitry of the Receiver block of FIG. 8.

The numeral 91 denotes an eight-channel balanced line which extends from the Data Transmitter 64 to a Receiver 94 which is mounted in the sign 20. That receiver is shown in block form in FIG. 8, and components thereof are shown in FIG. 13.

The Computer 52 provides address decoding for each input and output thereof. Each decoded input address is wired directly to that component of that Computer where it is used. Seven decoded data input addresses are used for the time and temperature information from the Time And Temperature unit 58. Four of those addresses access the four digits of the time data, and three of those addresses access the digits of the temperature data. The latter data is transmitted as degrees of Fahrenheit above a minimum value of minus forty degrees Fahrenheit.

Only one data output address is required; because the Operator Display 48 and the Data Transmitter 64 respond to that one address—which is supplied via branched conductor 74. Both that Operator Display and that Data Transmitter will receive that address simultaneously. Because the sign 20 has seven vertically-spaced rows, only seven lines of data are needed. Consequently, the branched cable 72, with its seven conductors, and the branched cable 74 can be made part of an eight-conductor branched cable.

Figure 8:
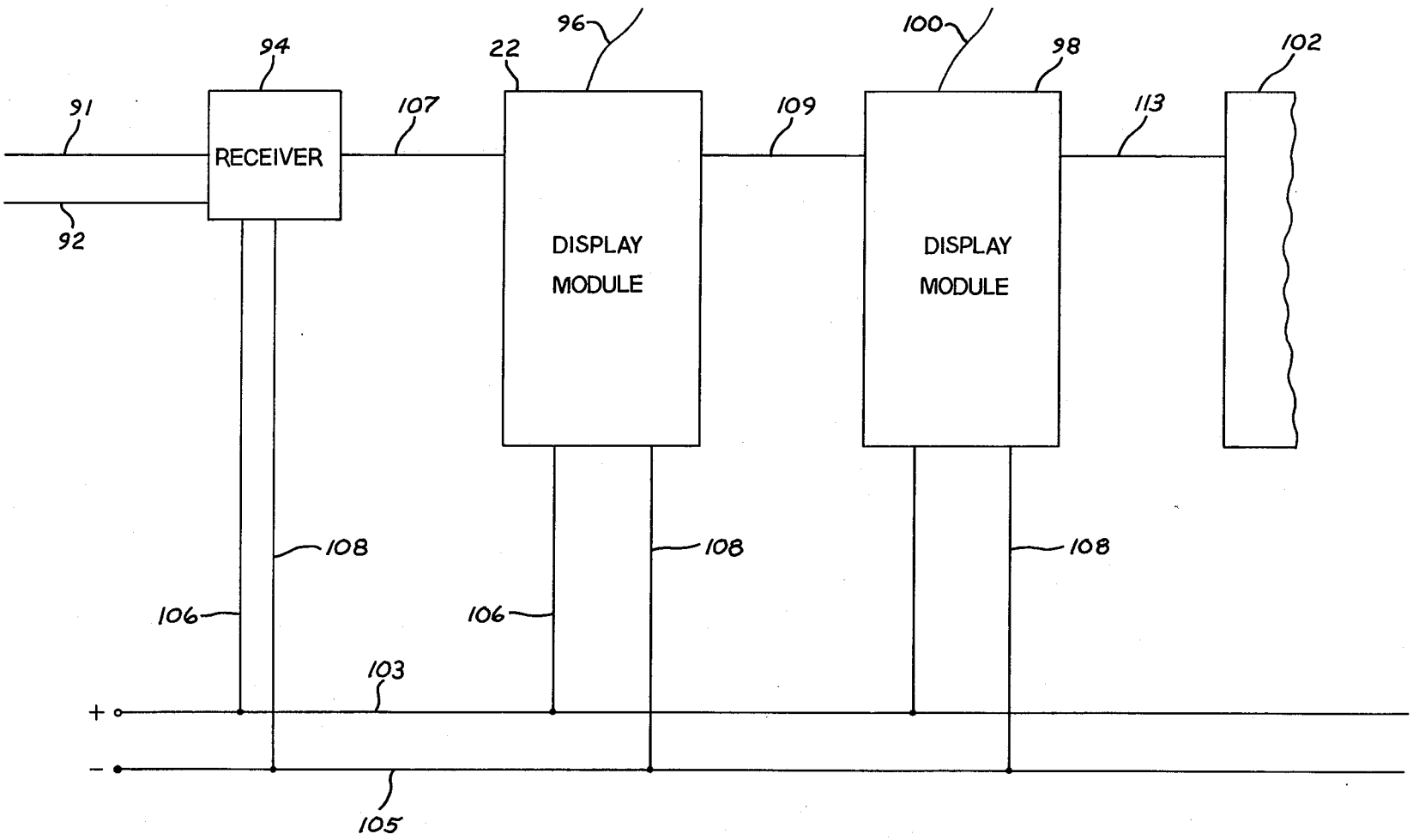
FIG. 8 is a block diagram showing the connections for the Receiver and some of the display modules of the sign of FIG. 1.

Referring particularly to FIG. 8, the Receiver 94 is connected to a positive bus bar 103 from a twenty-eight volt D.C. power supply, not shown, of standard and usual design by a conductor 106. That Receiver is connected to the negative bus bar 105 from that power supply by a conductor 108. The output of Receiver 94 is connected to the input of display module 22 by an eight-conductor cable 107; and the output of that display module is connected to the input of a display module 98 by an eight-conductor cable 109. The output of display module 98 is connected to the input of a further display module 102 by an eight-conductor cable 113. Further eight-conductor cables, not shown, will connect the outputs of display module 102 and of further display modules to the inputs of the next-succeeding display modules of the sign 20.

The numeral 96 denotes a twenty-eight conductor cable which extends from the pin-type connector 32 of the display module 22 to a corresponding pin-type connector on that display module, not shown, at the rear of the sign 20 which is paired with the display module 22. That paired display module will be at the opposite end of the rear of the sign 20, because both it and the display module 22 provide the beginning of all information that is displayed with left-to-right orientation. The cable 96 will supply all of the address and data information which is needed to cause that paired display module to provide a mirror image of the illuminated display which will be provided by the display module 22. A mirror image, rather than a direct duplication, of the illuminated display provided by the display module 22 is needed to enable both the front and rear of the sign to be read in left-to-right fashion.

The numeral 100 denotes a further twenty-eight conductor cable which extends from the pin-type connector 32 of the display module 98 to a corresponding pin-type connector on that display module, not shown, at the rear of the sign 20 which is paired with the display module 98. That paired display module will be close to the opposite end of the rear of the sign 20, because both the display module 98 and its paired display module must complete the portions of the overall display initiated by the display module 22 and its paired display module. Similar twenty-eight conductor cables, not shown, will extend between the pin-type connectors 32 of display module 102 and of the other front display modules to corresponding pin-type connectors of laterally-displaced paired display modules at the rear of the sign. As a result, the seven-row, sixty-four column illuminated displays at the front and rear of sign 20 can be controlled by just eight conductors from the Computer 52.

As indicated by FIG. 8, each of the display modules 22, 98, 102 and the other display modules at the front of sign 20 receive power from the buses 103 and 105 via further conductors 106 and 108. Also, the paired display modules at the rear of that sign receive power from those buses.

The sign 20 has two ground reference paths, namely, a "power ground path" and a "signal ground path". Those paths are tied together at the point of entry of the conductor 108 into that sign. As a result, sign 20 has a common "power ground path" and "signal ground path"; and that common ground path will obviate all undesired operation of that sign which might occur if such a ground path was not provided.

Figure 9A:
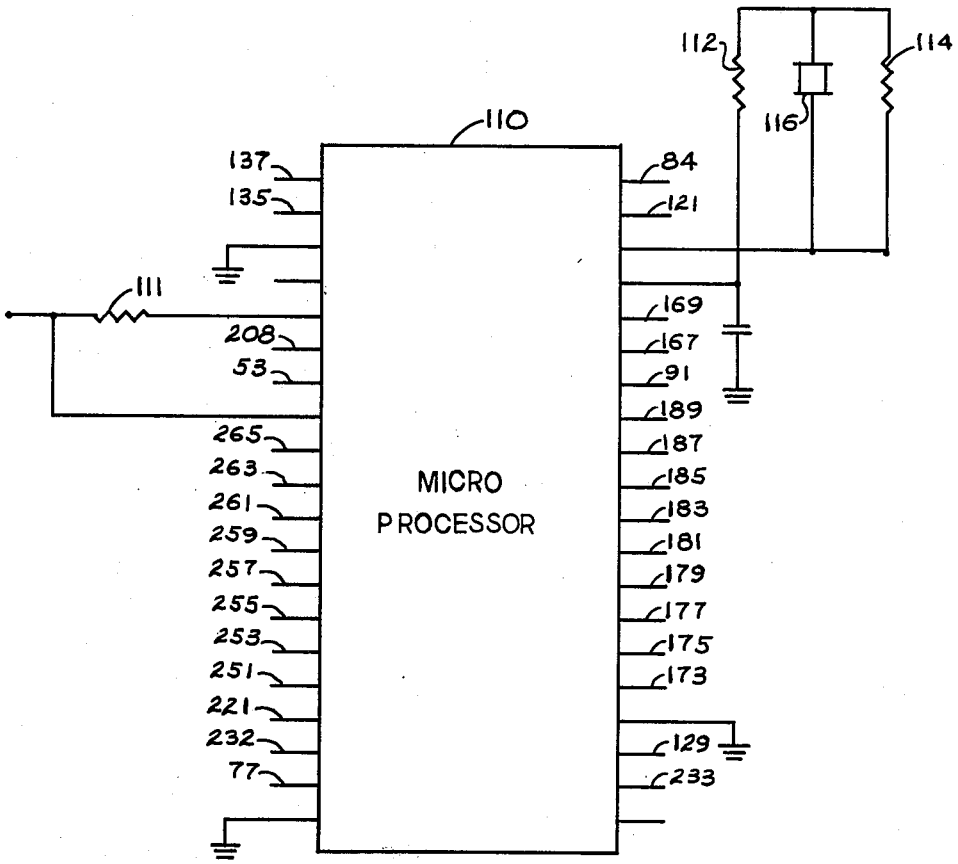
FIGS. 9A–F show the circuitry in the Computer block of FIG. 7.
Figure 9A:
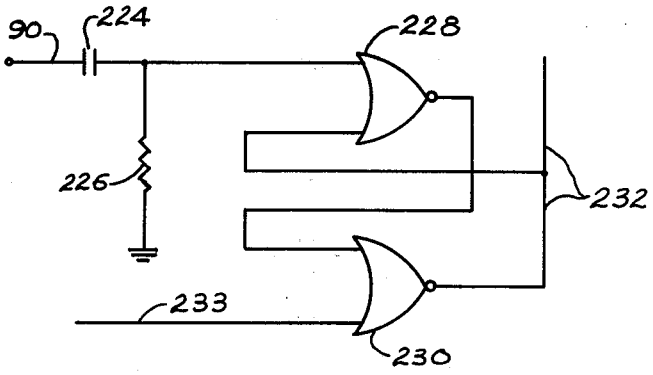
Figure 9B:
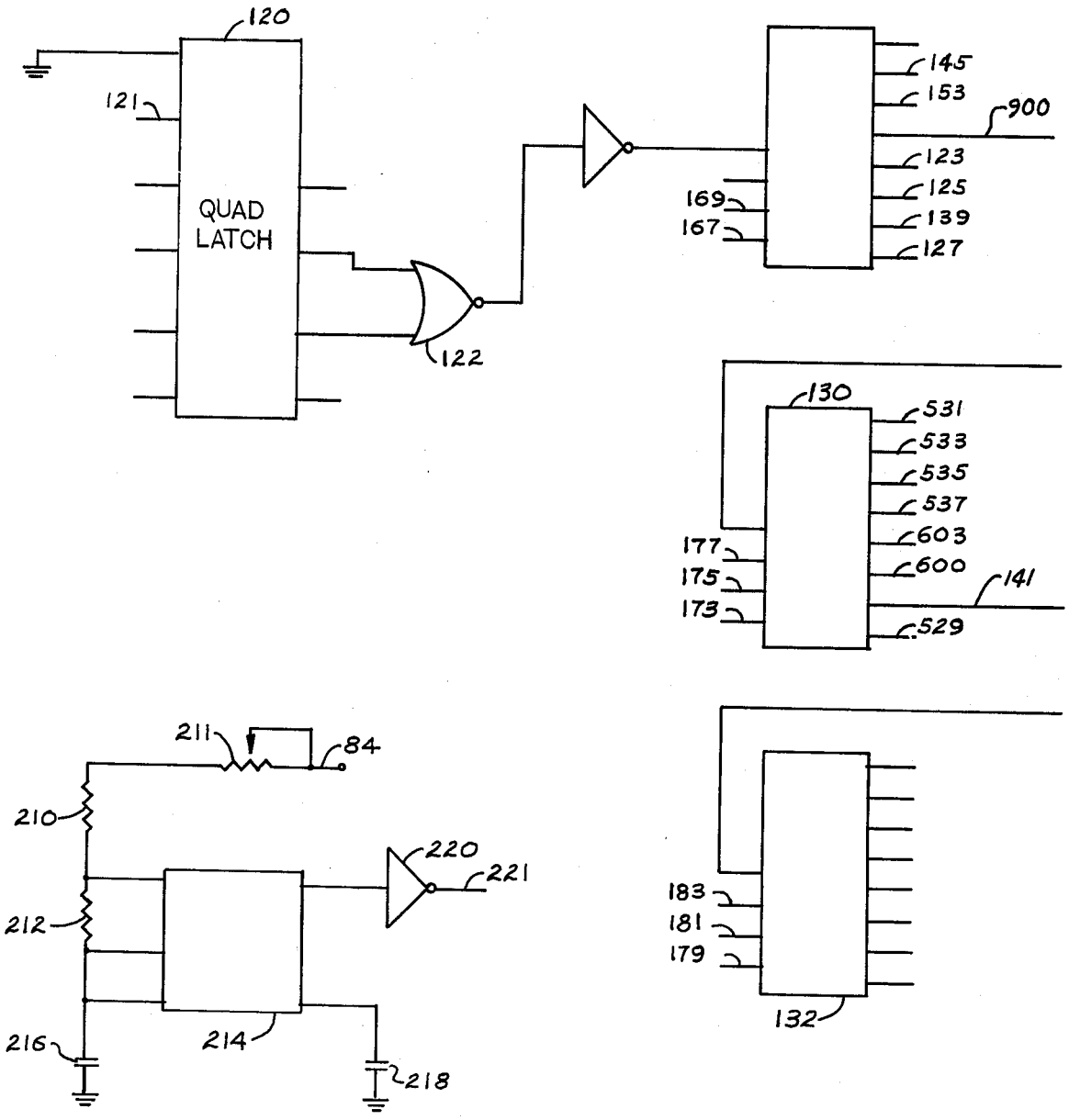

Referring particularly to FIG. 9A, the microprocessor 110 preferably is a National Semiconductor ISP-8A/600 microprocessor. That microprocessor is an "eight bit" microprocessor, having eight data lines and eight bit internal arithmetic and logic processing capability. The addressing capability of that microprocessor is sixteen bits for a total addressing capability of sixty-four thousand. To achieve such addressing, the twelve lower order bits are directly accessed to pins $A_0$ to $A_{11}$, and the four high order address bits are multiplexed on the low order data lines.

Pins eight and forty of microprocessor 110 are connected to the five volts on conductor 84; and a resistor 111 connects pin five to those five volts. Pins three, twenty and twenty-four are grounded; and pins four and twenty-one are not connected.

The numeral 112 denotes a resistor which is connected to pin thirty-seven of microprocessor 110; and a capacitor 118 is connected between ground and the junction of resistor 112 and that pin. A crystal 116 and a resistor 114 are connected in parallel with each other between resistor 112 and pin thirty-eight of microprocessor 110. That crystal develops a four megahertz signal, and supplies it to pin thirty-seven of that microprocessor.

The numeral 120 denotes a quad latch of standard and usual design. Pins seven, four, fourteen and thirteen of that quad latch are connected, respectively, to pins sixteen, fifteen, fourteen and thirteen of microprocessor 110, which are the zero through three data lines of that microprocessor. Timing signals for that quad latch are supplied by a NADS signal on conductor 121 which is connected to pin thirty-nine of microprocessor 110. Pin six of quad latch 120 is grounded.

Of the available sixty-four thousand total address fields, only the lower eight thousand are decoded—with the decoding being true and non-redundant for those and the rest of the lower thirty-two thousand of those sixty-four thousand address fields. The decoding is done by a one-of-eight decoder 126 and a serially-connected NOR gate 122 and inverter 124. The inputs of that NOR gate are connected to pins one and two of quad latch 120, and the output of inverter 124 is connected to pin eleven of decoder 126. Pin ten of quad latch 120 is connected to pin twelve of decoder 126 by a conductor 171; and pin eleven of that quad latch is not used.

Figure 9C:
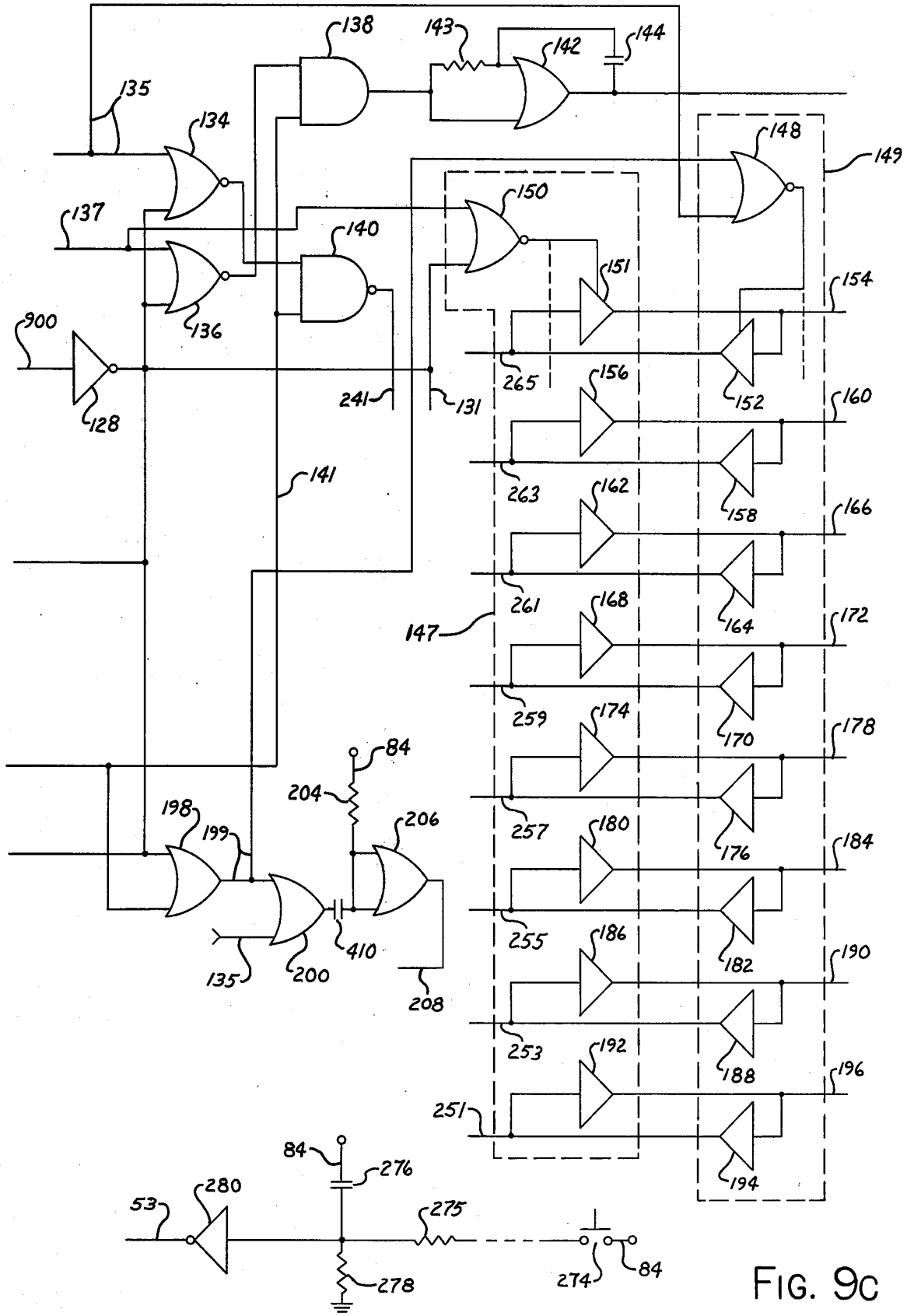

The numeral 128 in FIG. 9C denotes an inverter which has the input thereof connected to pin one of decoder 126 by a conductor 900; and the output of that inverter is connected to pins eleven of two additional one-to-eight decoders 130 and 132 by a conductor 131. In addition, the output of that inverter is connected to the lower inputs of two NOR gates 134 and 136, to the upper input of an OR gate 198, and to the lower input of a NOR gate 150 by conductor 131. An NRDS signal, from pin two of microprocessor 110, is applied to the upper input of NOR gate 134 and also to the lower input of a NOR gate 148 by a conductor 135. An NWDS signal, from pin one of that microprocessor, is applied to the upper input of NOR gate 136 and to the upper input of NOR gate 150 by a conductor 137. The output of NOR gate 134 is connected to the upper input of a NAND gate 140; and the output of NOR gate 136 is connected to the upper input of an AND gate 138. The lower inputs of that NAND gate and AND gate, and the lower input of OR gate 198 are connected to pin one of decoder 130 by a conductor 141. The output of AND gate 138 is connected directly to the lower input of an OR gate 142, and is connected by a resistor 143 to the upper input of that OR gate. A capacitor 144 is connected between the output and upper input of OR gate 142; and a conductor 146 is connected to that output to serve as a clocking or strobing signal for the Data Transmitter 64. The output of NAND gate 140 is a keyboard enable signal which is applied to a conductor 241.

NOR gate 150 is part of an 8ILS 95 octal tri-state buffer 147 of National Semiconductor which includes buffer amplifiers 151, 156, 162, 168, 174, 180, 186 and 192. NOR gate 148 is part of an 8ILS 95 octal tri-state buffer 149 which includes buffer amplifiers 152, 158, 164, 170, 176, 182, 188 and 194. The inputs of the amplifiers of buffer 147 and the outputs of the amplifiers of buffer 149 are connected, respectively, to pins nine through sixteen of microprocessor 110 by conductors 265, 263, 261, 259, 257, 255, 253 and 251. The outputs of the amplifiers of buffer 147 and the inputs of the amplifiers of buffer 149 are connected, respectively, to conductors 154, 160, 166, 172, 178, 184, 190 and 196 which constitute the bi-directional data bus 70.

The output of OR gate 198 is connected to the upper input of an OR gate 200 and also to the other input of OR gate 148 by a conductor 199. The NRDS signal from pin two of microprocessor 110 is applied to the lower input of NOR gate 200 by the conductor 135. A capacitor 202 can couple the output of OR gate 200 to both inputs of an OR gate 206; and a resistor 204 connects those inputs to five volts via conductor 84. A conductor 208 is connected to the output of OR gate 206 to supply an "N hold" signal to pin six of microprocessor 110.

The numerals 210 and 212 in FIG. 9B denote resistors which are connected in series between a capacitor 216 which has one terminal thereof grounded and an adjustable resistor 211 which has one terminal thereof connected to five volts by conductor 84. The numeral 214 denotes a timing device which has pin seven thereof connected to the junction between resistors 210 and 212, which has pins two and six thereof connected to the junction between resistor 212 and capacitor 216, which has a capacitor 218 connected between pin five thereof and ground, and which has pin three thereof connected to the input of an inverter 220. Although various timing devices could be used, the 555 IC timing device of National Semiconductor has been found to be useful. The inverter 220 can develop a Sense A signal on a conductor 221, and can apply that signal to pin seventeen of microprocessor 110.

The numeral 224 in FIG. 9A denotes a capacitor and the numeral 226 denotes a resistor which can couple changes in the voltage, which the Memory Power unit 86 supplies to conductor 90, to the upper input of a NOR gate 228. The other terminal of resistor 226 is grounded. The output of NOR gate 228 is connected to the upper input of a NOR gate 230; and the other input of the latter NOR gate is connected to pin twenty-two of microprocessor 110 by a conductor 233. The output of NOR gate 230 is connected to the lower input of NOR gate 228 and to pin eighteen of microprocessor 110 by a conductor 232 which provides a Sense B signal to that pin. NOR gates 228 and 230 act as a flipflop.

Figure 9D:
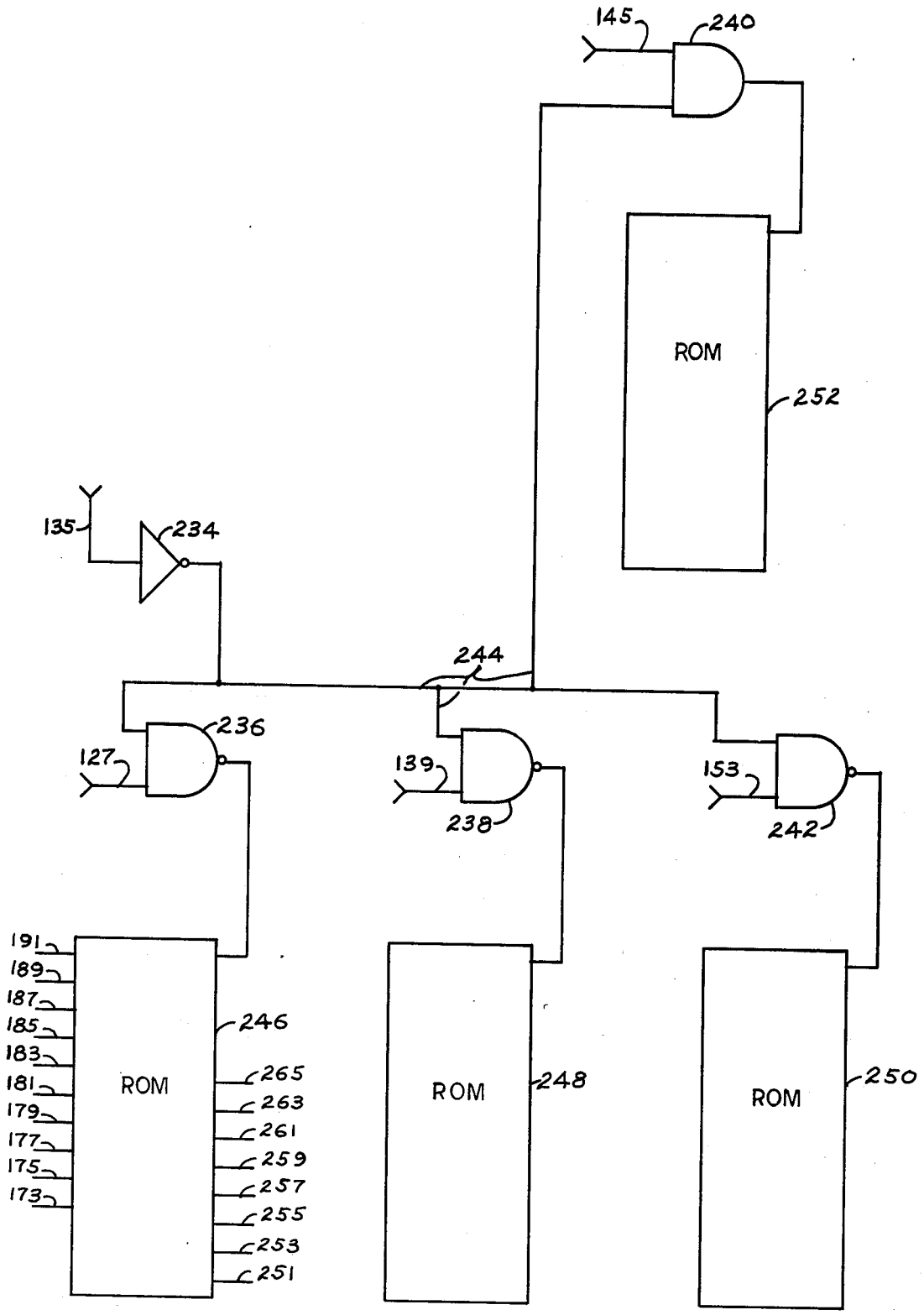
Figure 9E:
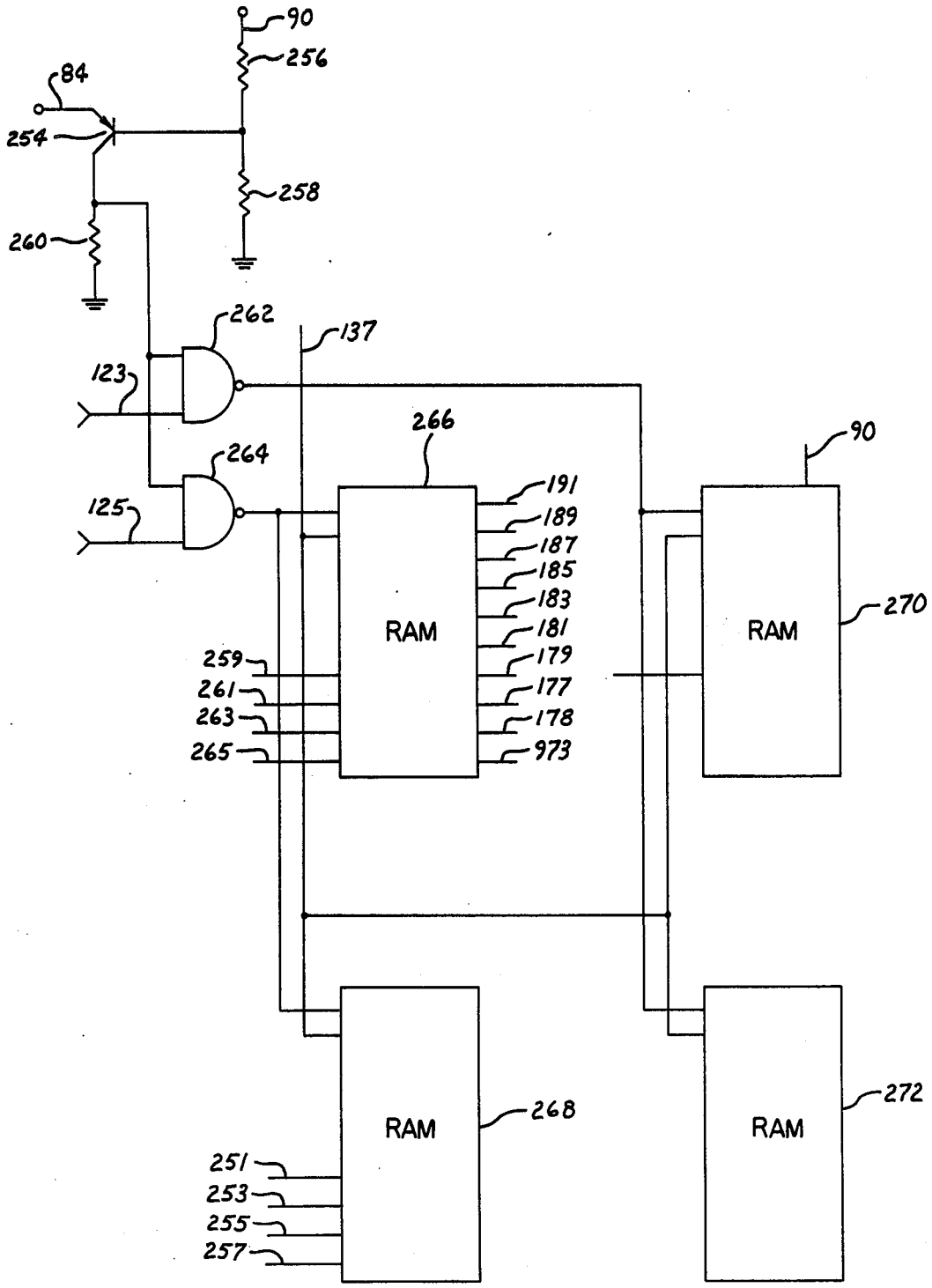

The numeral 234 in FIG. 9D denotes an inverter which receives the NRDS signal from pin two of microprocessor 110 via the conductor 135; and it supplies an inverted signal to the upper inputs of NAND gates 236, 238 and 242 and to the lower input of a NAND gate 240. That inverted signal is a positive logic read strobe signal. The other input of NAND gate 236 is connected to pin three of decoder 126 by a conductor 127, the other input of NAND gate 238 is connected to pin fourteen of that decoder by a conductor 139, the other input of NAND gate 240 is connected to pin seven of that decoder by a conductor 145, and the other input of NAND gate 242 is connected to pin six of that decoder by a conductor 153.

The numerals 246, 248, 250 and 252 denote sections of a read only memory such as a ROM or PROM. In the said preferred embodiment, this read only memory will be a ROM. Pins eight through one, twenty-three and twenty-two of each of those sections are connected, respectively, to pins twenty-five through thirty-four of microprocessor 110 by conductors 173, 175, 177, 179, 181, 183, 195, 187, 189 and 191. Pins nine through eleven and thirteen through seventeen of those sections are connected, respectively, to pins sixteen through nine of microprocessor 110 by conductors 251, 253, 255, 257, 259, 261, 263 and 265. The output of NAND gate 236 is connected to $\overline{CE}$ pin of section 246, the output of NAND gate 238 is connected to $\overline{CE}$ pin of section 248, the output of NAND gate 242 is connected to $\overline{CE}$ pin of section 250, and the output of NAND gate 240 is connected to $\overline{CE}$ pin of section 252.

The numeral 254 denotes a PNP transistor which has the emitter thereof connected to five volts by conductor 84 and which has the collector thereof connected to ground by resistor 260. A voltage divider consisting of resistors 256 and 258 is connected between ground and the Memory Power unit 86 by conductor 90; and the junction between those resistors provides the base voltage for transistor 254. The collector of that transistor is connected to input terminals of NAND gates 262 and 264; and the other input of NAND gate 262 is connected to pin fifteen of decoder 126 by a conductor 123, and the other input of NAND gate 264 is connected to pin two of that decoder by a conductor 125. The power for those NAND gates is supplied by the Memory Power unit 86 via conductor 90 rather than by the Power Supply 82 via conductor 84. The RAM sections 270 and 272 are of standard and usual design; and the output of NAND gate 262 is connected to the $\overline{CS}$ pins of each of those sections. Similarly, the RAM sections 266 and 268 are of standard and usual design; and the output of NAND gate 264 is connected to the $\overline{CS}$ pins of each of those sections. The power for those RAM sections is supplied by the Memory Power unit 86 via conductor 90 rather than by the Power Supply 82 via conductor 84. The I/O ports one through four of each of sections 266 and 270 are connected, respectively, to pins nine through twelve of microprocessor 110 by conductors 265, 263, 261 and 259. The I/O ports one through four of each of the sections 268 and 272 are connected, respectively, to pins thirteen through sixteen of that microprocessor by conductors 257, 255, 253 and 251. Pins five through seven, four through one, seventeen, sixteen and fifteen of each of the sections 266, 268, 270 and 272 of the RAM are connected, respectively, to pins twenty-five through thirty-four of microprocessor 110 by conductors 173, 175, 177, 179, 181, 183, 185, 187, 189 and 191.

The numeral 274 in FIG. 9C denotes a reset switch which has one terminal thereof connected to five volts via conductor 84, and which has the other terminal thereof connected to a resistor 275. The other terminal of resistor 275 is connected to the capacitor 276, a resistor 278 and the input of an inverter 280. The other terminal of capacitor 276 is connected to five volts by the conductor 84, the other terminal of resistor 278 is grounded, and the output of inverter 280 is connected to pin seven of microprocessor 110 by the conductor 53.

The numeral 282 denotes an inverting buffer which receives signals from microprocessor 110 and inverts those signals. Specifically, pin eleven of that inverting buffer receives a $\overline{\text{Series Out}}$ signal from pin twenty-three of microprocessor 110 via conductor 129, and that inverting buffer develops a Series Out signal at pin ten thereof and applies that signal to conductor 155. The buffer receives an $\overline{I/O}$ signal from inverter 128 via conductor 131; and it develops an I/O signal on pin eight thereof which is applied to conductor 157. Buffer 282 receives the NWDS signal from pin one of microprocessor 110 via conductor 137; and it develops a WDS signal at pin six and applies it to conductor 159. That buffer receives the NADS signal from pin thirty-nine of microprocessor 110 via conductor 121, and it develops an ADS signal at pin four which is applied to conductor 161. That buffer receives the NRDS signal from pin two of microprocessor 110 via conductor 135, and it develops an RDS signal at pin twelve which it applies to conductor 163. Various forms of inverting buffers could be used as the buffer 282, but a National Semiconductor 7404 buffer has been found to be useful.

The numeral 284 denotes another octal tri-state buffer; and pins one and nineteen of that buffer are connected together and, via the conductor 241, to the output of NAND gate 140. That NAND gate and conductor can supply a keyboard enable signal to those pins. Pins three, seventeen, five, fifteen, seven, thirteen, nine and eleven of that buffer are connected, respectively, to pins sixteen through nine of microprocessor 110 by conductors 251, 253, 255, 257, 259, 261, 263 and 265; and pins two, eighteen, four, sixteen, six, fourteen and eight are connected, respectively, to data lines zero through six of Keyboard 44 by conductors 902, 904, 906, 908, 910, 912 and 914 which constitute cable 56.

The numeral 298 denotes a push button switch which has one terminal thereof connected to five volts by conductor 84, at which has the other terminal thereof connected to a junction between resistors 288 and 290 that are connected between ground and pin seven of a timing device 286. Although different timing devices could be used, a 555 IC timing device has been found to be useful. A resistor 292 is connected between pins six and seven of that timing device, pins two and six are connected together, and a capacitor 294 is connected between those pins and ground. Pins four and eight of that timing device are connected together and to five volts by conductor 84. A capacitor 296 is connected between ground and pin five of that timing device. Pin three of that timing device is connected to an input of an AND gate 295 which has the other input thereof connected by a conductor 297 to a source of keyboard strobe signals. The output of AND gate 295 is connected to pin twelve of buffer 284.

Figure 10A:
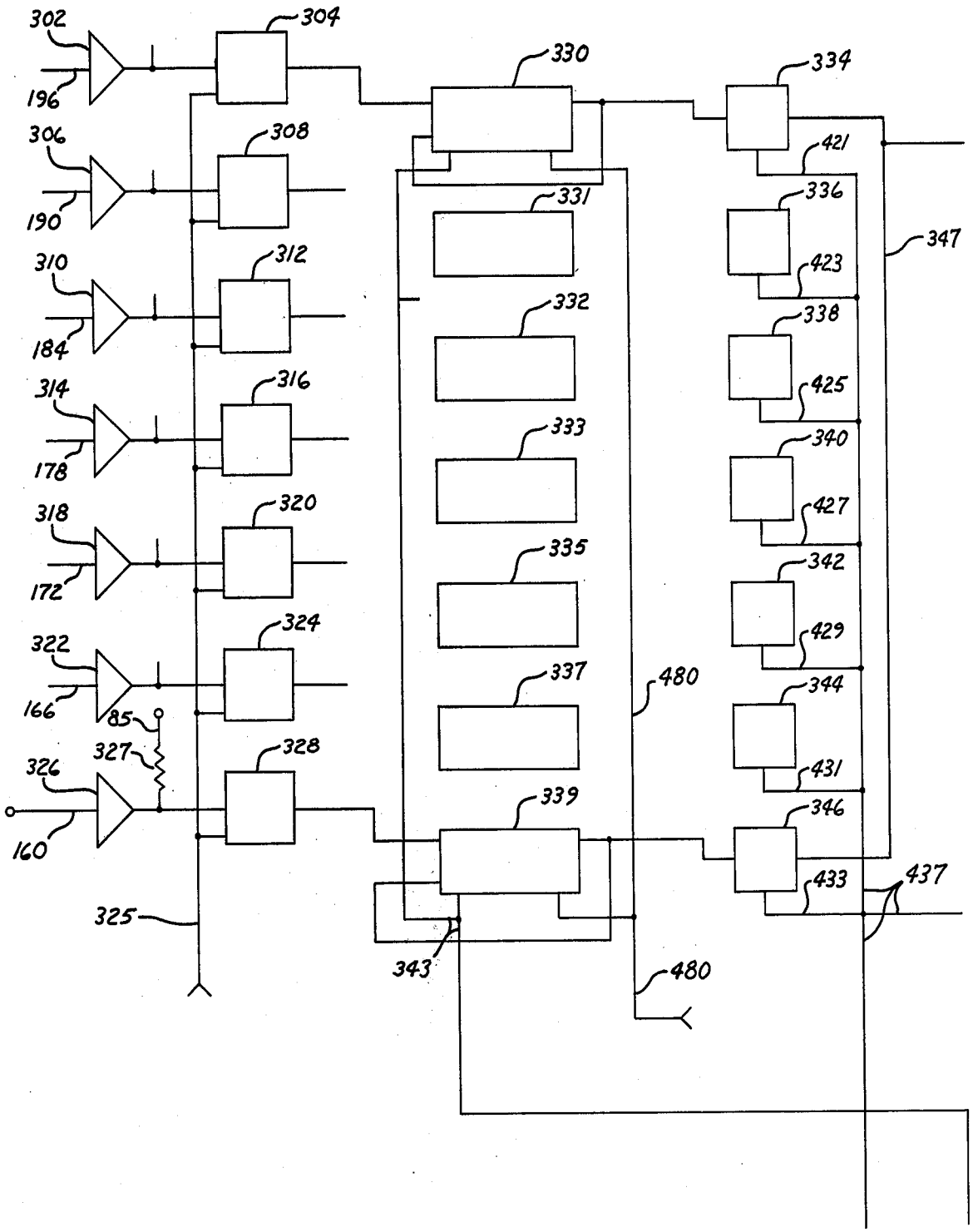
FIGS. 10A–D show the circuitry of the Operator Display block of FIG. 7.

The numerals 302, 306, 310, 314, 318, 322 and 326 in FIG. 10A denote buffer amplifiers which have the inputs thereof connected to the terminals of buffer 149 by conductors 196, 190, 184, 178, 172, 166, and 160, respectively. Those buffer amplifiers have the five volts from conductor 84 applied to them. A resistor 327 is connected between the output of buffer amplifier 326 and the ten volts supplied by conductor 85. Similar resistors, not shown, are connected between the outputs of all of buffer amplifiers 302, 306, 310, 314, 318 and 322 and that ten volts. D-type flip flops 304, 308, 312, 316, 320, 324 and 328 have the D inputs thereof connected, respectively, to the outputs of amplifiers 302, 306, 310, 314, 318, 322 and 326. All of those flip flops have the clock inputs thereof connected to a conductor 325 which is connected to a buffer amplifier 390 that can supply an "A clock" signal to all of those inputs.

The numerals 330, 331, 332, 333, 335, 337 and 339 denote shift registers. Although different shift registers could be used, National Semiconductor CO4031 shift registers have been found to be useful. The data input terminals of those shift registers are connected, respectively, to the outputs of flip flops 304, 308, 312, 316, 320, 324 and 328; but, to simplify the drawing, only the input connections to shift registers 330 and 339 have been shown. Conductors are connected from the outputs to the recirculate inputs of the shift registers 330, 331, 332, 333, 335, 337 and 339, so data which is stepped out of those shift registers may be stepped back into those shift registers. The DR terminals of the shift registers 330, 331, 332, 333, 335, 337 and 339 are connected together by a branched conductor 343; and the clock inputs of those shift registers are connected together by a branched conductor 480. As a result, the data in each stage of all of those shift registers will be clocked at the same instant. If new data is presented to the data input terminals of the shift registers 330-333, 335, 337 and 339 while a logic "0" is on conductor 343, the clock signals on conductor 480 will cause that new data to be clocked into the first stages of those shift registers. However, if a logic "1" is on conductor 343, no new data can be clocked in; and the clock signals on conductor 480 will merely cause the data at the output terminals of those shift registers to be shifted into the first stages of those shift registers.

Figure 10B:
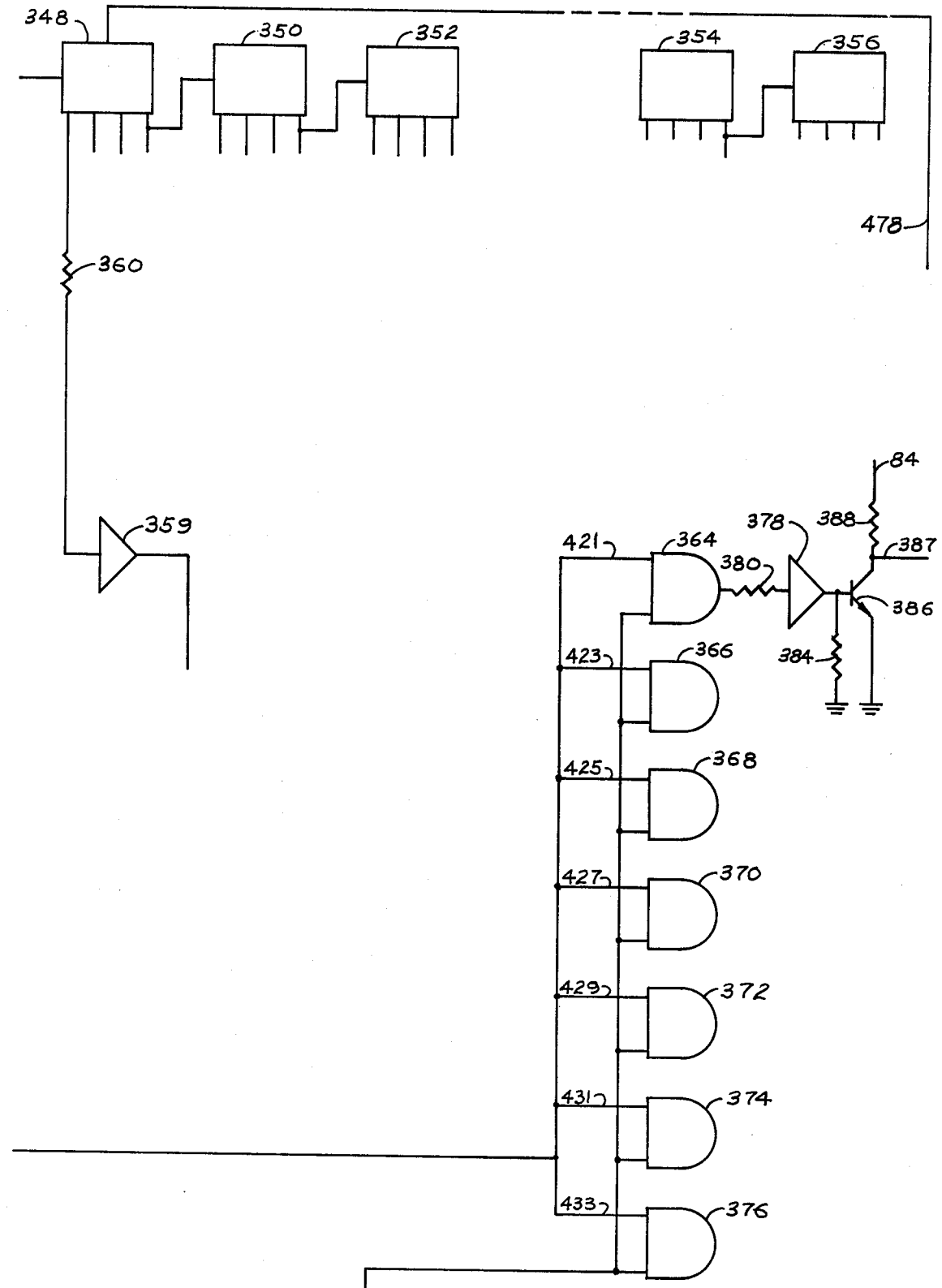

The numerals 334, 336, 338, 340, 342, 344 and 346 denote CMOS switches that have the inputs thereof connected, respectively, to the outputs of shift registers 330, 331, 332, 333, 335, 337 and 339. The outputs of all of those CMOS switches are connected together and to the input of the first section 348 of FIG. 10B, of a serial-in parallel-out sixty-four stage shift register, by a branched conductor 347. The numerals 350, 352, 354 and 356 denote four additional sections which coact with the section 348 and with eleven further sections to constitute the sixty-four bit serial-in parallel-out shift register. The other eleven sections are not shown to simplify the drawing. Although different shift registers could be used as those sections, the CD 4015 shift registers of National Semiconductor have been found to be useful.

A resistor 360 is connected to the output of the first stage of section 348; and that resistor is connected to the input of a Darlington amplifier 359 which has the output thereof connected to all of the anodes of all of the LEDs of the first column of the Operator Display 48. That amplifier is connected to five volts by the conductor 84. The outputs of the other three stages of that section are connected by resistors, not shown, to the inputs of three additional Darlington amplifiers, not shown, which have the outputs thereof connected, respectively, to the anodes of all of the LEDs in the second, third and fourth columns of that Operator Display. In similar manner, the outputs of the stages of the sections 350, 352, 354 and 356 of the serial-in parallel-out shift register are connected, respectively, to Darlington amplifiers, not shown, which have the outputs thereof connected, respectively, to the anodes of the LEDs in the fifth, sixth, seventh, eighth, ninth, tenth, eleventh, twelfth, fifty-seventh, fifty-eighth, fifty-ninth, sixtieth, sixty-first, sixty-second, sixty-third, and sixty-fourth columns of Operator Display 48. The stages of the other eleven stages of that shift register, and an additional forty-four Darlington amplifiers, will be connected to the anodes of the LEDs in the thirteenth through the fifty-sixth columns of that Operator Display. It will be noted that all of the sixteen sections, other than the section 356, will have the output of the stage corresponding to the most significant bit thereof connected to the input of the next-succeeding section of the serial-in parallel-out shift register. In this way, the data that is shifted into each stage which corresponds to the most significant bit is shifted out of that stage and into the stage which corresponds to the least significant bit of the nextsucceeding section whenever those sections are clocked. A branched conductor 478 is connected to the clock inputs of sections 348, 350, 352, 354, 356 and of the other eleven sections, not shown, of the serial-in parallel-out shift registers. As a result, all of those sections will be clocked simultaneously, so the bits in each stage of each of those sections will be shifted simultaneously.

Figure 10C:
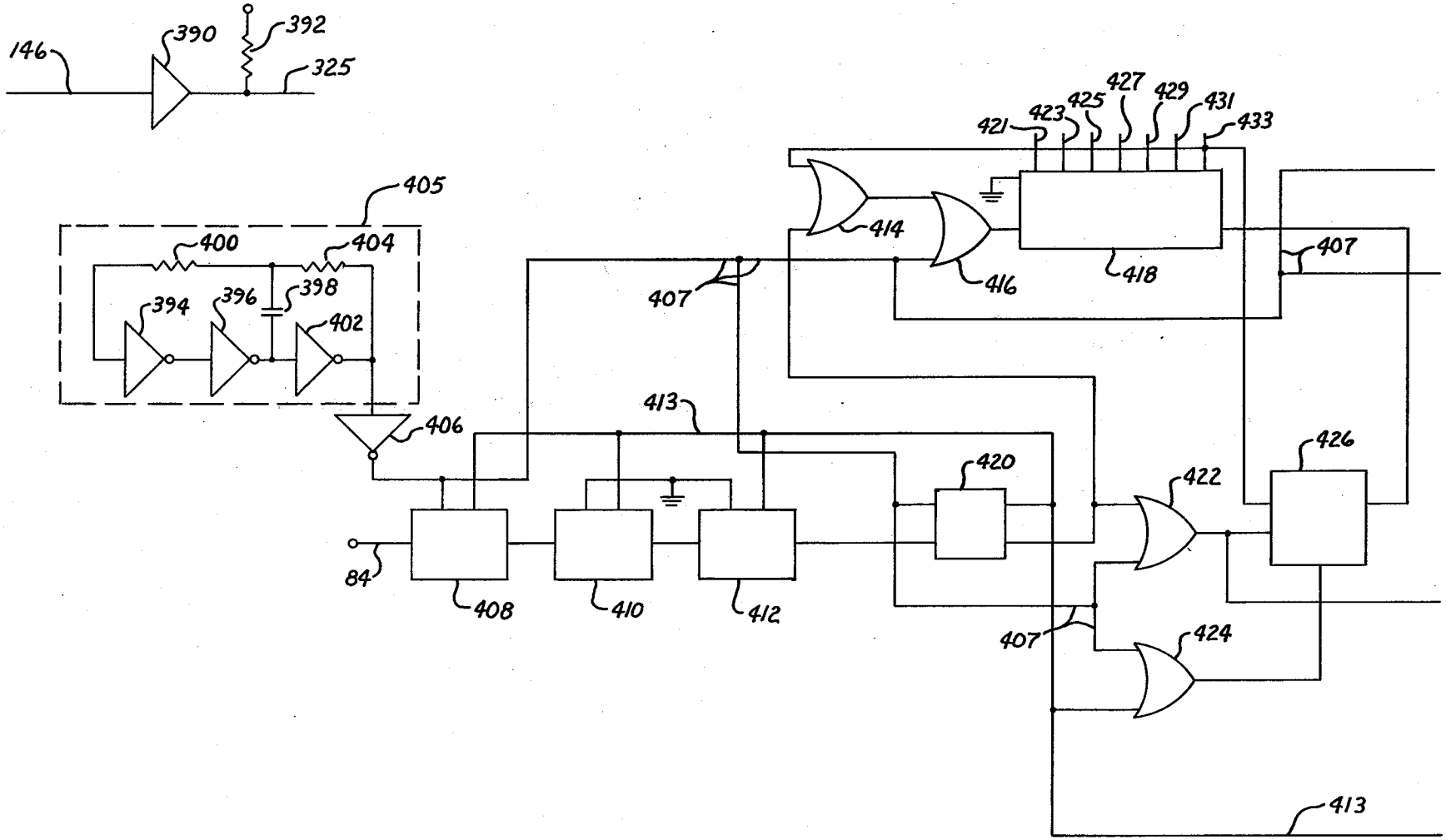

As indicated by FIG. 10C, the input of buffer amplifier 390 can receive a signal via conductor 146 from the OR gate 142 of FIG. 9C; and the output of that amplifier is connected to ten volts by a resistor 392 and conductor 85. In addition to supplying the "A clock" signal to flip flops 304, 308, 312, 316, 320, 324 and 328, the buffer amplifier supplies that signal to resistor 442 and to flip flop 462 in FIG. 10D.

The numerals 394, 396 and 402 in FIG. 10C denote inverters which are connected with a resistor 400, a capacitor 398 and a resistor 404 to constitute an oscillator 405 which provides a pulse train having a frequency of about two megahertz. The numeral 406 denotes three parallel-connected inverters which, for convenience, are shown as a single inverter. The outputs of those parallel-connected inverters are connected together and to the clock input of a binary divider 408, to the lower input of an OR gate 416, to the input of an inverter 417, to the upper input of an AND gate 458, to the clock input of a flip flop 456, to the clock input of a flip flot 420, to the lower input of an OR gate 422, to the upper input of a NOR gate 424, and to the clock input of a D flip flop 472. The output of inverter 417 is connected to the upper inputs of AND gates 460 and 468, and to the lower input of a NOR gate 476, by a branched conductor 407. The "enable" input of binary divider 408 is connected to five volts by conductor 84 to keep it continually "enabled"; and the output of that binary divider is applied to the "enable" input of a binary divider 410. The output of the latter binary divider is connected to the "enable" input of a binary divider 412. The clock inputs of binary dividers 410 and 412 are connected to ground. The output of binary divider 412 is connected to the D input of flip flop 420 by a conductor 413. Each of the three binary dividers is a four bit binary divider; and they are parts of two CD4520 binary divider packages of National Semiconductor. Those binary dividers coact with flip flop 420 to provide a pulse on conductor 413 at the end of each two thousand and fiftieth pulse of the two megahertz wave train from the parallel-connected inverters 406.

The Q output of flip flop 420 is connected to the reset inputs of binary dividers 408, 410 and 412, and also to the lower input of the OR gate 424 and to the reset input of flip flop 472. The $\overline{Q}$ input of flip flop 420 is connected to the lower input of an OR gate 414 and to the upper input of OR gate 422. The output of OR gate 414 is connected to the upper input of OR gate 416; and the output of the latter OR gate is connected to the clock input of a one-of-eight decoder 418. The CE pin of that decoder is connected to ground, pin ten is not used, and the reset pin is connected to the output of a D flip flop 426. Pins two, one, three, seven, eleven, four and five are connected, respectively, by conductors 421, 423, 425, 427, 429, 431 and 433 to the switch-actuating pins of the CMOS switches 334, 336, 338, 340, 342, 344 and 346. Those seven conductors constitute a branched cable 437 which also extends to the upper inputs of AND gates 364, 366, 368, 370, 372, 374 and 376 of FIG. 10B. The conductor 433 also extends to the upper input of OR gate 414 and to the D input of flip flop 426.

Each of AND gates 364, 366, 368, 370, 372, 374 and 376 is part of a row selection switch; and the other parts of the row selection switch of which the AND gate 364 is a part are shown. Those other parts include a resistor 380 which connects the output of that AND gate to the input of an NPN Darlington amplifier 378 which is connected to five volts by conductor 84 and which has the output thereof connected to the base of an NPN transistor 386. A resistor 384 has the lower terminal thereof connected to ground and has the upper terminal thereof connected to the output of that Darlington amplifier and to the base of that transistor. The emitter of that transistor is grounded. A resistor 388 is connected between the collector of that transistor and five volts by conductor 84; and a conductor 387 extends from that collector to the cathodes of all of the LEDs of the row one of the Operator Display 48. The collectors of the row selection switches, of which AND gates 366, 368, 370, 372, 374 and 376 are parts, are connected, respectively, to the cathodes of the LEDs in the second, third, fourth, fifth, sixth and seventh rows of LEDs of that Operator Display. In this way, a signal on conductor 421 will cause a signal to be applied to the cathodes of all of the sixty-four LEDs in the first row of Operator Display 48, a signal on conductor 423 will cause a signal to be applied to the cathodes of all of the sixty-four LEDs in the second row of that Operator Display, a signal on conductor 425 will cause a signal to be applied to the cathodes of all of the sixty-four LEDs in the third row of that Operator Display, and so on.

The numeral 430 denotes an NPN transistor which has the emitter thereof grounded. An adjustable resistor 432 and a resistor 434 are connected between the ten volts from conductor 85 and the collector of that transistor, the upper terminal of a capacitor 436, and pins six and seven of a timing device 438. Although different timing devices could be used, a 555 IC timing device has been found to be useful. Pin one of that timing device is grounded, a capacitor 440 is connected between ground and pin five of that timing device, and pins four and eight are connected together and to the ten volts by conductor 85.

The output of OR gate 422 is connected to the clock input of flip flop 426 and of a flip flop 454. The D input of flip flop 454 is connected to ten volts by conductor 85; and the Q output of that flip flop is connected to all of the DR pins of shift registers 330, 331, 332, 333, 335, 337 and 339 by the branched conductor 343, to the base of transistor 430 via a resistor 428, and to the D input of flip flop 456. The $\overline{Q}$ output of flip flop 454 is connected to pin two of timing device 438, to an input of an AND gate 470, and to the reset inputs of binary dividers 464 and 466 by a branched conductor 345.

Figure 10D:
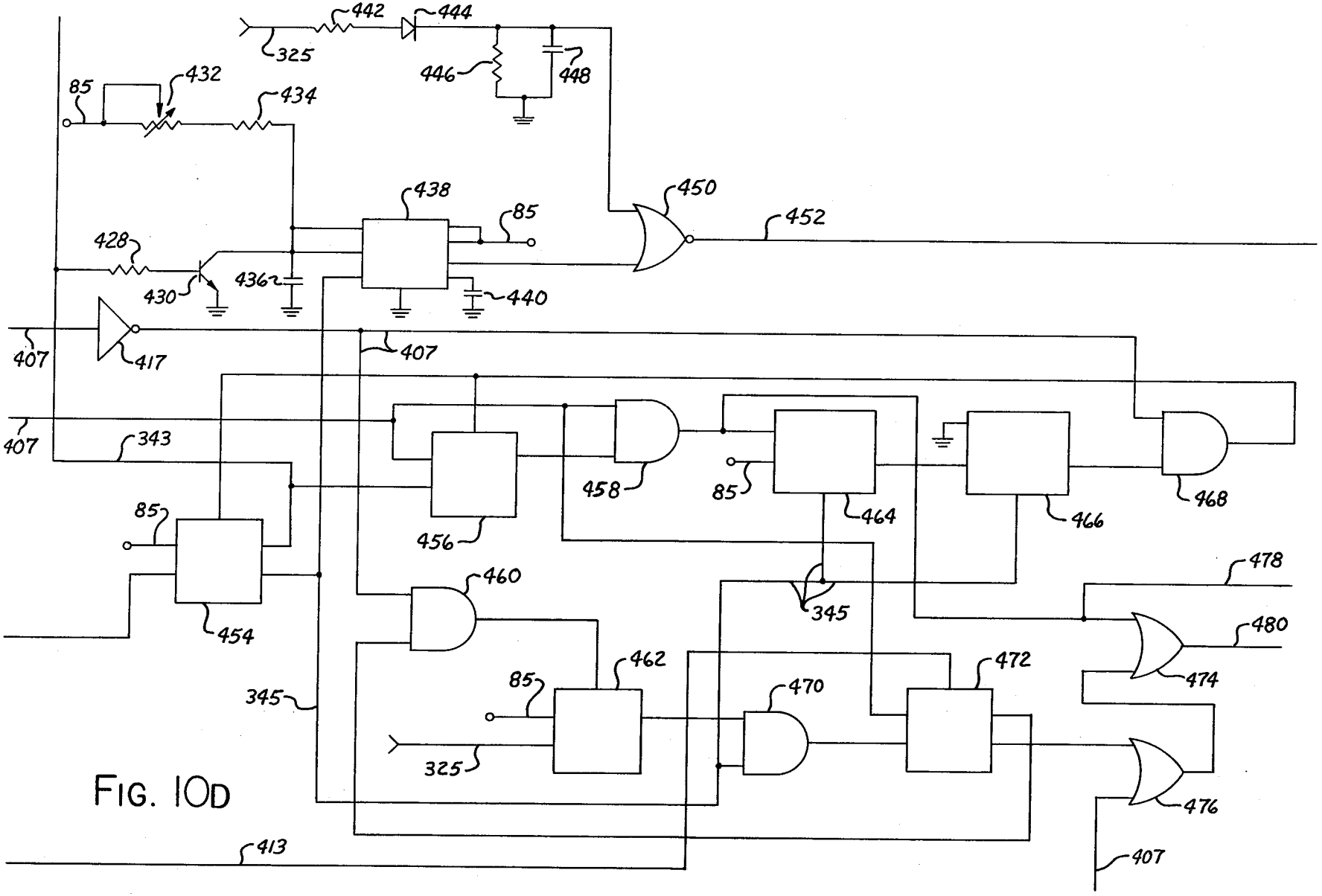

The resistor 442 in FIG. 10D, which has one terminal thereof connected to conductor 325, has the other terminal thereof connected to an input of a NOR gate 450 by a diode 444. A resistor 446 and a capacitor 448 are connected in parallel between the cathode of diode 444 and ground. Pin three of timing device 438 is connected to the other input of NOR gate 450; and the output of that NOR gate is connected by a branched conductor 452 to the other inputs of each of the AND gates 364, 366, 368, 370, 372, 374 and 376 of the row selection switches.

The enable input of binary divider 464 is connected to ten volts by conductor 85; and the output is connected to the enable terminal of binary divider 466. The output of the latter binary divider is connected to the lower input of the AND gate 468. The output of AND gate 458 is connected to the clock input of binary divider 464, to the upper input of OR gate 474 and to the branched conductor 478. The clock input of binary divider 466 is grounded. The output of AND gate 468 is connected to the reset inputs of flip flops 454 and 456.

The Q output of flip flop 472 is connected to the lower input of AND gate 460; and the output of that AND gate is connected to the reset input of the flip flop 462. The D input of that flip flop is connected to ten volts by conductor 85; and the output of that flip flop is connected to the upper input of AND gate 470.

The $\overline{Q}$ output of flip flop 472 is connected to the upper input of the NOR gate 476; and the output of that NOR gate is connected to the lower input of NOR gate 474. The output of the latter NOR gate is connected to the branched conductor 480.

The output of NOR gate 424 is connected to the reset input of flip flop 426. The Q output of flip flop 456 is connected to the lower input of AND gate 458. The output of AND gate 470 is connected to the D input of flip flop 472.

Figure 11A:
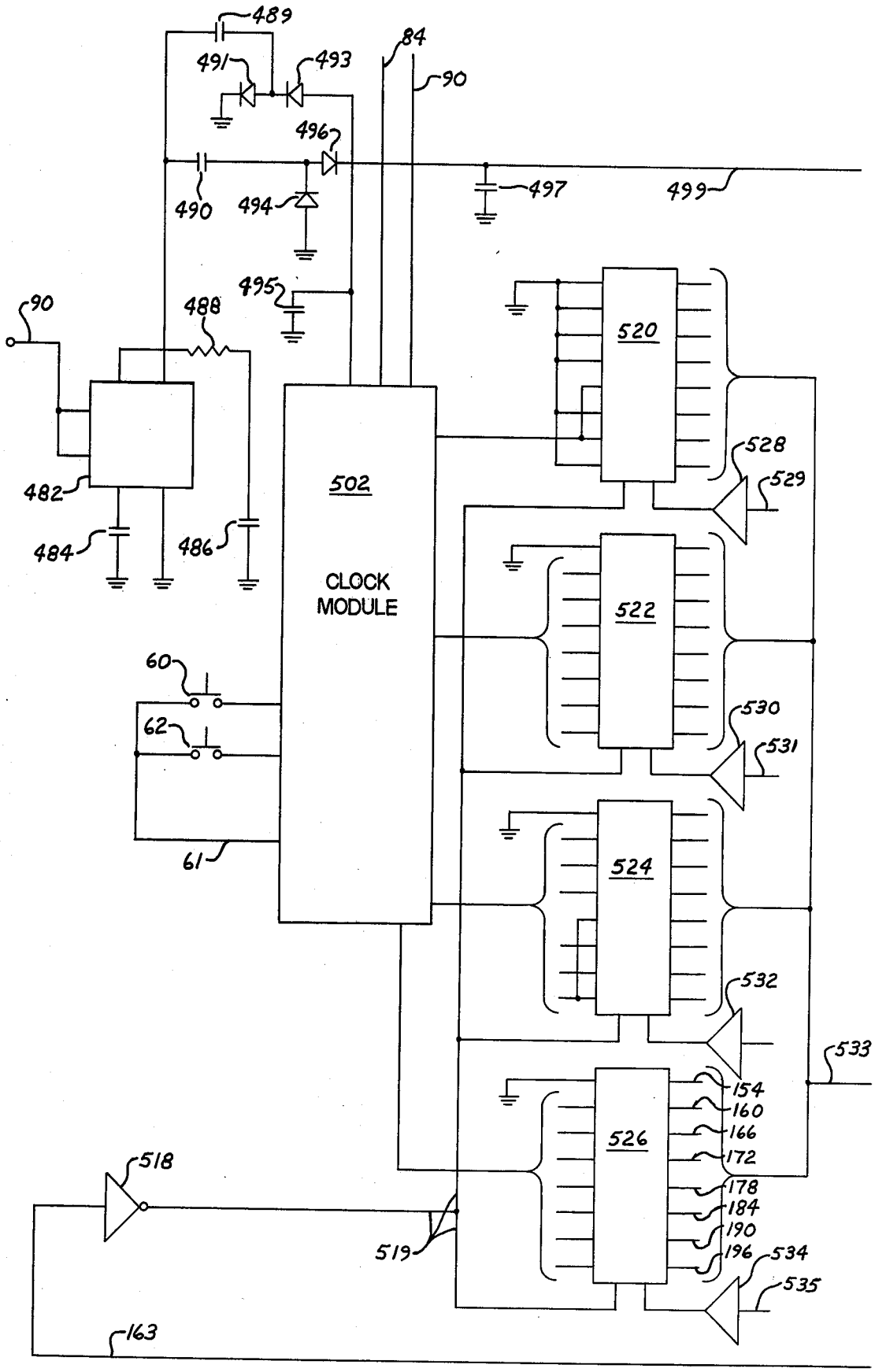
FIGS. 11A and B show the circuitry of the Time And Temperature block of FIG. 7.

Referring particularly to FIG. 11A, the numeral 482 denotes a timing device; and, in the said preferred embodiment, that timing device is another 555 IC timing device. Pins four and eight of that timing device are connected together and to the Memory Power unit 86 by conductor 90. A capacitor 484 is connected between ground and pin five of that timing device, and pin one is grounded. A capacitor 486 has one terminal thereof grounded, and has the other terminal thereof connected to pins two and six of the timing device 482 and also to one terminal of a resistor 488. The other terminal of that resistor is connected to pins three and seven of that timing device, and also to one terminal of a capacitor 489 and to one terminal of a capacitor 490. A diode 491 has the anode thereof connected to the other terminal of capacitor 489, and has the cathode thereof connected to ground. A diode 493 has the cathode thereof connected to the other terminal of capacitor 489; and a capacitor 495 has one terminal thereof connected to the anode of that diode and the other terminal grounded. A diode 494 has the cathode thereof connected to the other terminal of capacitor 490, and has the anode thereof grounded. A diode 496 has the anode thereof connected to the other terminal of capacitor 490, and has the cathode thereof connected to one terminal of a capacitor 497 and also to a conductor 499; and that conductor will have a boosted D.C. voltage thereon.

A conductor 504 is connected to a junction between the anode of diode 493 and the adjacent terminal of capacitor 495, and that conductor extends to a clock module 502. Although different clock modules could be used, the MA 1003 clock module of National Semiconductor has been found to be useful. The fixed contact of the hour-setting switch 60 extends into that clock module; and, similarly, the fixed contact of the minute-setting switch 62 extends to that clock module. The conductor 61 which is connected to the movable contacts of both of those switches also extends to that clock module.

Figure 9F:
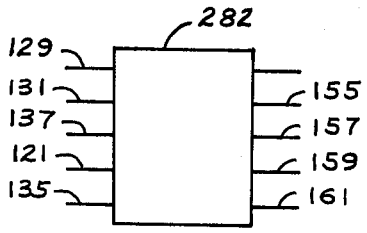
Figure 9F:
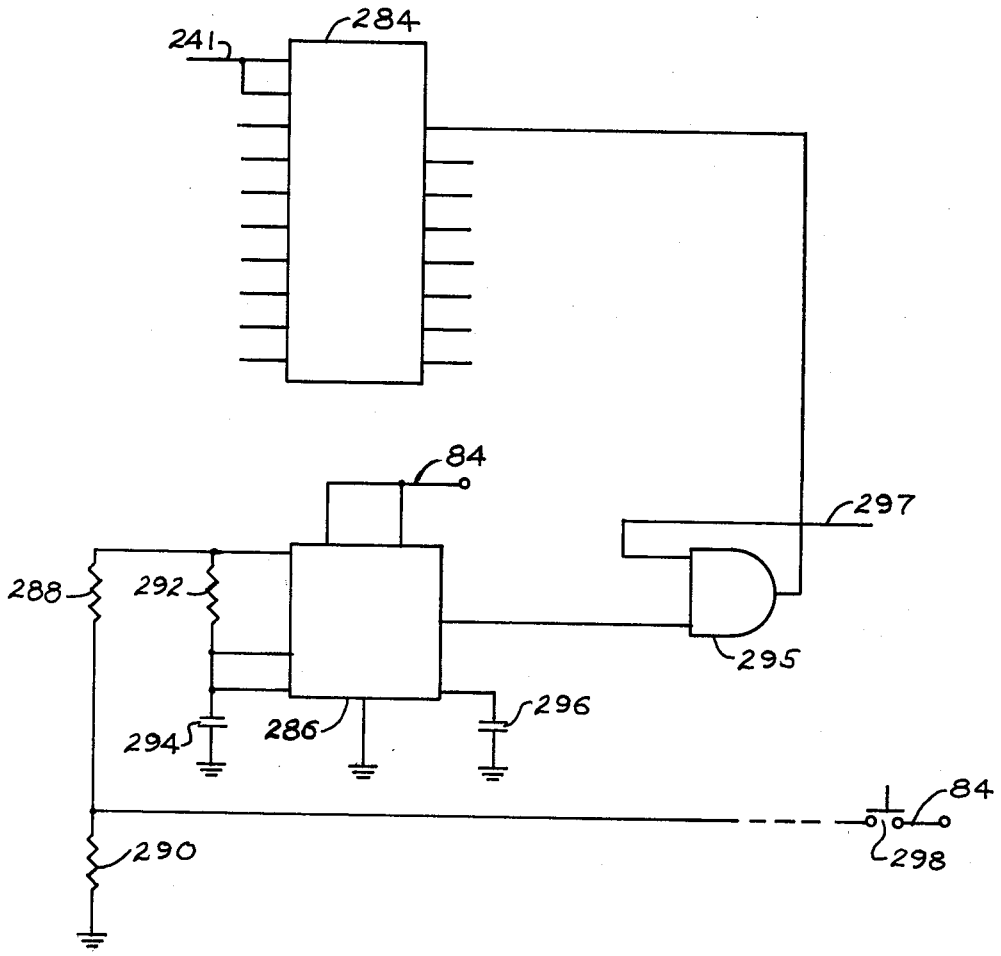

The numeral 518 denotes an inverter which has the input thereof connected to pin twelve of inverting buffer 282 in FIG. 9F by conductor 163. A branched conductor 519 extends from the output of that inverter to pins one of four octal tri-state buffers 520, 522, 524 and 526. Pins two, four, twelve, fourteen, sixteen and eighteen of buffer 520 are connected to ground; and pins six and eight are connected together and to the H1 b/c input of clock module 502. Pin two of buffer 522 is grounded, and pins twelve, eight, fourteen, six, sixteen, four and eighteen are connected to pins H0 a through g of that clock module. Pin two of buffer 524 is grounded and pins twelve and six are connected together and to the M1 a/d pin of clock module 502. Pins eight, fourteen, sixteen, four and eighteen of that buffer are connected, respectively, to the M1 b, c, e, f and g pins of that clock module. Pin two of buffer 526 is grounded; and pins twelve, eight, fourteen, six, sixteen, four and eighteen are connected, respectively, to the M0 a through g pins of the clock module 502. Pins eleven of all of the buffers 520, 522, 524 and 526 are connected together and to pin sixteen of microprocessor 110 via conductor 196, buffers 149 and 147, and conductor 251. Pins nine of all of those buffers are connected together and to in fifteen of that microprocessor via conductor 190, buffers 149 and 147, and conductor 253. In similar fashion, conductors 255, 257, 259, 261, 263 and 265, buffers 147 and 149 and conductors 184, 178, 172, 166, 160 and 154 connect pins fourteen through nine, respectively, of that microprocessor to pins thirteen, seven, fifteen, five, seventeen and three of all of the buffers 520, 522, 524 and 526. The conductors 196, 190, 184, 178, 172, 166, 160 and 154 constitute the eight-conductor cable 68 of FIG. 7.

The numeral 528 denotes an inverter which has the input thereof connected to pin three of decoder 130 of FIG. 9B by a conductor 529. The output of that inverter is connected to pin nineteen of buffer 520. The numeral 530 denotes an inverter which has the input thereof connected to pin four of decoder 130 by a conductor 531; and the output of that inverter is connected to pin nineteen of buffer 522. The numeral 532 denotes an inverter which has the input thereof connected to pin seven of decoder 130 by a conductor 533; and the output of that inverter is connected to pin nineteen of buffer 524. The numeral 534 denotes an inverter which has the input thereof connected to pin six of decoder 130 by a conductor 535; and the output of that inverter is connected to pin nineteen of buffer 526. Those conductors plus three conductors 601, 603 and 537 constitute the seven-conductor cable 66 of FIG. 7.

Figure 11B:
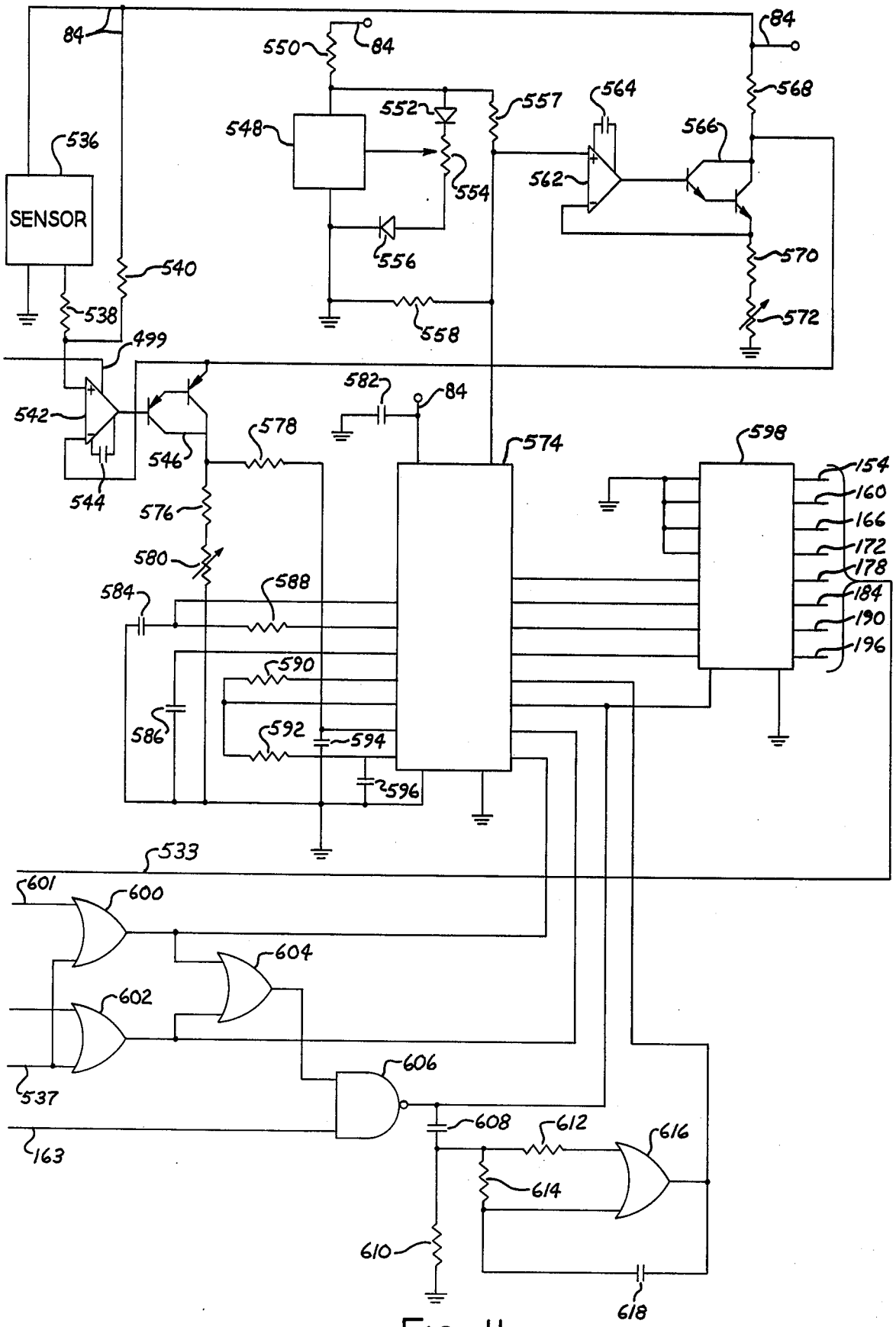

The numeral 536 of FIG. 11B denotes a temperature sensor which is sealed into a probe assembly; and the National Semiconductor LM 3911 IC temperature sensor has been found to be useful. That sensor is factory calibrated to provide an output of a negative one-hundredth (0.01) of a volt per degree Kelvin relative to the five volts supplied to that sensor by conductor 84. Resistors 540 and 538 are connected in series between the conductor 84 and the output of sensor 536; and the ground terminal of that sensor is connected to the analog ground of the Time And Temperature unit 58. Resistors 540 and 538 constitute a voltage divider; and the junction between those resistors is connected to the non-inverting input of an operational amplifier 542. A capacitor 544 is connected between two terminals of that amplifier; and the boosted D.C. voltage on conductor 499 is applied to that amplifier.

The numeral 548 denotes a voltage regulator; and a resistor 550 connects one terminal of that voltage regulator to five volts via conductor 84; and the ground terminal of that voltage regulator is connected to the analog ground. A diode 552, a potentiometer 554 and a diode 556 are connected between the lower terminal of resistor 550 and the analog ground; and the output of that voltage regulator is connected to the movable contact of potentiometer 554. As a result, that voltage regulator will establish a predetermined, desired voltage at the anode of diode 552. A resistor 557 and a resistor 558 are connected in series between the anode of diode 552 and the analog ground to constitute a voltage divider which will apply a regulated positive two volts to the non-inverting input of an operational amplifier 562, and also to pin sixteen of an analog-to-digital converter 574. A capacitor 564 is connected between two terminals of operational amplifier 562. A resistor 568 connects the five volts on conductor 84 to a NPN Darlington amplifier 566, and to a PNP Darlington amplifier 546, and to the inverting input of operational amplifier 542. The output of Darlington amplifier 566 is connected to analog ground by series-connected resistor 570 and adjustable resistor 572.

The output of operational amplifier 542 is connected to the input of Darlington amplifier 546; and the output of that Darlington amplifier is connected to analog ground by series-connected resistor 576 and adjustable resistor 580, and also is connected to pin nine of the analog-to-digital converter 574 by a resistor 578. A capacitor 594 is connected between pin nine and analog ground; and a capacitor 582 is connected between conductor 84 and ground. That conductor also is connected to pin one of the analog-to-digital converter 574. A capacitor 584 is connected between pin seventeen of that analog-to-digital converter and analog ground; and a resistor 588 is connected between pin eighteen of that analog-to-digital converter and the ungrounded terminal of capacitor 584. A capacitor 586 is connected between pin two of the analog-to-digital converter 574 and analog ground; and resistors 590 and 592 and a capacitor 596 are connected between pin fourteen of that analog-to-digital converter and analog ground. Pin fifteen of that converter is connected to the junction between those resistors, while pin twelve is connected to the junction between resistor 592 and capacitor 596. Pin thirteen of that analog-to-digital converter is connected to analog ground; and pin twenty-two is connected to grounded conductor 92.

The numeral 598 denotes an octal tri-state buffer which has pins one, two, four, sixteen and eighteen thereof grounded. Pins six, eight, twelve, fourteen and nineteen of that buffer are connected, respectively, to pins four, twenty-four, twenty-three, three and nineteen of the analog-to-digital converter 574. Pins eleven, nine, thirteen, seven, fifteen, five, seventeen and three of buffer 598 are connected, respectively, to the corresponding pins of each of buffers 520, 522, 524 and 526, and hence to pins sixteen through nine of microprocessor 110 by cnductors 196, 190, 184, 178, 172, 166, 160 and 154, buffers 149 and 147, and conductors 251, 253, 255, 257, 259, 261, 263 and 265.

The numeral 600 denotes an OR gate which has one input thereof connected to conductor 601; and the other input of that OR gate is connected to conductor 537. The numeral 602 denotes an OR gate which has one input thereof connected to conductor 537 and which has the other input thereof connected to conductor 603. The output of OR gate 600 is connected to one input of an OR gate 604 and also to pin twenty of the analog-to-digital converter 574. The output of OR gate 602 is connected to the other input of OR gate 604 and to pin twenty-one of that analog-to-digital converter. The output of OR gate 604 is connected to one input of a NAND gate 606; and the other input of that NAND gate is connected to conductor 163. The output of that NAND gate is connected to pins nineteen of the analog-to-digital converter 574 and of buffer 598; and it also is connected to one terminal of a capacitor 608 which has the other terminal thereof connected to ground by a resistor 610. A resistor 612 is connected between one input of an OR gate 616 and the upper terminal of resistor 610, and a further resistor 614 is connected between the other input of OR gate 616 and the upper terminal of resistor 610. A capacitor 618 is connected between the output and input of OR gate 616; and that output also is connected to pin seven of the analog-to-digital converter 574.

All of the analog ground connections of FIG. 11B are connected together. Further, those interconnected ground connections are connected to grounded conductor 92. In this way, there can be no potential differences between any of the analog grounds, and there can be no potential differences between any of those analog grounds and the "ground" of the overall sign.

Figure 12:
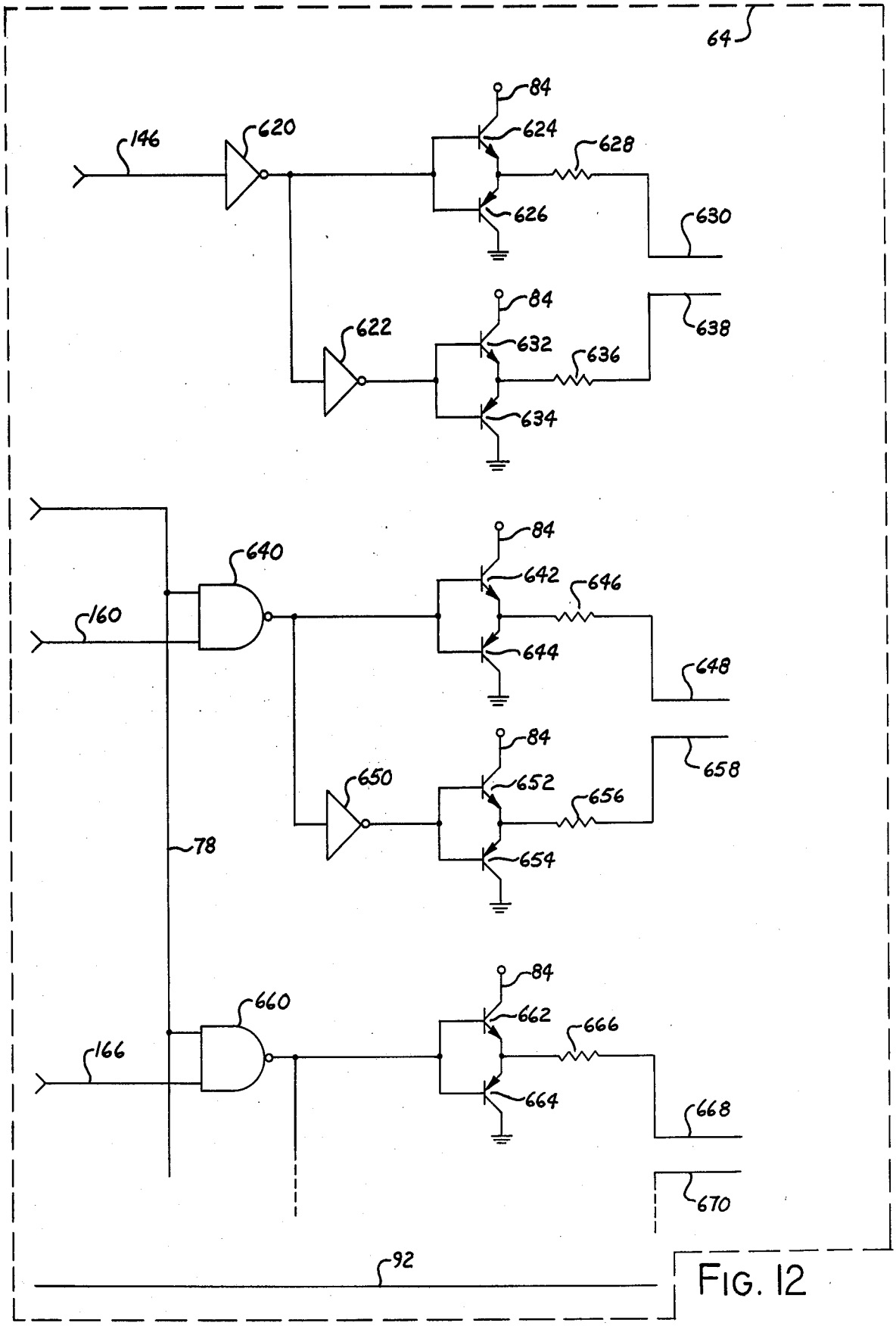
FIG. 12 shows representative circuitry of the Data Transmitter block of FIG. 7.

Referring particularly to FIG. 12, the numeral 620 denotes an inverter which has the input thereof connected to the output of OR gate 142 in FIG. 9C by conductor 146. The output of that inverter is connected to the input of an inverter 622 and also to the bases of series-connected NPN transistor 624 and PNP transistor 626. The collector of transistor 624 is connected to five volts by conductor 84, and the collector of transistor 626 is connected to ground. A resistor 628 connects the emitters of those transistors to a conductor 630 which constitutes part of a balanced line. The output of inverter 622 is connected to the bases of series-connected NPN transistor 632 and PNP transistor 634. The collector of transistor 632 is connected to five volts by conductor 84, and the collector of transistor 634 is connected to ground. A resistor 636 connects the emitters of transistors 632 and 634 to the other conductor 638 of that balanced line.

The numeral 640 denotes a NAND gate which has one input thereof connected to the buffer 149 of FIG. 9C by a conductor 160. The other input of that NAND gate is connected to conductor 78 of FIG. 7. The output of NAND gate 650 is connected to the bases of series-connected NPN transistor 642 and PNP transistor 644. The collector of transistor 642 is connected to five volts by conductor 84, and the collector of transistor 644 is connected to ground. A resistor 646 connects the emitters of transistor 642 and 644 to one conductor 648 of a second balanced line. The output of NAND gate 640 also is connected to an inverter 650; and the output of that inverter is connected to the bases of series-connected NPN transistor 652 and PNP transistor 654. The collector of transistor 652 is connected to five volts by conductor 84, and the collector of transistor 654 is grounded. A resistor 656 connects the emitters of transistors 652 and 654 to a conductor 658 of that second balanced line.

The numeral 660 denotes a NAND gate which has one input thereof connected to the buffer 149 by conductor 166. The other input of that NAND gate is connected to conductor 78. The output of NAND gate 660 is connected to the bases of series-connected NPN transistor 662 and PNP transistor 664. The collector of transistor 662 is connected to five volts by conductor 84, and the collector of transistor 664 is connected to ground. A resistor 666 connects the emitters of those transistors to a conductor 668 of a third balanced line. The output of NAND gate 660 also is connected to an inverter, not shown, which is identical to the inverter 650; and the output of that inverter is connected to a conductor 670 of the third balanced line by series-connected NPN and PNP transistors, not shown, which are identical to the transistors 652 and 654 and also by a resistor which is identical to the resistor 656.

Further NAND gates, inverters, transistors and resistors, not shown, are connected between the conductors 172, 178, 184, 190 and 196 and fourth through eighth balanced lines. Those further NAND gates, inverters, transistors and resistors are connected to the conductors of those further balanced lines in the manner in which the NAND gate 640, transistors 642, 644, 652 and 654, inverter 650 and resistors 646 and 656 are connected to the conductors 648 and 658 of the second balanced line. The resulting eight balanced lines are parts of the cable 91 which extends from the Data Transmitter 64 of FIG. 7. The collectors of the PNP transistors of FIG. 12 are connected to ground via the ground conductor 92.

Referring particularly to FIG. 13, the numerals 672, 674 and 676 denote resistors which apply signals from the conductors 630 and 638 of the first balanced line of FIG. 12 to the non-inverting and inverting inputs of a comparator amplifier 678. The output of that amplifier is connected to the input of an inverter 682, and also is connected to ten volts by a resistor 680 and a conductor 728. The output of that inverter is connected to the bases of an NPN transistor 684 and of a PNP transistor 686 which are connected in series between ten volts and ground by resistors 688 and 690. A conductor 692 is connected to the junction between those resistors.

Resistors 694, 696 and 698 connect conductors 648 and 658 of the second balanced line of FIG. 12 to the non-inverting and inverting inputs of a comparator amplifier 700. The output of that amplifier is connected to the input of an inverter 704, and also is connected to ten volts by a resistor 702 and conductor 728. The output of that inverter is connected to a conductor 706, which constitutes a part of the cable 107 that extends between the Receiver 94 and the display module 22 of FIG. 8.

The numerals 708, 710 and 712 denote resistors which connect the conductors 668 and 670 of the third balanced line of FIG. 12 to the non-inverting and inverting inputs of a comparator amplifier 714. The output of that amplifier is connected to the input of an inverter 718, and also to ten volts by a resistor 716 and conductor 728. The output of that inverter is connected to a conductor 720 which also is a part of cable 107. Conductor 692 will supply clock signals to the electronic package 40 of display module 22, conductor 706 will supply data to the shift register for the seventh row of lamps of that display module, and conductor 720 will supply data to the shift register for the sixth row of lamps. Five additional sets of resistors, comparator amplifiers, pull-up resistors and inverters, not shown, interconnect the remaining balanced lines from the Data Transmitter 64 to conductors, not shown, that supply data to the shift registers for the fifth, fourth, third, second and first row of lamps of display module 22.

The numeral 724 denotes a voltage regulator which is connected to positive twenty-eight volts by a conductor 722. That voltage regulator also is connected to the common ground conductor 92 which, in turn, is connected to negative twenty-eight volts by a conductor 723. A capacitor 726 is connected between the ground conductor 92 and the output conductor 728 of voltage regulator 724; and the latter conductor supplies a regulated ten volts to the upper ends of resistors 680, 702, 716 and of the other five corresponding resistors, not shown. That conductor also supplies ten volts to the collector of transistor 684.

Figure 14:
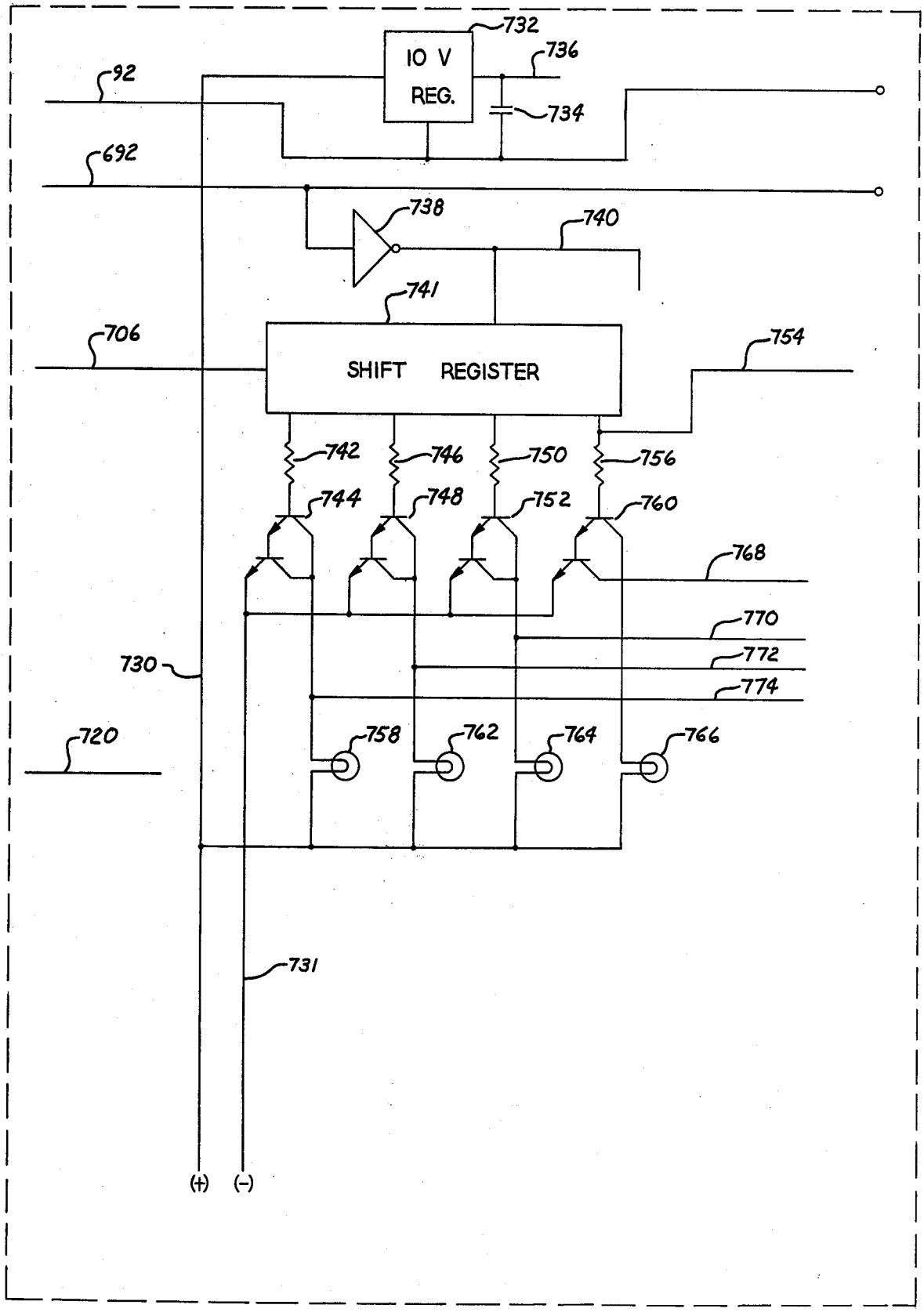
FIG. 14 shows representative circuitry within one of the display modules of the sign of FIG. 1.

Referring particularly to FIG. 14, the numeral 732 denotes a voltage regulator which is connected to positive twenty-eight volts by a conductor 730, and also is connected to ground conductor 92. A capacitor 734 is connected between ground conductor 92 and the output conductor 736 of that voltage regulator. That voltage regulator provides a regulated ten volts, and conductor 736 supplies that voltage to the inverters and shift registers of display module 22.

The numeral 738 denotes an inverter which has the input thereof connected to conductor 692, and which has the output thereof connected to the clock inputs of shift register 741 and of the other six shift registers, not shown, of display module 22 by a branched conductor 740. Although various shift registers could be used, the CD 4015 shift registers of National Semiconductor have been found to be useful. Resistors 742, 746, 750 and 756 connect the four output stages of shift register 741 to NPN Darlington amplifiers 744, 748, 752 and 760. A conductor 731 connects each of those amplifiers to the negative twenty-eight volts. The output of amplifier 744 is connected to the one terminal of socket 24 for lamp 758 in the seventh row of lamps for display module 22; and the other terminal of that socket is connected to conductor 730. The output of amplifier 748 is connected to the one terminal of socket 24 for lamp 762 in that row of lamps, the output of amplifier 752 is connected to the one terminal of socket 24 for lamp 764 in that row of lamps, and the output of amplifier 760 in that row of lamps. The other terminals of those sockets are connected to conductor 730.

A conductor 754 is connected to the junction between resistor 756 and the output of the last stage of shift register 741; and that conductor will be connected to one of the pins of the pin-type male connector 34. Conductors 768, 770, 772 and 774 extend, respectively, from the amplifiers 744, 748, 752 and 760 to pins on the pin-type male connector 32.

Shift register 741, resistors 742, 746, 750 and 756, Darlington amplifiers 744, 748, 752 and 760, and conductors 754, 768, 770, 772 and 774 are representative of the seven sets of shift registers, groups of four resistors, groups of four Darlington amplifiers, and groups of five conductors in display module 22. The clock inputs of the six shift registers, not shown, will be connected to the conductor 740. The data inputs of those six shift registers will be connected to conductor 720, and to the other conductors, not shown, which constitute the output of Receiver 94 of FIG. 13. Each of those shift registers, not shown, will act through its group of resistors and Darlington amplifiers to provide the required illuminating or darkening of the four lamps in the row to which that shift register is dedicated, and also for the lamps in the corresponding row of the paired display module. Also, the last stage of that shift register will supply an input for the first stage of the shift register for the corresponding row of lamps of the next-succeeding display module.

The decoder 126 has pins ten and thirteen thereof connected, respectively, to pins thirty-five and thirty-six of microprocessor 110 by conductors 167 and 169. The decoder 130 has pins ten, thirteen and twelve thereof connected, respectively, to pins twenty-five through twenty-seven of microprocessor 110 by conductors 173, 175 and 177. The decoder 132 has pins ten, thirteen and twelve thereof connected, respectively, to pins twenty-eight through thirty of microprocessor 110 by conductors 179, 181 and 183.

The lower input of NOR gate 230 in FIG. 9A is connected to pin twenty-two of microprocessor 110 by conductor 233. A signal on that conductor constitutes a "flag" signal which can reset the flip flop which is cnstituted by NOR gates 228 and 230; and the program will cause microprocessor 110 to develop that "flag" signal as the Power Supply 82 re-establishes its five volt output after any "power out" period wherein the Memory Power unit 86 failed to maintain five volts on conductor 90.

OPERATION OF SIGN

Only one data output address is required, because both the Operator Display 48 and the Data Transmitter 64 respond to that same decoded address. Where, as in the preferred embodiment, a seven row display matrix is used, only seven lines of data are actually needed; and, in fact, only seven of the data lines are wired to either the Operator Display 48 or the Data Transmitter 64. Those seven data lines are combined with the decoded data output address lines to form the eight line composite signal which contains all of the information required to operate the Operator Display 48 and the main display which is provided by the display modules.

Pin nineteen of microprocessor 110 will provide a logic "1" signal whenever the illuminated display, which is provided by the various display modules, should be "on"; and conductor 77, switch 76 and conductor 78 will, whenever that switch is in the position shown by FIG. 7, supply that signal to the Data Transmitter 64. That signal serves as a "flag" output; and that Data Transmitter logically combines it with the data from the seven-conductor cable 72 by means of NAND gates 640, 660 and the NAND gates in that Data Transmitter which correspond to rows five through one in the various display modules.

Specifically, as long as pin nineteen of microprocessor 110 provides a logic "1", the seven NAND gates in the Data Transmitter 64 will be able to respond to logic "0"s and "1"s from conductors 160, 166, 172, 178, 184, 190 and 196 to supply "1"s and "0"s to the balanced lines that extend to the Receiver 94. Those logic signals will enable that Receiver to supply appropriate signals to the inputs of the shift registers within the display modules, and thereby will cause illumination of the desired lamps. However, if pin nineteen of microprocessor 110 develops a logic "0", the NAND gates of Data Transmitter 64 will be disabled immediately, and hence will not be able to respond to logic "0"s and "1"s from conductors 160, 166, 172, 178, 184, 190 and 196. The resulting "1"s at the outputs of all of those NAND gates will cause Receiver 94 to apply "0"s to all of the inputs of the shift registers of display module 22; and "0"s will thereafter be clocked into all of the stages of all of the seven shift registers of that display module; and of all other front display modules of the sign 20. Thereupon, all of the lamps at the front and rear of that sign will become dark.

All of this means that when the lamps of the sign are in the "on" mode, the Data Transmitter 64 serves as an "output-only" extension of the data bus 70, with the exception that the most significant bit of data is not used. Instead the signal on conductor 146 is used. As long as the signal at pin nineteen of microprocessor 110 is a logic "1", the signals on conductor 146 will enable the display data at the inputs of the NAND gates of Data Transmitter 64 to cause those NAND gates to supply signals to Receiver 94 which will enable the shift registers in the display modules to effect the required illuminating and darkening of the lamps of those display modules. However, when the signal at pin nineteen of microprocessor 110 becomes a "0", the clocking of those shift registers in response to signals on conductor 146 will cause "0"s to be stepped into all stages of all of those shift registers.

Microprocessor 110 addresses twelve lower order bits directly to pins twenty-five through thirty-six, and the four high order address bits are multiplexed on the low order data lines. The address contents of the four order data lines are de-multiplexed by the quad latch 126. Timing for the de-multiplexing is supplied by the NADS signal on conductor 121. Although Computer 52 has a capability of a sixty-four thousand address field, only the lower eight thousand are decoded—with the decoding being true and non-redundant for all eight thousand. This decoding is accomplished by decoder 126 and its associated gates; and it provides eight "pages" of address of one thousand and twenty-four bytes per page. Of those eight pages, three are used for read-only memory, with a fourth page wired to a fourth read-only memory location for furture program expansion. Two of the eight pages are used for the RAM, and one of those pages is assigned to input/output decoding.

With regard to the input/output decoding, only one output is used; and it is used for display data. Eight inputs are used; and four of them are used for digits for the time display, three are used for the digits for the temperature display, and one is used for input from the Keyboard 44. That Keyboard has been made the same address as display data, because one is an input and the other is an output. The decoding is done in a highly simplified manner by use of the one-of-eight decoder 130 which is logically combined with the I/O page address from the one-of-eight decoder 126 via inverter 128 plus the NRSD "read strobe" and the NWDS "write strobe" from microprocessor 110.

It will be noted that OR gates 198, 200 and 206, capacitor 202 and resistor 204 respond to an NRDS signal and to a signal from inverter 128 to develop a delay signal on conductor 208 which is applied to the N hold pin six of microprocessor 110. That delay signal has a duration of just a few micro-seconds, but it permits access of signals from slower external devices, such as the analog-to-digital converter 574 of the Time And Temperature sensing unit 58.

The decoder 132 is wired into the circuitry of FIG. 9B; but it is not used in the preferred embodiment. That decoder is provided in the event the sign 20 had to be constructed to have more than sixty-four columns.

The selection of the desired read only memory sections is accomplished by the page address signals and the NAND gates 236, 238, 240 and 242. The ROM 252 is wired into the circuitry of FIG. 9D; but it is not used in the preferred embodiment. That ROM and the NAND gate 240 will be used only if the sign 20 is made so it requires an unusually complex and lengthy program. The NAND gates 236, 238 and 242 will combine the NRDS signal from microprocessor 110 on conductor 135 with the page addresses from decoder 126 to select the designated ROM locations. Selection of the required sections of the RAM is provided by NAND gates 262 and 264 and by signals from the decoder 126. As shown particularly by FIG. 9B, a signal from pin fifteen of decoder 126 enables NAND gate 262 to select the sections 270 and 272 of the RAM, whereas a signal from pin two of that decoder enables NAND gate 264 to select the sections 266 and 268 of that RAM. The RAM is arranged, and is addressed in pairs, because two MWS 1114 static RAMS are needed for each one thousand and twenty-four byte pages. Although the bit sequence in and out of the RAMS is reversed relative to the designated pin outs, this is acceptable; because a RAM can supply a particular bit as long as the microprocessor can provide the proper addressing signal.

The Computer 52, which is shown in detail by FIG. 9A–F, utilizes two analog frequency generators. The timing device 214 operates continuously at a frequency which can be set by the operator by an appropriate adjustment of the movable contact of adjustable resistor 211. That frequency is applied to pin seventeen of microprocessor 110; and it provides a basic rate multiplier for the activity of information on the main display. That basic rate is modified by message display instructions which are entered by the operator; and it permits the same information to be run at different rates at different times during the display sequence.

The other timing device 286 becomes active when the repeat key 298 is held closed. That timing device will then provide a train of modified strobe pulses at a rate which wil enable the operator to easily enter the same keyboard character repeatedly.

The Computer main input/output data connection is through the octal tri-state buffers 147 and 149. Buffer 147 is enabled for output by the application of an NWDS signal from microprocessor 110 to the upper input of NOR gate 150 of that buffer. The buffer 149 is enabled for input by the application of an NRDS signal from microprocessor 110 to the lower input of NOR gate 148 of that buffer.

The signal at the output of NAND gate 138 of FIG. 9C is of short duration, namely about five hundred nanoseconds. To make that signal conveniently useable, the resistor 143 and the capacitor 144 are connected to OR gate 142 to provide a desired stretching of that signal. As a result, the strobe signal on conductor 146 has a duration greater than five hundred nanoseconds.

Whenever a microprocessor is first turned on, its internal registers must be initialized to put the device into a usuable loop. Such initialization is customarily done by an NRST signal; and that signal is automatically provided on "power up" by the action of capacitor 276 and resistor 278 in FIG. 9C. Specifically, that capacitor will act as a low resistance on "power up", and the resulting large IR drop aross resistor 278 will apply a logic "1" to the input of inverter 280. That inverter will then apply a logic "0" NRST signal to pin seven of microprocessor 110 via conductor 53. The logic "1" at the input of inverter 280 will disappear as capacitor 276 becomes charged; and hence the logic "0" at the output of that inverter will change to a "1". However, the logic "0" NRST signal will have remained long enough to enable microprocessor 110 to initialize its internal registers.

If, at any time, the operator wishes to reset the microprocessor 110, it is only necessary to close reset switch 274. Thereupon, the five volts on conductor 84 will appear at the input of inverter 280 as a logic "1"; and that inverter will apply a logic "0" NRST signal to pin seven of microprocessor 110 via conductor 53. The operator will provide only a momentary closing of switch 274; and, when that switch re-opens, the logic "1" at the input of inverter 280 will disappear, and hence the logic "0" at the output of that inverter will change to a "1".

A program for the microprocessor 110 is stored in the sections 246, 248 and 250 of the ROM. Although different programs could be used with that microprocessor, the preferred program is attached hereto and made a part hereof.

The data from the buffers 302, 306, 310, 314, 318, 322 and 326 in FIG. 10A is clocked into the flip flops 304, 308, 312, 316, 320, 324 and 328, respectively, on the rising edge of the "A clock" signal on conductor 325. The data in those flip flops is then transferred to, and stored within, the serial-in serial-out shift registers 330, 331, 332, 333, 335, 337 and 339. Each of those shift registers has sixty-four stages and hence can hold all of the data corresponding to a full row of the LEDs.

The binary dividers 408, 410 and 412 of FIG. 10C are four-bit binary dividers; and they will respond to each group of two thousand and fifty pulses from the parallel-connected inverters 406 to set the flip flop 420. Specifically, those binary dividers will respond to each two thousand and forty-ninth pulse from those inverters to apply a logic "1" to the D input of flip flop 420; and that flip flop will respond to that "1" and to the "1" which the two thousand and fiftieth pulse will apply to the clock input thereof to change the Q output thereof to a "1" and the $\overline{Q}$ output thereof to a "0". That "0" will act through OR gates 414 and 416 to remove the inhibiting "1" from the clock input of decoder 418; and the "1" on the Q output will be applied directly to the reset input of flip flop 472, will be applied via OR gate 424 to the reset input of flip flop 426, and will be applied directly to the reset inputs of binary dividers 408, 410 and 412. Thereupon, the signal at the D input of flip flop 420 will disappear; and the next pulse from inverters 406 will cause a "0" to reappear at the Q output and a "1" at the $\overline{Q}$ output of that flip flop. That same pulse will cause decoder 418 to apply an output signal to the next-higher conductor—which will be assumed to be conductor 423. The "1" which re-appears at the Q output of flip flop 420 will act through OR gate 422 to "clock" flip flops 426 and 454; but because pin five of decoder 418 is applying a "0" to the D input of flip flop 426, that flip flop will not be set. However, flip flop 454 will become set; and it will apply a "1" to the DR inputs of all of shift registers 330–333, 335, 337 and 339, to the base of transistor 430 and also to the D input of flip flop 456. The "0" at the $\overline{Q}$ output of flip flop 454 will disable AND gate 470 and and will remove the reset signal from binary dividers 464 and 466, but it will not affect the operation of timing device 438.

The next pulse from inverters 406 will cause flip flop 456 of FIG. 10D to be set; and AND gate 458 will then respond to the pulses from inverters 406 to recurrently apply "1"s to the clock input of binary divider 464, to conductor 478 and, via OR gate 474, to conductor 480.

The binary divider 466 normally supplies a "0" to the lower input of AND gate 468; and hence that AND gate will not reset flip flops 454 or 456. However, after sixty-four pulses have been applied to the clock input of binary divider 464 by AND gate 458, binary divider 466 will apply a "1" to the lower input of AND gate 468. The inverter 417 will respond to the "0" portion of the next pulse from inverters 406 to apply a "1" to the upper input of AND gate 468; and, thereupon, that AND gate will supply a reset signal to flip flops 454 and 456 which will reset those flip flops. During the time AND gate 458 was applying the sixty-four pulses to the clock input of binary divider 464, conductor 480 was applying an equal number of pulses to the clock inputs of all of the shift registers 330–333, 335, 337 and 339, and the conductor 478 was applying the same number of pulses to the clock inputs of sections 348, 350, 352, 354, 356 and to the other eleven sections of the serial-in parallel-out shift register. Also, the signal on conductor 423 was holding CMOS switch 336 "on". As a result, all of the data in shift register 331 was stepped into the serial-in parallel-out shift register while also being recirculated back into shift register 331. The "1" at the base of transistor 430 rendered that transistor conductive; and the resulting "0" at pin seven of the timing device 438 enabled that timing device to cause NOR gate 450 to disable all of the row selection switches by applying a "0" to the lower inputs of the NAND gates 364, 366, 368, 370, 372, 374 and 376 of those switches.

When flip flops 454 and 456 are reset after the sixty-four pulses, the "1" at the base of transistor 430 will be removed. Thereupon, capacitor 436 will begin to charge via adjustable resistor 432 and resistor 434; and when the voltage of pin two of timing device 438 reaches a predetermined level, the output of that timing device will enable NOR gate 450 to apply a "1" to the lower inputs of all of the NAND gates of the row selection switches. Thereupon, the row selection switch, that corresponds to the CMOS switch which is "on", will connect the cathodes of the LEDs of the selected row to ground; and hence those LEDs will illuminate or darken in response to the data in the serial-in parallel-out shift register. The LEDs of that row will retain their illuminated and darkened states through the rest of that group of two thousand and fifty pulses.

The overall result is that at the end of each group of two thousand and fifty pulses from inverters 406, a signal on one of the outputs of decoder 418 turns one of the CMOS switches "on", the binary dividers 464 and 466 count sixty-four pulses, the serial-in serial-out shift register which is connected to that CMOS switch steps the data therein into the serial-in parallel-out shift register, and NOR gate 450 keeps all of the LEDs of the Operator Display 48 dark. Also, that serial-in serial-out shift register recirculates its data back into the stages thereof.

The decoder 418 will respond to the end of each group of two thousand and fifty pulses to apply a signal to the next-higher conductor 421, 423, 425, 427, 429, 431 and 433; and, as a result, each of the CMOS switches 334, 336, 338, 340, 342, 344 and 346 will be turned "on" in turn. Consequently, each of the serial-in serial-out shift registers 330–333, 335, 337 and 339 will successively step the data therein into the serial-in parallel-out shift register for display during the rest of that group of two thousand and fifty pulses.

At the time the decoder 418 applies a signal to conductor 433, that signal will be applied to the D input of flip flop 426, and also will be applied via OR gates 414 and 416 to keep OR gate 416 from applying further pulses to the clock input of that decoder until that decoder is reset. As a result, that decoder will continue to enable conductor 433 to enable CMOS switch 346, and to apply a "1" to the D input of flip flop 426 until the end of that group of two thousand and fifty pulses. When flip flop 420 becomes set at the end of that group of two thousand and fifty pulses, it will permit OR gate 422 to pass a pulse to the clock input of flip flop 426; and, thereupon, that flip flop will apply a reset signal to decoder 418. The signal which that decoder will develop on conductor 421 will be developed after flip flop 420 has been set and reset; and hence that signal will remain on that conductor through the rest of the groups of two thousand and fifty pulses.

The timing device 438 is connected as a modified delay-type monostable multivibrator. After the transistor 430 becomes non-conductive at the end of the sixty-four pulses, the capacitor 436 and adjustable resistor 432 and resistor 434 will coact to maintain a "1" at input pin three of that timing device for a short time. However, when that capacitor becomes charged, that timing device will apply a continuous "0" to the input of NOR gate 450 until a further "1" from the Q output of flip flop 454 again renders transistor 430 conductive.

In this way, the binary dividers 408, 410, and 412, decoder 418, the binary dividers 464 and 466, the flip flops 420, 426, 454 and 456, the gates 414, 416, 422 424, 458, 468 and 474, transistor 430 and capacitor 436, the timing device 438, and NOR gate 450 will successively cause the data in shift registers 330–333, 335, 337 and 339 to be shifted into the serial-in parallel-out shift register. Thereafter the LEDs in the appropriate rows of the Operator Display 48 will become illumined or darkened in response to the data which was shifted from those serial-in serial-out shift registers into the serial-in parallel-out shift register via the appropriate CMOS switches 334, 336, 338, 340, 343, 344 and 346. The shifting of data through those CMOS switches continues endlessly, and hence the LEDs in each of the seven rows of the Operator Display 48 will have data supplied to them for slightly less than one-seventh of the time. The retentivity of the human eye is such that an operator's eyes will respond to the successive illumining of some or all of the LEDs in the seven rows of the Operator Display 48 to sense a seemingly-simultaneous display by all seven of those rows. As a result, the present invention is able to provide a display of data in the seven rows of LEDs without the cost, space and energy consumption which would be involved in providing an additional ninety-six shift register sections such as the section 348, an additional three hundred and eighty-four Darlington amplifiers such as the amplifier 359, and an additional three hundred and eighty-four resistors such as resistor 360.

The apparent or seeming brightness of the LEDs is a function of the time which is required for the capacitor 436 to recharge. By appropriately setting the movable contact of adjustable resistor 432, the rate of charge, and hence the total time of charge, of capacitor 436 can be varied to provide a desired level of apparent brightness for the LEDs.

If, at the time the program causes microprocessor 110 to develop an NWDS signal and apply it to the upper input of NOR gate 136 in FIG. 9C via conductor 137, a "0" is being applied to the lower input of that NOR gate and a "1" is being applied to the lower input of AND gate 138, a "1" will appear on conductor 146 and be applied to the input of buffer amplifier 390 in FIG. 10C. The resulting "A clock" signal on conductor 325 will be applied to the clock inputs of all of the flip flops 304, 308, 312, 316, 320, 324 and 328, to the clock input of flip flop 462 in FIG. 10D, to the input of NOR gate 450 via conductor 325, resistor 442 and diode 444. The RC network 446 and 448 will momentarily retain the application of that "A clock" signal to NOR gate 450; but, as capacitor 448 becomes discharged, that NOR gate will apply a "1" to the NAND gates of each of the row selection switches. Consequently, as long as that "A clock" signal is retained, all of the LEDs of the Operator Display 48 will be dark.

Flip flop 462 will respond to that "A clock" signal to apply a "1" to the upper input of AND gate 470. If that "A clock" signal is developed at a time when conductors 480 and 478 are not supplying stepping pulses to the serial-in serial-out and serial-in parallel-out shift registers, the $\overline{Q}$ output of flip flop 454 will be applying a "1" to the lower input of AND gate 470. As a result, that AND gate will apply a "1" to the D input of flip flop 472, with a consequent "1" at the Q output and a consequent "0" at the $\overline{Q}$ output of that flip flop. AND gate 460 will respond to that "1" to apply a reset signal to flip flop 462; and NOR gate 476 will respond to that "0" to enable the next "0" of the inverted pulse train from inverter 417 to apply a "1" to the lower input of OR gate 474, and hence to conductor 480. That "1" will cause all of the serial-in serial-out shift registers to shift into the first stages thereof the data which had been stored in the flip flops 304, 308, 312, 316, 320, 324 and 328. During the succeeding recirculations of the data in the serial-in serial-out shift registers, the new data together with the remaining portions of the original data will be stepped into the serial-in parallel-out shift register on a row-by-row basis.

In the event the "A clock" signal is developed during a sixty-four pulse recirculation period, the "1" at the Q output of flip flop 454 will be present at the DR inputs of the serial-in serial-out shift registers to hold them in their data recirculation modes. The "0" at the $\overline{Q}$ output of that flip flop will be applied to the lower input of AND gate 470; and the resulting "0" output of that AND gate will not affect flip flop 472. The "1" at the $\overline{Q}$ output of the latter flip flop will cause a "0" to appear at the output of NOR gate 476 throughout the rest of the recirculation period. However, when flip flop 454 is reset at the end of that recirculation period, the "1" will be removed from the DR inputs of the serial-in serial-out shift registers, and a "1" will be applied to the lower input of AND gate 470. The flip flop 472 will respond to the resulting "1" at the D input thereof and to the next positive pulse from inverter 417 to become set; and NOR gate 476 will respond to the resulting "0" at the $\overline{Q}$ output of that flip flop and to the next "0" of the inverted pulse train from inverter 417 to cause NOR gate 476 to apply a "1" to OR gate 474, and hence to conductor 480. The application of that "1" to the clock inputs of the serial-in serial-out shift registers will, because those shift registers are not being held in their recirculation mode, cause those shift registers to step the new data, from flip flops 304, 308, 312, 316, 320, 324 and 328, into the first stages thereof. That "1" thus will act like a sixty-fifth shifting pulse; and it will cause new data to be introduced into the first stage, and it will cause old data to be stepped out of the last stage, of each of the serial-in serial-out shift registers. In this way, any data which is supplied by the microprocessor 110 during a recirculation period is not lost and, instead, is held within the flip flops 304, 308, 312, 316, 320, 324 and 328 until the end of that recirculation period, and then is stepped into the first stages of the serial-in serial-out shift registers.

The "A clock" signal on conductor 325 also will be applied to the upper input of NOR gate 450 via resistor 442 and diode 444. That signal will force a "0" to appear on conductor 452, and thereby will cause the AND gates 364, 366, 368, 370, 372, 374 and 376 of the row selection switches to keep all of the LEDs of all of the rows of the Operator Display 48 dark until the new data has been entered into the serial-in serial-out shift registers.

The information which is displayed by the sign 20 can, if desired, be displayed in a flashing mode or in a rolling mode. This can be accomplished by "rewriting" all of the information displayed by the display modules each time a change is made in that information. That "rewriting" requires a burst of sixty-four "A clock" pulses on conductor 325; and the program will cause the microprocessor 110 to initiate those "A clock" pulses. To keep a "glitter" appearance from developing in the displaying of the information by the sign 20, the lamps displaying that information must be held blank during the entering of those sixty-four "A clock" pulses. That blanking is provided by the resistor 442, diode 444, the RC network 446 and 448, and the NOR gate 450. Specifically during those sixty-four "A clock" pulses, that NOR gate will maintain a continuous "0" on the lower inputs of all of the AND gates of all of the row selection switches.

It will be noted that the signals on conductor 146 and that the signals on the conductors 160, 166, 172, 178, 184, 190 and 196 are supplied simultaneously to the Data Transmitter 64 and to buffer amplifiers 302, 306, 310, 314, 318, 322, 326 and 390. In this way, the same identical strobe-like signal and the same identical data signals are supplied to the Operator Display 48 and also to the Data Transmitter 64 for application to the display modules. Further, it will be noted that serial-in serial-out shift registers 330–333, 335, 337 and 339 receive and store that data and then multiplex it to the serial-in parallel-out shift register.

The transistors 624, 626, 632, 634, 642, 644, 652, 654, 662 and 664 of FIG. 12, the additional two transistors for row six and the additional twenty transistors for rows five through one are biased so they will not saturate. As a result, those transistors can provide extremely fast operation. The termination resistors 628, 636, 646, 656 and 666 and the further termination resistors, not shown, provide damping for any reflected waves. Also, those termination resistors protect the transistors from burn out in the event of a line short circuit. The NAND gates 640, 660 and the five other NAND gates corresponding to rows five through one are provided to force "0"s to appear in all of the stages of all of the shift registers of all of the display modules whenever it is desirable to do so. At such times, those "0"s will appear in all of those stages irrespective of the signals which are applied to conductors 160, 166, 172, 178, 184, 190 and 196.

The inverters 682, 704 and 718 and the five other inverters, not shown, in the Receiver of FIG. 13 are used as buffers. Those inverters are CMOS inverters rather than discrete components.

The conductor 692 in FIG. 13 must have a substantial fan out capability, which is not required for conductors 706 and 720 or for the other five output conductors, not shown, of Receiver 94. That fan out capability is provided by the transistors 684 and 686. Those transistors are never permitted to become saturated and hence are able to provide fast operation.

In the sub-circuit of FIG. 14, the conductor 740 extends to three additional shift registers, not shown, which are connected in parallel so they can be clocked simultaneously. The inverter 738 acts as a buffer as well as an inverter. The resistors 742, 746, 750 and 756 serve as current limiting resistors; and they also isolate the stages of the shift registers so the flow of data to adjacent Darlington amplifiers will not be disrupted in the event any of those amplifiers were to fail.

The voltage regulator 732 is referenced to the signal ground conductor 92. As a result, large transient voltages which could exist on the power ground or on the twenty-eight volt power bus will be isolated from the power which is supplied to the inverters and to the shift registers in the display modules.

The resistors 256, 258 and 260 of FIG. 9E coact with the PNP transistor 254 to constitute a voltage-type sensing circuit. That circuit monitors the five volt power from the Power Supply 82 against the power which the Memory Power unit 86 supplies to the conductor 90. As long as the power from Power Supply 82 is five volts and the Memory Power unit applies five volts to conductor 90, transistor 254 will be conductive, and hence the voltage at the upper end of resistor 260 will apply a logic "1" to the upper inputs of the NAND gates 262 and 264. As a result, those NAND gates will be enabled to respond to the signals which decoder 126 will apply to conductors 123 and 125. However, in the event the voltage which the Power Supply 82 supplies to the emitter of transistor 254 via conductor 84 were to fail, essentially ground voltage would be applied to the upper inputs of those NAND gates. Thereupon, those NAND gates would develop continual "1"s at the outputs thereof, and thereby become unable to respond to any signals on conductors 123 and 125. Consequently, none of the message and display instruction data which had previously been stored in the sections of the RAM could be rewritten; and, instead, that data would be maintained valid despite the failure of the Power Supply 82.

In the event the Power Supply 82 were to fail but the voltage which the Memory Power unit 86 supplies to conductor 90 were to remain a logic "1", the flip flop which is constituted by the NOR gates 228 and 230 in FIG. 9A would remain set. The output signal on the conductor 232 would remain a logic "0" and would be applied to the Sense B input of microprocessor 110. In such event, the subsequent restoration of the power from Power Supply 82 would not affect the flip flop constituted by NOR gates 228 and 230; and the signal on conductor 232, and hence at the Sense B input of microprocessor 110, would continue to remain low. As such, it would constitute a valid Memory Power signal.

However, in the event the Power Supply 82 were to be "off" for a very long time, the battery 88 which is connected to the Memory Power unit 86 could become exhausted. Thereupon, the voltage on conductor 90 would change from a logic "1" to a logic "0"; and capacitor 224 would discharge. The subsequent restoration of the Power Supply 82 would cause that capacitor to apply a positive-going signal to the upper input of NOR gate 228, and thereby set the flip flop. At such time, the signal on conductor 232 would become a "1"; and the microprocessor 110 and the program would respond to that "1" to clear the message locations and display the word "ready". Upon seeing that the message locations had been cleared the operator would re-establish valid message data. The "1" on conductor 232 serves as a reset signal, and the microprocessor 110 and the program respond to that signal to cause the word "ready" to be displayed on the Operator Display 48 and also to reset that microprocessor.

In the event the Power Supply 82 fails but battery 88 continues to enable the Memory Power unit 86 to supply five volts D.C. to the conductor 90, the microprocessor 110 and the program will respond to the restoration of power to cause the Operator Display 48 to display the word "ready". Thereupon, the operator will select a particular portion of the stored message data which he wants to display on the sign 20, and will then appropriately initiate the displaying of that data.

To provide a flashing mode or a rolling mode for the displayed data, the operator need only press the "control" key on the Keyboard 44 and then press the appropriate key or keys on that Keyboard which call for the program to operate the microprocessor 110 in the desired mode. Thereafter, that program will coact with that microprocessor to cause the sign to provide the desired mode for the displayed data until the operator again presses the "control" key on Keyboard 44 and presses appropriate keys to effect a change in that mode.

Referring particularly to FIG. 11A, the timing device 482 is operated as a free running multivibrator to supply signals for the voltage doubler circuit which supplies the boosted D.C. voltage to operational amplifier 542 via the conductor 499. That boosted voltage is about seven volts. The non-inverting input of that operational amplifier will receive a voltage which is proportional to the voltage that the sensor 536 will develop in response to the temperature of the ambient air. At a temperature of minus forty degrees Fahrenheit (−40° F.), the numeric value of the temperature is the same on both the Fahrenheit and Centigrade scales. Also, that temperature is sufficiently low to keep the voltages at the output of the Time And Temperature unit 58 from experiencing reversals of polarity in most geographic areas. Further, that temperature is one of a number of temperatures which supplies the arithmatic conversion of degrees of temperature to corresponding voltages.

At a temperature of minus forty degrees Fahrenheit (−40° F.), the voltage at the non-inverting input of amplifier 542 will be one and one hundred and sixty-five thousandths (1.165) of a volt below the five volts from conductor 84. That operational amplifier and the Darlington amplifier 546 coact to constitute a current source for series-connected resistors 568 and 576 and adjustable resistor 580. The resistor 568 serves as a current reference resistor. The operational amplifier 562 and the NPN Darlington amplifier 566 coact to serve as a current sink which is referenced to the two volts that the voltage regulator 548 supplies to the non-inverting input of that operational amplifier. The amount of current which will be permitted to flow through the Darlington amplifier 566 is controlled by resistor 570 and adjustable resistor 572; and that current flow will be adjusted to cause one and one hundred and sixty-five thousandths (1.165) of a volt to appear across resistor 568. That adjustment plus the adjustment of the ratio between the ohmic value of resistor 568 and the combined ohmic values of resistor 576 and adjustable resistor 580 will provide a voltage at the junction of resistors 576 and 578 of zero at minus forty degrees Fahrenheit (−40° F.) and a slope of one hundredth (0.01) of a volt per degree Fahrenheit. Resistor 578 will apply that voltage to pin nine of the analog-to-digital converter 574; and that analog-to-digital converter will respond to that voltage to develop a binary coded decimal output on pins four, three, twenty-four and twenty-three. That output will provide direct reading in degrees Fahrenheit above minus forty degrees (−40°); and the voltage level to temperature data conversion will be at a resolution of one tenth (0.1) of a degree Fahrenheit. However, in the preferred embodiment, the least significant bit is not used. The logic gates 600, 602, 604 and 606 will respond to signals from decoder 130 via conductors 601, 603 and 537 to select the particular digit of the temperature that is to be displayed at any one time. That decoder will permit only one of the conductors 601, 603 and 537 to go high at any time, and will thereby make certain that only one digit will have the data therefor supplied to buffer 598 at any given instant. That buffer will respond to the binary coded decimal output on pins four, three, twenty-four and twenty-three of the analog-to-digital converter and to the "ground" on its pins two, four, sixteen and eighteen to apply signals to pins sixteen through nine of microprocessor 110 via conductors 196, 190, 184, 172, 166, 160 and 154, buffers 149 and 147, and conductors 251, 253, 255, 257, 259, 261, 263 and 265. The OR gate 616 and the resistor 614 provide a start conversion signal to the analog-to-digital converter 574 after the last digit has been read. Although each digit of the temperature will be read individually, all digits will appear to the viewer simultaneously.

The time can be displayed separately from, or simultaneously with, the temperature or with other data. Similarly, the temperature can be displayed separately from, or simultaneously with, the time or with other data. Usually, the temperature will be displayed both as a Fahrenheit temperature and a Centigrade temperature.

The clock module 502 has a crystal regulated circuit therein which will keep the time data correct over long periods of time. Also, that clock module receives power from the Memory Power unit 86 via conductor 90. As a result, that clock module will be able to supply precise and accurate time data for long periods of time even if the power from the Power Supply 82 is interrupted from time to time.

If at any time it became desirable to do so, the operator could easily make all of the lamps of the sign 20 dark. All the operator would have to do would be to shift the switch 76 of FIG. 7 to the "OFF" position. The resulting application of "0"s to the lower inputs of all of the NAND gates of the Data Transmitter would cause "0"s to be applied to all of the shift registers of all of the display modules; and the Darlington amplifiers of those display modules would then cut off the current to all of the lamps. Importantly, the LEDs of the Operator Display 48 would continue to be illuminated, in the hereinbefore-discussed multiplexing manner, in response to the data in the serial-in serial-out shift registers. Such a setting of switch 76 would enable the operator to view a display of data as he used Keyboard 44 to compare or edit that data—without having any of that data displayed by the display modules of sign 20.

If at any time it became desirable to do so, the operator could easily make the illumination of the lamps of the sign 20 independent of the "flag" signal provided by pin nineteen of microprocessor 110. All the operator would have to do would be to shift the switch 76 of FIG. 7 to the "ON" position. The resulting application of "1"s to the lower inputs of all of the NAND gates of the Data Transmitter would cause those NAND gates to respond to the data signals on conductors 160, 166, 172, 178, 184, 190 and 196 to effect appropriate illuminating and darkening of the lamps of the sign—wholly irrespective of the presence or absence of a signal at pin nineteen of microprocessor 110.

The preferred embodiment of the present invention utilizes an INS 8060 machine code program; and that program controls the operation of the sign 20 and of the Operator Display 48 in response to commands entered from the Keyboard 44. That program provides for the entry, storage and display of up to twenty-six messages which are designated "A" through "P" and are addressable by that Keyboard; and the data in those storage locations are alterable by that Keyboard. The data in the remaining ten locations are permanently stored in various of the sections 246, 248 and 250 of the ROM.

When power is turned on, the Computer 52 determines whether both the main power from the Power Supply 82 and the back-up power from the Memory Power unit 86 had failed, as by determining the state of the signal on conductor 232. If a "1" is present on that conductor, the Computer 52 will "clear" the memory in the sections 266, 268, 270 and 272 of the RAM and will display "ready" on the Operator Display 48. If the back-up from the Memory Power unit 86 had not failed, the Computer 52 would immediately display "ready" on that Operator Display. While the "ready" is being displayed, the Computer 52 turns the Data Transmitter 64 off via conductor 77, switch 66 and conductor 78; and the overall illuminated changeable-display sign is in its stand-by state.

When the Operator Display 48 shows "ready", the overall changeable-display sign can be put into one of three modes. Mode one is the message entry mode; and to enter a message, a memory location must first be selected by using Keyboard 44 to select a key "A" through "P". The Computer 52 will then display the selected letter on the Operator Display; and the desired message entry may begin.

Mode two is the logo entry mode; and to enter a logo, the "L" key must be depressed while holding down the "control" key. The Computer 52 will then display "logo" indicating that the logo routine has been selected. A memory location "A" through "P" must then be selected for storage of that logo therein. When a key "A" through "P" is pressed, the Operator Display 48 will clear, and the logo may be entered.

Mode three is the message displaying mode. To display a message, the "P" key must be depressed while holding down the "control" key. The Computer 52 will then display "play" on the Operator Display 48. The memory location "A" through "Z" to be displayed may now be selected by pressing an appropriate letter key. The sign 20 will begin displaying the message which is stored in that selected memory location.

The various letter-type keys can enter letters in upper or in lower case as desired. Further and additional keys are provided to give the programmer added control of the information which can be displayed by the sign 20. A "Control E" key can terminate a message entry and return the Computer 52 to the stand-by state with "ready" displayed on the Operator Display 48. A "Control P" key allows program control to be transferred from one message subroutine to another. "PL" will be displayed on the Operator Display 48, and must be followed by the letter ("A" through "Z") which signifies the message to which control shall be transferred. Upon completion ofthe subroutine to which control was transferred, control is returned to the prior program. For example, a logo which is stored in memory location "B" can be used in a message which is stored in memory "A" by actuation of the "A" and "B" keys. A "Control R" key causes all subsequent message information to be rolled from bottom to top. An upwardly-directed arrow is displayed on the Operator Display 48 while the Computer 52 is operating in the bottom-to-top roll mode. Actuation of the space bar on the Keyboard 44 will terminate one line of message; and each line of message will automatically be entered midway of the sixty-four columns of the sign 20. To terminate the bottom-to-top roll mode of display, another mode (travel or flash) must be selected. A "Control S" key allows the programmer to control the speed of operation of the sign 20. "SP" is displayed in the Operator Display 48 and must be followed immediately by a letter ("A" through "O") designating the desired speed. "A" is the fastest speed, and "O" is the slowest speed. When given no command, the Computer 52 assumes speed "E". The required speed change is attained by dividing the frequency of the timing device 214 by a number from one to fifteen —depending upon the letter chosen. Thus, A=1, B=2, etc. with O=15. In addition to the division of frequency responsive to the speed command, another division of frequency is provided in response to the selection of the mode. The mode divisor is one for the travel mode, two for the roll mode, and sixteen for the flash mode. Thus, if speed represented by the letter "O" is selected in the flash mode, the incoming frequency is divided by fifteen and then by sixteen—or by a total of two hundred and forty. A "Control T" key causes a horizontal arrow, which points to the left, to be displayed on the Operator Display 48, and the pressing of that key also causes all subsequent characters to be displayed in a travelling fashion.

A "Control U" key causes a "T*T*" to be displayed on the Operator Display 48 and also transfers control to the time and temperature routine. The length of display of the time and temperature routine cannot be controlled by the "SP" key; and, instead can be controlled only by the speed control knob. The time and temperature routine is always flashed on the main display of sign 20. The Computer 52 will remain in the flash mode until another mode (roll or travel) is selected. If the "U" key, which provides the "T*T*" display is pressed immediately following the pressing of the "SP" and "A" keys, the time but not the temperature will be displayed. Such an arrangement allows the time to be continually viewed to facilitate setting the clock module 502.

A "Control F" key causes the Operator Display 48 to display "FL" and also places the Computer 52 in the flash mode. As in the roll mode, centering of each message line is automatic; and a space bar terminates a message line. A "line feed" key is used to enter a space in a message line without terminating the line while in the flash or roll mode. For example, to enter "THIS IS" on one line, the "line feed" key must be used between the two words; because if a space bar had been used, each word would have appeared alone—centered in the overall display of sign 20.

A "rub out" is used to edit a message or a logo while it is being entered. When pushed, that key causes the last-entered character to be wiped out, and also causes all characters to be moved back one space. When in the logo entry routine, the entire last line that was entered is wiped out.

An "escape" key has two functions. While a message is running, the "ESC" key will terminate that message and return the Computer 52 to the stand-by state wherein "ready" will be displayed on the Operator Display 48. The other function of the "ESC" key is to edit the last message which was entered. When the "ESC" key is pushed while the Operator Display 48 is displaying "ready", the first character of the last message entered will be displayed. Each subsequent depression of the "ESC" key will cause the message to be single-stepped onto the Operator Display. If an error is detected, the rubout key or any character key may be pressed, and then the remainder of the message reentered.

At the time the "ready", "play", "logo", "T*T*", arrow, letter or letter-combination designations are being displayed on the Operator Display 48, the microprocessor 110 and the program will keep the lamps of the sign 20 dark by a "0" on conductor 78 via conductor 77 and switch 76. Subsequently, after the selected message has been caused to appear on that Operator Display and on that sign, that microprocessor and that program will permit those various designations to disappear.

Sun shades, which consist of a plurality of vertically-arranged horizontally-directed elongated, narrow, inclined strips of metal, will be mounted at the front and rear faces of sign 20 whenever that sign is to be viewed during daylight hours. Such sun shades are commercially available and are not part of the present invention.

The attached list of components, as well as the attached program, is a part hereof.

PROGRAM FOR ILLUMINATED CHANGEABLE-DISPLAY SIGN

| | | | | | | | | | | | | | | | | |
|---|---|---|---|---|---|---|---|---|---|---|---|---|---|---|---|---|
| (00) | 80 | C4 | 02 | 37 | C4 | 55 | 33 | C4 | 08 | 36 | C4 | 00 | 32 | C4 | 08 | 35 |
| | C4 | 80 | 31 | 06 | D4 | 20 | 98 | 14 | C4 | 80 | C9 | 00 | C4 | 00 | CE | 01 |
| | B9 | 00 | 9C | F8 | C4 | 08 | CA | A2 | C4 | E0 | CA | A3 | C4 | 04 | 07 | C4 |
| | 80 | 32 | 3F | 08 | C4 | D2 | 3F | 09 | C4 | C5 | 3F | 09 | C4 | C1 | 3F | 09 |
| | C4 | C4 | 3F | 09 | C4 | D9 | 3F | 09 | C4 | A0 | 3F | 09 | 3E | 09 | 3F | 03 |
| | 01 | 40 | D4 | E0 | E4 | E0 | 98 | 15 | 40 | E4 | 90 | 9C | 02 | 3F | 0C | 40 |
| | E4 | 9B | 9C | 02 | 3F | 0A | 40 | E4 | 8C | 9C | E3 | 3F | 0B | 40 | 3F | 09 |
| | C4 | 0E | CA | FF | C4 | A0 | 3F | 09 | BA | FF | 9C | F8 | 40 | D4 | 1F | 01 |
| | 40 | CA | A0 | CA | A1 | 3F | 07 | C2 | 80 | 98 | 02 | 3F | 04 | C2 | A2 | CA |
| | 80 | 35 | C6 | 01 | C2 | A2 | CA | 80 | 31 | C6 | FF | C4 | 00 | CD | 01 | 90 |
| | 02 | 90 | 89 | 3F | 03 | 01 | 40 | E4 | FF | 9C | 04 | 3F | 06 | 90 | E4 | 40 |
| | D4 | 60 | 98 | 04 | 3F | 05 | 90 | EB | 40 | E4 | 85 | 98 | E4 | 40 | E4 | 86 |
| | 9C | 04 | C4 | DB | 90 | DF | 40 | E4 | 8A | 9C | 04 | C4 | C0 | 90 | D6 | C4 |
| | 90 | CA | FF | C4 | 00 | CA | FE | 40 | E2 | FF | 98 | 0A | AA | EE | AA | EE |
| | E4 | 96 | 98 | BB | 90 | F1 | 02 | C4 | 03 | F2 | FE | 01 | C0 | 80 | 90 | B5 |
| | DC | E0 | DF | DE | E0 | DD | 35 | 01 | 08 | B2 | 00 | 05 | A8 | C4 | 05 | 07 |
| | C4 | 08 | 37 | C4 | 80 | 33 | C3 | A6 | 01 | 40 | E4 | E0 | 9C | 04 | C4 | 01 |
| | 90 | 0B | 40 | E4 | DB | 9C | 04 | C4 | 10 | 90 | 02 | C4 | 02 | 01 | C4 | 00 |
| | 02 | 01 | 01 | F3 | A4 | 01 | F4 | FF | 9C | F8 | AB | A5 | 60 | 9C | 50 | C4 |
| | 00 | CB | A5 | C3 | A6 | 01 | 40 | E4 | DD | 98 | CF | 40 | E4 | DB | 98 | 1A |
| | 40 | E4 | DF | 98 | 5F | BB | A9 | 01 | C3 | 80 | 01 | C4 | 10 | 37 | C4 | 00 |
| | 33 | 40 | CB | 01 | D4 | 80 | 98 | 27 | 90 | 1C | C4 | 80 | 32 | C4 | 10 | 37 |
| | C4 | 00 | 33 | C4 | 40 | 01 | 02 | C6 | FF | CB | 01 | 40 | F4 | FF | 98 | 03 |
| | 01 | 90 | F3 | C4 | 35 | 32 | 02 | C2 | 00 | F4 | 02 | CA | 00 | 90 | 02 | BA |
| | 00 | C4 | 10 | 37 | C4 | 00 | 33 | C3 | 01 | E4 | 9B | 98 | 07 | C4 | 02 | 37 |
| | C4 | 46 | 33 | 3F | C4 | 08 | 36 | C4 | 75 | 32 | C4 | 2B | CA | 00 | C4 | 00 |
| | CA | 01 | 90 | E9 | C4 | 10 | 35 | CE | FF | C4 | 00 | 31 | CE | FF | C4 | 80 |
| | 32 | C3 | A9 | E4 | 08 | 98 | 2C | C3 | A9 | 9C | 04 | C4 | 07 | CB | A9 | C4 |
| | 40 | 01 | C6 | FF | 1E | CA | 00 | D4 | 80 | DA | 60 | 1C | CA | 60 | C9 | 01 |
| | 02 | 40 | F4 | FF | 98 | 03 | 01 | 90 | E9 | BB | A9 | 9C | 08 | C4 | 08 | CB |
| | A9 | CB | AA | BB | AA | 01 | C4 | 33 | 32 | C6 | 01 | 31 | C6 | 01 | 35 | 40 |
| | 94 | 8D | 90 | 82 | 40 | 98 | 00 | C5 | 01 | D4 | 1F | 01 | 40 | F4 | FF | 08 |
| | CE | F9 | 01 | CE | FF | 06 | CE | FF | C3 | 00 | E4 | 3F | 9C | 4A | C7 | 01 |
| | C3 | 00 | 02 | F3 | 00 | F4 | 0E | 01 | C0 | 80 | 37 | CE | FF | 40 | F4 | F8 |
| | 01 | C0 | 80 | 33 | CE | FF | 3F | 02 | 60 | 05 | 5F | 02 | 8F | 03 | 06 | 03 |
| | 23 | 03 | 96 | 04 | 17 | 03 | BA | 03 | FD | 03 | CF | 04 | 4C | 04 | 9C | 14 |
| | FF | 14 | 5F | 13 | FF | 05 | 91 | C6 | 01 | 33 | C6 | 01 | 37 | C6 | 01 | 07 |
| | C6 | 01 | 01 | C6 | 07 | 3F | 90 | A8 | 90 | 2A | 37 | C4 | 6F | 33 | 3F | 90 |
| | E6 | C4 | 02 | 37 | C4 | 55 | 33 | 08 | C4 | 10 | 35 | CE | FF | C4 | 00 | 31 |
| | CE | FF | C2 | 06 | C9 | 01 | C6 | 01 | 31 | C6 | 01 | 35 | 04 | C4 | 02 | 37 |

-continued

PROGRAM FOR ILLUMINATED CHANGEABLE-DISPLAY SIGN

| | | | | | | | | | | | | | | | | |
|---|---|---|---|---|---|---|---|---|---|---|---|---|---|---|---|---|
| | C4 | 46 | 33 | 3F | C4 | 00 | 37 | CE | FF | C4 | 0C | 33 | CE | FF | 3F | FF |
| | C4 | 02 | 37 | C4 | 55 | 33 | 08 | C2 | 04 | E4 | A0 | 01 | 40 | D4 | 60 | 98 |
| | 05 | 40 | 03 | FC | 20 | 01 | 40 | D4 | 40 | 9C | 0E | C4 | 05 | CE | FF | C4 |
| | FB | CA | 01 | C4 | 05 | CA | FF | 90 | 10 | 40 | D4 | 1F | 01 | C4 | 07 | CE |
| | FE | C4 | 2C | CA | 01 | C4 | 06 | CA | FF | 02 | C2 | 01 | 70 | CA | 01 | C4 |
| | 00 | F2 | 00 | CA | 00 | BA | FF | 9C | F0 | C2 | 01 | 31 | CA | 01 | C2 | 00 |
| | 35 | CA | 00 | C4 | FF | 01 | 40 | 02 | F4 | 01 | 01 | C5 | 01 | CA | 0C | D4 |
| | 80 | 9C | 04 | C6 | FF | 90 | EF | C6 | 80 | C6 | 01 | 35 | C6 | 01 | 31 | 04 |
| | 04 | 02 | 37 | C4 | 46 | 33 | 3F | C4 | 10 | 37 | C4 | 00 | 33 | C3 | 01 | D4 |
| | 80 | 9C | FA | C3 | 01 | D4 | 80 | 98 | FA | C3 | 01 | CA | 04 | C4 | 02 | 37 |
| | C4 | 46 | 33 | 3F | C2 | 03 | 02 | F4 | 0B | 01 | C2 | 80 | 37 | C2 | 80 | 35 |
| | CE | FF | 02 | 40 | F4 | 02 | 01 | C2 | 80 | 33 | C2 | 80 | 31 | CF | FF | C5 |
| | 01 | E4 | FF | 9C | FA | 31 | 01 | 40 | 31 | 40 | E2 | B0 | 9C | 09 | 35 | 01 |
| | 40 | 35 | 40 | E2 | AF | 98 | 2E | C4 | 00 | 32 | 35 | 01 | 40 | 35 | 40 | E6 |
| | 01 | 98 | 04 | C6 | 01 | 90 | F3 | 31 | 01 | 40 | 31 | 40 | E6 | 01 | 9C | FA |
| | 33 | CA | FF | 33 | 37 | CA | FE | 37 | C4 | 73 | 32 | C5 | 01 | CF | 01 | F4 |
| | FF | 98 | C2 | 90 | F6 | C4 | 02 | 37 | CA | AF | C4 | 46 | 33 | CA | B0 | C6 |
| | 01 | 31 | C6 | 01 | 35 | 3F | 3B | C4 | 02 | 37 | C4 | 55 | 33 | C2 | 03 | CD |
| | 01 | 3F | 09 | C4 | FF | C9 | 00 | C4 | 02 | 37 | C4 | 46 | 33 | C5 | 01 | 31 |
| | CA | AE | 31 | 35 | CA | AD | 35 | C5 | FF | 3F | 36 | C2 | 03 | 01 | 03 | C4 |
| | 00 | 78 | 03 | 78 | 03 | FC | 60 | CA | 03 | C4 | 02 | 37 | C4 | 46 | 33 | 3F |
| | C4 | 02 | 37 | C4 | 55 | 33 | C2 | 04 | 3F | 02 | C4 | 00 | 01 | 02 | C6 | FF |
| | 3F | 00 | D4 | 80 | 9C | 06 | 40 | F4 | 01 | 01 | 90 | F2 | C6 | 01 | C6 | 80 |
| | C4 | 00 | 3F | 00 | 3F | 00 | C4 | 02 | 37 | C4 | 46 | 33 | 3F | 7F | C4 | 02 |
| (00) | 37 | C4 | 55 | 33 | C4 | 40 | CA | FF | C4 | 00 | 3F | 00 | BA | FF | 9C | F8 |
| | C4 | 02 | 37 | C4 | 46 | 33 | 3F | 7F | C4 | 02 | 37 | C4 | 55 | 33 | C1 | FF |
| | 98 | 23 | C4 | FF | CD | FF | C4 | 11 | CA | FF | BA | FF | 98 | 06 | C5 | FF |
| | 9C | F8 | C5 | 01 | 3F | 08 | C5 | 01 | 01 | 40 | E4 | FF | 98 | 05 | 40 | 3F |
| | 09 | 90 | F3 | C5 | FF | C4 | 02 | 37 | C4 | 46 | 33 | 3F | 35 | C4 | 02 | 37 |
| | C4 | 55 | 33 | C2 | AC | 01 | 3F | 07 | C6 | 0B | C2 | 80 | 35 | C6 | 01 | C2 |
| | 80 | 31 | C6 | F4 | C5 | 01 | E4 | 80 | 98 | 2B | 3F | 08 | C5 | 01 | 01 | 40 |
| | E4 | FF | 9C | 04 | C5 | FF | 90 | 03 | 40 | 3F | 09 | 3F | 03 | 01 | 40 | E4 |
| | 9B | 98 | E9 | C4 | A4 | CA | 00 | C4 | 00 | CA | 01 | C4 | 02 | 37 | C4 | 46 |
| | 33 | 40 | CA | 04 | 3F | C4 | 00 | 01 | 90 | F1 | 7C | 7F | 3B | C4 | 02 | 37 |
| | C4 | 55 | 33 | C4 | 08 | 36 | C4 | 80 | 32 | 3F | 08 | C4 | CC | 3F | 09 | C4 |
| | CF | 3F | 09 | C4 | C7 | 3F | 09 | C4 | CF | 3F | 09 | C4 | A0 | 3F | 09 | 3F |
| | 09 | 3F | 09 | 3F | 03 | 01 | 40 | D4 | E0 | E4 | E0 | 9C | F6 | 40 | D4 | 1F |
| | 01 | 40 | CA | A0 | CA | A1 | 3F | 07 | C2 | 80 | 98 | 02 | 3F | 04 | C2 | A2 |
| | CA | 80 | 35 | C6 | 01 | C2 | A2 | CA | 80 | 31 | C6 | FF | C4 | 80 | CD | 01 |
| | C4 | 00 | CD | 01 | C4 | FF | C9 | 00 | 3F | 08 | C5 | FF | E4 | 80 | 9C | FA |
| | C5 | 01 | C1 | 00 | E4 | FF | 98 | 06 | C5 | 01 | 3F | 00 | 90 | F4 | 3F | 03 |
| | 01 | 40 | E4 | FF | 98 | 27 | 40 | E4 | 85 | 98 | 2C | 40 | E4 | B8 | 98 | D0 |
| | 40 | D4 | F8 | E4 | B0 | 9C | E7 | 40 | D4 | 07 | 02 | F4 | 06 | 01 | C0 | 80 |
| | D9 | FF | C9 | FF | 90 | C2 | 01 | 02 | 04 | 08 | 10 | 20 | 40 | C1 | FE | E4 |
| | 80 | 98 | CB | C5 | FE | 90 | A9 | C5 | 01 | 31 | CA | A3 | 35 | CA | A2 | C4 |
| | 00 | CE | F6 | C4 | 31 | CE | FF | C4 | 02 | 37 | C4 | 46 | 33 | 30 | E4 | 21 |
| | C2 | 04 | 98 | 1E | C4 | 20 | 01 | C0 | 80 | E2 | 04 | 98 | 0D | 02 | 40 | F4 |
| | 01 | 01 | DC | 29 | 9C | F1 | C4 | B0 | 90 | 08 | 03 | 40 | FC | 20 | D4 | 0F |
| | DC | B0 | CA | 04 | C4 | 46 | 33 | 3F | 3F | 06 | 5B | 4F | 66 | 6D | 7D | 07 |
| | 7F | 6F | C4 | 08 | 37 | C4 | 80 | 33 | C3 | A8 | 01 | 02 | 40 | 70 | 01 | C3 |
| | 80 | 35 | C4 | 01 | 70 | 01 | C3 | 80 | 31 | C3 | A8 | 98 | 07 | 02 | F4 | FF |
| | CB | A8 | 90 | 08 | C5 | 01 | CB | A7 | CA | 03 | 90 | 06 | C4 | 00 | CB | A7 |
| | CA | 03 | C4 | 02 | 37 | C4 | 46 | 33 | 3F | C4 | 02 | 37 | C4 | 55 | 33 | C4 |
| | 02 | CE | FF | C4 | 05 | CE | FF | C4 | 02 | CE | FF | C4 | 00 | CE | FF | CE |
| | FF | CE | FF | CE | FF | C4 | AF | 3F | 02 | C6 | FB | C4 | 17 | 37 | C4 | CD |
| | 33 | 3F | D0 | 07 | 87 | FF | FF | FF | 1C | 22 | C1 | 00 | 80 | FF | FF | FF |
| | 5F | DF | FF | FF | FF | 07 | 00 | 87 | FF | FF | 0A | 1F | 0A | 1F | 8A | 24 |
| | 2A | 6B | 2A | 92 | 23 | 13 | 08 | 64 | E2 | 36 | 49 | 56 | 20 | D0 | 07 | 87 |
| | FF | FF | FF | 1C | 22 | C1 | FF | FF | 41 | 22 | 9C | FF | FF | 15 | 0E | 1F |
| | 0E | 95 | 08 | 08 | 3E | 08 | 88 | 58 | B8 | FF | FF | FF | 08 | 08 | 08 | 88 |
| | FF | 60 | E0 | FF | FF | FF | 20 | 10 | 08 | 04 | 82 | 3E | 41 | 41 | BF | FF |
| | 42 | 7F | C0 | FF | FF | 62 | 51 | 49 | C6 | FF | 22 | 49 | 49 | B6 | FF | 18 |
| | 14 | 12 | 7F | 90 | 27 | 45 | 45 | 45 | B9 | 3E | 49 | 49 | B2 | FF | 01 | 61 |
| | 19 | 87 | FF | 36 | 49 | 49 | B6 | FF | 26 | 49 | 49 | BE | FF | 36 | B6 | FF |
| | FF | FF | 5B | BB | FF | FF | FF | 08 | 14 | 22 | C1 | CD | 14 | 14 | 14 | 94 |
| | FF | 41 | 22 | 14 | 88 | FF | 02 | 01 | 59 | 86 | FF | 08 | 1C | 2A | 08 | 88 |
| | 7E | 09 | 09 | FE | FF | 7F | 49 | 49 | B6 | FF | 3E | 41 | 41 | A2 | FF | 7E |
| | 41 | 41 | BE | FF | 7F | 49 | 49 | C9 | FF | 7F | 09 | 09 | 89 | FF | 3F | 41 |
| | 51 | B2 | FF | 7F | 08 | 08 | FF | FF | 41 | 7F | C1 | FF | FF | 20 | 40 | 40 |
| | BF | FF | 7F | 08 | 14 | E3 | FF | 7F | 40 | 40 | C0 | FF | 7F | 02 | 0C | 02 |
| | FF | 7F | 0C | 18 | FF | FF | 3E | 41 | 41 | 41 | BE | 7F | 09 | 09 | 86 | FF |
| | 3E | 41 | 51 | 21 | DE | 7F | 09 | 09 | F6 | FF | 26 | 49 | 49 | B2 | FF | 01 |
| | 01 | 7F | 01 | 81 | 3F | 40 | 40 | BF | FF | 1F | 20 | 40 | 20 | 9F | 7F | 20 |
| | 18 | 20 | FF | 63 | 14 | 08 | 14 | E3 | 07 | 08 | 70 | 08 | 87 | 61 | 59 | 4D |
| | C3 | FF | 02 | 05 | 82 | FF | FF | 06 | 09 | 89 | FF | FF | 00 | 80 | FF | FF |
| | FF | FF | 7E | 7F | 09 | 09 | FE | FF | 7F | 7F | 49 | 49 | B6 | FF | 3E | 7E |
| | 41 | 41 | A2 | FF | 7F | 7F | 41 | 41 | BE | FF | 7F | 7F | 49 | 49 | C9 | FF |
| | 7F | 7F | 09 | 09 | 89 | FF | 3E | 7F | 41 | 51 | B2 | FF | 7F | 7F | 08 | 08 |
| | FF | FF | 41 | 7F | 7F | C1 | FF | FF | 20 | 40 | 40 | 7F | BF | FF | 7F | 7F |
| | 08 | 14 | F3 | FF | 7F | 7F | 40 | 40 | C0 | 00 | 7F | 7F | 02 | 0C | 02 | FF |
| | 7F | 7F | 04 | 08 | 10 | FF | 3E | 7F | 41 | 41 | 7F | BF | 7F | 7F | 09 | 09 |

-continued

PROGRAM FOR ILLUMINATED CHANGEABLE-DISPLAY SIGN

| | | | | | | | | | | | | | | | | |
|---|---|---|---|---|---|---|---|---|---|---|---|---|---|---|---|---|
| | 86 | FF | 3E | 7F | 41 | 51 | 21 | DE | 7F | 7F | 09 | 09 | F6 | FF | 26 | 4F |
| | 49 | 79 | B2 | FF | 01 | 01 | 7F | 7F | 01 | 81 | 3F | 7F | 40 | 40 | BF | FF |
| | 1F | 3F | 40 | 20 | 9F | FF | 7F | 7F | 20 | 18 | 20 | FF | 63 | 77 | 08 | 08 |
| | 77 | E3 | 07 | 0F | 70 | 70 | 0F | 87 | 61 | 71 | 59 | 4D | 47 | C3 | 7F | 09 |
| | 01 | 7F | 40 | C0 | 7F | 09 | 06 | 7F | 40 | C0 | 01 | 0F | 01 | 08 | 78 | 88 |
| | 26 | 49 | 32 | 7F | 09 | 86 | 04 | 02 | 7F | 02 | 84 | FF | 1F | 1F | 1F | 1F |
| | 1F | 1F | 1F | 1F | 1F | 1F | 1F | 1F | 1F | 1F | 1F | 1F | 1F | 1F | 1F | 1F |
| (00) | C4 | 08 | 37 | C4 | 35 | 33 | C4 | 05 | 01 | C6 | 01 | CF | 01 | 02 | 40 | F4 |
| | FF | 98 | 03 | 01 | 90 | F3 | C6 | 06 | C4 | 40 | 32 | 01 | C4 | 00 | CE | 01 |
| | 40 | 32 | 01 | 40 | 32 | 01 | 60 | 9C | F3 | 40 | 02 | F4 | C0 | 1C | 02 | F4 |
| | 40 | 33 | C4 | 08 | 37 | 32 | 01 | 40 | 32 | 40 | E4 | 80 | 98 | 06 | C6 | 01 |
| | CF | 01 | 90 | F1 | C4 | 00 | CF | 01 | 33 | 01 | 40 | 33 | 40 | F4 | 80 | 9C |
| | F3 | C4 | 02 | 37 | C4 | 46 | 33 | C4 | 35 | 32 | 3F | 8C | 7B | AF | FA | 7E |
| | C4 | 08 | 37 | C4 | 80 | 33 | C2 | 03 | 01 | 40 | E4 | DB | 98 | 1B | 40 | F4 |
| | DC | 98 | 22 | 40 | E4 | DD | 98 | 16 | 40 | E4 | DE | 98 | 54 | 40 | E4 | DF |
| | 98 | 57 | 40 | E4 | E0 | 98 | 02 | 90 | 6A | 40 | CB | A6 | 90 | 5D | C4 | 16 |
| | 37 | C4 | 23 | 33 | 3F | C5 | 01 | D4 | 1F | CA | FF | AB | A8 | 01 | C4 | 20 |
| | 33 | C7 | FE | BA | FF | 9C | FA | 02 | 40 | 70 | 01 | C3 | 00 | 35 | CF | FF |
| | C3 | 01 | 31 | CE | FF | C4 | 80 | 33 | C2 | 01 | CB | 80 | 02 | 40 | F4 | 01 |
| | 01 | C6 | 02 | CB | 80 | 08 | 08 | C4 | 15 | CA | 01 | C4 | 6A | CA | 00 | 90 |
| | 22 | C5 | 01 | D4 | 0F | CB | A4 | 90 | 12 | 40 | CB | A6 | C4 | 40 | CA | FF |
| | C4 | A0 | 33 | C4 | 00 | CF | 01 | BA | FF | 9C | 08 | C4 | 15 | CA | 01 | C4 |
| | 72 | CA | 00 | C4 | 02 | 37 | C4 | 46 | 33 | 3F | 46 | 33 | 3F | 9F | F1 | 2F |
| | C4 | 02 | 37 | C4 | 55 | 33 | C4 | 08 | 36 | C4 | 80 | 32 | C4 | 05 | CA | A4 |
| | C4 | E0 | CA | A6 | C4 | 00 | CA | A7 | CA | A5 | 3F | 08 | C4 | D0 | 3F | 09 |
| | C4 | CC | 3F | 09 | C4 | C1 | 3F | 09 | C4 | D9 | 3F | 09 | C4 | 40 | 3F | 09 |
| | 3F | 09 | 3F | 09 | 3F | 03 | 01 | 40 | D4 | E0 | E4 | E0 | 9C | F8 | 40 | 01 |
| | C4 | 08 | 37 | C4 | 20 | 33 | 40 | D4 | 1F | CA | FF | C7 | FE | BA | FF | 9C |
| | FA | C3 | 00 | 98 | E1 | 35 | C3 | 01 | 31 | C3 | 00 | CA | 00 | C3 | 01 | CA |
| | 01 | C4 | 00 | CA | A8 | C4 | 02 | 37 | C4 | 55 | 33 | C4 | 80 | 32 | C5 | 01 |
| | CA | A7 | 01 | C4 | 80 | 32 | C2 | A7 | 01 | C2 | A6 | E4 | E0 | 9C | 4F | C2 |
| | A7 | E4 | 80 | 98 | 2F | C4 | 00 | CA | A9 | C5 | 01 | 01 | 40 | F4 | FF | 9C |
| | 04 | 3F | 0F | 90 | DE | 40 | 3F | 0D | 40 | 3F | 02 | C6 | FF | D4 | 80 | 98 |
| | FA | C2 | 00 | D4 | 7F | CA | 00 | C4 | 00 | CE | FF | C4 | 80 | CE | FF | 05 |
| | 90 | FE | 90 | BF | C5 | 01 | 01 | 40 | E4 | FF | 9C | 04 | 3F | 0F | 90 | B3 |
| | C4 | 00 | CA | A9 | 40 | DC | 80 | CA | FF | 05 | 90 | FE | 90 | E6 | 40 | 9C |
| | 42 | C5 | 01 | 01 | 40 | E4 | FF | 9C | 04 | 3F | 0F | 90 | 96 | 40 | F4 | A0 |
| | 9C | 0E | 3F | 0E | 05 | 90 | FE | C4 | 80 | 32 | C4 | 00 | CA | A9 | 90 | E1 |
| | 40 | 3F | 0D | 40 | 3F | 02 | C6 | FF | D4 | 80 | 98 | FA | C4 | 00 | CE | FF |
| | CE | FF | 32 | 01 | 40 | 32 | 03 | C4 | 40 | 78 | 94 | 02 | 90 | C3 | C4 | 41 |
| | 32 | 90 | CF | C5 | 01 | 01 | 40 | E4 | FF | 9C | 04 | 3F | 0F | 90 | AF | 40 |
| | CE | FF | 90 | EF | C4 | 02 | 37 | C4 | 55 | 33 | C4 | 08 | 36 | C4 | 34 | 32 |
| | C4 | 10 | 35 | CE | FF | C4 | 02 | 31 | CE | FF | C4 | DB | CA | F4 | 02 | C4 |
| | 00 | 01 | C5 | 01 | CE | FF | 01 | F4 | 01 | 01 | 40 | E4 | 08 | 98 | 0F | 40 |
| | D4 | 04 | 9C | 02 | 90 | EC | C6 | 28 | 3F | 01 | CE | D8 | 90 | F4 | C4 | 80 |
| | 32 | C4 | 08 | 35 | C4 | 2B | 31 | C4 | 05 | 01 | C5 | 01 | 98 | 0F | 3F | 02 |
| | C6 | FF | D4 | 80 | 98 | FA | C4 | 00 | CE | FF | CE | FF | 02 | 40 | F4 | FF |
| | 01 | 40 | 98 | 10 | E4 | 03 | 98 | 04 | C5 | 01 | 90 | E2 | C4 | 36 | CE | FF |
| | CE | FF | 90 | E2 | 3F | 0E | 05 | 90 | FE | C2 | E4 | E4 | 01 | 9C | 17 | C4 |
| | 14 | CA | 01 | C4 | EA | CA | 00 | C4 | 46 | 33 | C4 | 32 | 31 | C5 | 01 | 01 |
| | C5 | 01 | 35 | 01 | 31 | 3F | C4 | 2F | 31 | C4 | 80 | 32 | C4 | 0F | C9 | F5 |
| | C4 | 00 | C9 | FF | C9 | FE | C9 | FD | 01 | C4 | 06 | C9 | FC | 40 | D4 | 01 |
| | 9C | 11 | 40 | D4 | 02 | 9C | 04 | C1 | FE | 90 | 02 | C1 | FF | 1C | 1C | 1C |
| | 1C | 90 | 04 | C1 | FE | D4 | 0F | E1 | 80 | 98 | 1E | 02 | C4 | 03 | E9 | FF |
| | C9 | FF | C4 | 00 | E9 | FE | C9 | FE | B9 | FC | 98 | CD | F4 | 03 | 9C | CD |
| | 02 | C4K | 01 | E9 | FD | C9 | FD | 90 | C4 | 40 | F4 | 02 | 98 | 09 | 02 | C4 |
| | 01 | 70 | 01 | 90 | B8 | 90 | 88 | C1 | FD | D4 | 0F | C9 | FF | C1 | FD | D4 |
| | F0 | 1C | 1C | 1C | 1C | C9 | FE | C4 | 00 | C9 | FD | C4 | 01 | C9 | FC | C4 |
| | 00 | C9 | F9 | 02 | C1 | 01 | EC | 06 | 01 | 40 | D4 | 0F | C9 | 01 | 01 | D4 |
| | F0 | 9C | 16 | C1 | 00 | 98 | 24 | C4 | 00 | C9 | 00 | C4 | B0 | D9 | 01 | C9 |
| | 01 | C4 | B0 | D9 | 02 | C9 | 02 | 90 | 36 | C1 | 00 | 9C | 06 | C1 | 01 | 98 |
| | F0 | 90 | E8 | C1 | 00 | DC | B0 | C9 | 00 | 90 | E0 | C1 | 02 | 98 | 2F | 03 |
| | C4 | 0A | F9 | 02 | DC | B0 | C9 | 02 | 03 | C4 | 09 | F9 | 01 | C9 | 01 | 9C |
| | 08 | C4 | AD | C9 | 01 | 90 | CA | 90 | 8C | C4 | AD | C9 | 00 | 90 | BC | C1 |
| | FC | 98 | 04 | C5 | FD | 90 | 9C | C5 | 03 | C4 | 06 | 01 | 90 | 09 | C4 | B0 |
| | C9 | 02 | 03 | C4 | 0A | 90 | D4 | C5 | 01 | 98 | 0E | 3F | 02 | C6 | FF | D4 |
| | 80 | 98 | FA | C4 | C0 | CE | FF | CE | FF | 02 | C4 | FF | 70 | 98 | 23 | 01 |
| | 40 | E4 | 03 | 98 | 02 | 90 | E0 | C4 | 05 | 37 | C4 | C8 | 33 | 3F | C4 | 02 |
| | 37 | C4 | 55 | 33 | C4 | 00 | CE | FF | CE | FF | CE | FF | CE | FF | C5 | FA |
| | 90 | C5 | C4 | 06 | CE | FF | C4 | 09 | CE | FF | CF | FF | 3F | 0E | 05 | 90 |
| | FE | C4 | 80 | 32 | 3F | 0E | 05 | 90 | FE | C4 | 05 | CA | E4 | 90 | 88 | 90 |

| Identifying Numerals | Description of Components |
|---|---|
| 111 | 5K ohms, ¼ watt resistor |
| 112 | 1K ohms, ¼ watt resistor |
| 114 | 100K ohms, ¼ watt resistor |

-continued

| Identifying Numerals | Description of Components |
|---|---|
| 118 | 20 picofarad capacitor |
| 143 | 51K ohms, ¼ watt resistor |
| 144 | 470 picofarad capacitor |

-continued

| Identifying Numerals | Description of Components |
|---|---|
| 202 | 470 picofarad capacitor |
| 204 | 37K ohms, ¼ watt resistor |
| 210 | 100K ohms, ¼ watt resistor |
| 211 | 1 megohm Rheostat |
| 212 | 1K ohm, ¼ watt resistor |
| 216 | .1 microfarad, 35 volt tantalum capacitor |
| 218 | .01 microfarad, 100 volt ceramic disc capacitor |
| 224 | 1.0 microfarad, 10 volt tantalum capacitor |
| 226 | 100K ohm, ¼ watt resistor |
| 254 | PNP transistor, type 2N6076 |
| 256 | 3.3K ohm, ¼ watt resistor |
| 258 | 1.5K ohm, ¼ watt resistor |
| 260 | 1K ohm, ¼ watt resistor |
| 275 | 1K ohm, ¼ watt resistor |
| 276 | 1.0 mirofarad, 35 volt tantalum capacitor |
| 278 | 100K ohm, ¼ watt resistor |
| 288 | 1K ohm, ¼ watt resistor |
| 290 | 18K ohm, ¼ watt resistor |
| 292 | 10K ohm, ¼ watt resistor |
| 294 | 10 microfarad, 35 volt tantalum capacitor |
| 296 | .01 microfarad, 100 volt ceramic disc capacitor |
| 327 | 4.7K ohm, ¼ watt resistor |
| 359 | NPN Darlington transistor amplifier using MPSU 95 transistor and a 56 ohm, ¼ watt collector resistor |
| 360 | 68K ohm, ¼ watt resistor |
| 378 | NPN Darlington transistor amplifier using a MPSU 95 transistor and a 15 ohm, ¼ watt emitter resistor |
| 380 | 68K ohm, ¼ watt resistor |
| 384 | 47 ohm, ¼ watt resistor |
| 386 | NPN transistor type D44D, (G.E.) |
| 388 | 470 ohm, ¼ watt resistor |
| 392 | 4.7K ohm, ¼ watt resistor |
| 398 | 22 picofarad ceramic disc capacitor |
| 400 | 5.1K ohm, ¼ watt resistor |
| 404 | 5.1K ohm, ¼ watt resistor |
| 428 | 47K ohm, ¼ watt resistor |
| 430 | NPN transistor, type 2N5172 |
| 432 | 15K ohm rheostat |
| 434 | 1K ohm, ¼ watt resistor |
| 436 | .05 microfarad, 25 volt ceramic disc capacitor |
| 442 | 10K ohm, ¼ watt resistor |
| 444 | diode, type 1N914 |
| 446 | 10 megohm, ¼ watt resistor |
| 448 | 400 picofarad ceramic disc capacitor |
| 484 | .01 microfarad, 100 volt ceramic disc capacitor |
| 486 | .01 microfarad, 100 volt ceramic disc capacitor |
| 488 | 4.7K ohm, ¼ watt resistor |
| 489 | 10 microfarad, 35 volt tantalum capacitor |
| 490 | 10 microfarad, 35 volt tantalum capacitor |
| 491 | Rectifier diode, fast recovery, type A114A, (G.E.) |
| 493 | Rectifier diode, fast recovery, type A114A, (G.E.) |
| 494 | Rectifier diode, fast recovery, type A114A, (G.E.) |
| 495 | 10 microfarad, 35 volt tantalum capacitor |
| 496 | Rectifier diode, fast recovery, type A114A, (G.E.) |
| 497 | 10 microfarad, 35 volt tantalum capacitor |
| 538 | 51K ohm, ⅛ watt, 1% metal film resistor |
| 540 | 51K ohm, ⅛ watt, 1% metal film resistor |
| 542 | Operational amplifier, type CA3130AT, (RCA) |
| 544 | 67 picofarad, ceramic disc capacitor |
| 546 | PNP Darlington transistor, type MPSA66 |
| 548 | Precision voltage reference, (regulator), type LM336, (National Semiconductor) |
| 550 | 1.2K ohm, ¼ watt resistor |
| 552 | diode, type 1N914 |
| 554 | 100K ohm, ¼ watt resistor |
| 556 | diode, type 1N914 |
| 557 | 243 ohm, ⅛ watt, 1% metal film resistor |
| 558 | 1K ohm, ⅛ watt, 1% metal film resistor |
| 562 | Operational amplifier, type CA3130AT, (RCA) |
| 564 | 67 picofarad, ceramic disc capacitor |
| 566 | NPN Darlington transistor, type MPSA 12 |
| 568 | 294 ohm, ⅛ watt, 1% metal film resistor |

-continued

| Identifying Numerals | Description of Components |
|---|---|
| 570 | 499 ohm, ⅛ watt, 1% metal film resistor |
| 572 | 10 ohm trim rheostat |
| 574 | Analog-to-digital converter, type ADC 3511, (National Semiconductor) |
| 576 | 1K ohm, ⅛ watt, 1% metal film resistor |
| 578 | 100K ohm, ¼ watt resistor |
| 580 | 100 ohm trim rheostat |
| 582 | 100 microfarad, 10 volt tantalum capacitor |
| 584 | 270 picofarad ceramic disc capacitor |
| 586 | 47 microfarad, 10 volt tantalum capacitor |
| 588 | 7.5K ohm, ¼ watt resistor |
| 590 | 220 ohm, ¼ watt resistor |
| 592 | 100K ohm, ¼ watt resistor |
| 594 | .5 microfarad, low loss film type capacitor |
| 596 | .5 microfarad, low loss film type capacitor |
| 608 | 100 picofarad ceramic disc capacitor |
| 610 | 100K ohm, ¼ watt resistor |
| 612 | 22K ohm, ¼ watt resistor |
| 614 | 100K ohm, ¼ watt resistor |
| 618 | .01 microfarad, 100 volt ceramic disc capacitor |
| 624 | NPN transistor, type 2N5172 |
| 626 | PNP transistor, type 2N6076 |
| 628 | 22 ohm, ¼ watt resistor |
| 636 | 22 ohm, ¼ watt resistor |
| 672 | 1K ohm, ¼ watt resistor |
| 674 | 51 ohm, ¼ watt resistor |
| 676 | 1K ohm, ¼ watt resistor |
| 678 | Comparator, part of quad comparator type LM3302 |
| 680 | 4.7K ohm, ¼ watt resistor |
| 684 | NPN transistor, type 2N5172 |
| 686 | PNP transistor, type 2N6076 |
| 688 | 10 ohm, ¼ watt resistor |
| 690 | 10 ohm, ¼ watt resistor |
| 724 | Regulator, 10 volt, type 78L10ACZ |
| 726 | .05 microfarad, 25 volt ceramic disc capacitor |
| 734 | .05 microfarad, 25 volt ceramic disc capacitor |
| 742 | 47K ohm, ¼ watt resistor |
| 744 | NPN Darlington transistor, type MPSU 95 |
| 746 | 47K ohm, ¼ watt resistor |
| 748 | NPN Darlington transistor, type MPSU 95 |
| 750 | 47K ohm; ¼ watt resistor |
| 752 | NPN Darlington transistor, type MPSU 95 |
| 756 | 47K ohm, ¼ watt resistor |
| 758 | Incandescent lamp, type CM 313 |
| 760 | NPN Darlington transistor, type MPSU 95 |
| 762 | Incandescent lamp, type CM 313 |
| 764 | Incandescent lamp, type CM 313 |

Whereas the drawing and accompanying description have shown and discussed a preferred embodiment of the present invention, it should be apparent to those skilled in the art that various changes may be made in form of the invention without affecting the scope thereof.

What I claim is:

1. An illuminated changeable-display sign which comprises a first plurality of light sources that are located for general viewing, a second plurality of light sources that are located for viewing by the operator of said sign, said second plurality of light sources being displaceable away from said first plurality of light sources whereby said operator cannot simultaneously view said first plurality of light sources and said second plurality of light sources, said light sources of said first plurality of light sources and said light sources of said second plurality of light sources being similarly arranged in rows and columns, a plurality of shift registers for said first plurality of light sources whereby each row of light sources of said first plurality of light sources has its own shift register, a further shift register which is usable for all of the light sources of said second plurality of light sources, and a multiplexing circuit which recurrently steps into said further shift register data that corresponds to the various rows of said second plurality of light sources and thereupon, for short periods of time, uses said data to appropriately illumine or darken the light sources in said various rows of said second plurality of light sources.

2. An illuminated changeable-display sign as claimed in claim 1 wherein said multiplexing circuit connects said light sources of said second plurality of light sources to said further shift register often enough and for long enough periods of time to enable all of the rows of light sources of said second plurality of light sources to appear to be simultaneously supplied with selective illuminating and darkening signals.

3. An illuminated, changeable-display sign as claimed in claim 1 wherein said further shift register is a serial-in parallel-out shift register, wherein said multiplexing circuit includes a plurality of serial-in serial-out shift registers, wherein said data that corresponds to said various rows of said second plurality of light sources is stored within said plurality of serial-in serial-out shift registers, and wherein the output stages of said plurality of serial-in serial-out shift registers are successively connected to the input of said serial-in parallel-out further shift register to successively transfer said data from said plurality of serial-in serial-out shift registers to said serial-in parallel-out further shift register.

4. An illuminated, changeable-display sign as claimed in claim 1 wherein said multiplexing circuit includes a plurality of serial-in serial-out shift registers, wherein said data that corresponds to said various rows of said second plurality of light sources is stored within said plurality of serial-in serial-out shift registers, wherein the output stages of said plurality of serial-in serial-out shift registers are successively connected to the input of said further shift register to successively transfer said data from said plurality of serial-in serial-out shift registers to said further shift register, and wherein a sensing circuit senses when said data is being transferred, from one of said plurality of serial-in serial-out shift registers to said further shift register, to develop a sensing signal, wherein a holding circuit responds to said sensing signal to temporarily hold new data, which is to be stepped into said plurality of serial-in serial-out shift registers, until the said first said data has been transferred to said further shift register, and said holding circuit therefor permits said new data to be transferred to said further shift register.

5. An illuminated, changeable-display sign as claimed in claim 1 wherein said light sources of said first plurality of light sources are incandescent lamps, and wherein said light sources of said second plurality of light sources are light emitting diodes.

6. An illuminated changeable-display sign which has a plurality of light sources that can display time data and temperature data, a time unit that includes a crystal-controlled clock which can supply precise time data over long periods of time, a temperature unit which can supply temperature data, a power supply that supplies D.C. to some components of said sign, and a memory power supply which supplies D.C. to said time unit and which has a back-up battery that enables it to keep the time data valid even if the main power from the first said power supply to the sign were to fail from time to time, said battery normally not supplying power to said memory power supply but doing so in the event the source of power for the first said power supply fails.

7. An illuminated changeable-display sign as claimed in claim 6 wherein each digit of the time data and each digit of the temperature data is directly addressed, whereby no coding and decoding of said data is required to distinguish said digit.

8. An illuminated changeable-display sign which has a plurality of light sources arranged in rows, a plurality of gates that normally supply data to said rows to provide desired illumining and darkening of the light sources in said rows, an inhibit circuit which can simultaneously inhibit all of said gates and thereby cause all of said light sources in all of said rows to be dark, a data-modifying circuit, a second plurality of light sources that is arranged in rows and that is adapted to display data supplied by said data-modifying circuit, said second plurality of light sources being displaceable away from the first said plurality of light sources, said inhibit circuit permitting said data-modifying circuit to continue to operate and thereby permitting said second plurality of light sources to display data supplied by said data-modifying circuit while said inhibit circuit is applying inhibit signals to all of said gates to darken said first said plurality of light sources.

9. An illuminated changeable-display sign which comprises a memory from which data to be displayed is read, data generating means which generate data that is to be stored in said memory and that is generated at different rates of speed, said data generating means being accessed to enable data generated thereby to be stored in said memory, and means to provide a short delay between the accessing of said data generating means and the subsequent reading of said memory, whereby even slowly-generated data will be in said memory at the time said data to be displayed is read.

10. An illuminated changeable-display sign which has a power supply that supplies D.C. to some components of said sign and a memory power supply that supplies D.C. to at least one component of said sign, said memory power supply having a battery which will enable it to supply power when the main power fails but which does not normally supply power to said memory power supply, and a circuit which senses any condition wherein both the main power and the memory power have failed, said circuit subsequently responding to restoration of said main power to provide a signal to the operator of said sign indicating that both said main power and said memory power had failed.

11. An illuminated changeable-display sign which comprises a first plurality of light sources that are located for general viewing, a second plurality of light sources that are located for viewing by the operator of said sign, said second plurality of light sources being displaceable away from said first plurality of light sources whereby said operator cannot simultaneously view said first plurality of light sources and said second plurality of light sources, said light sources of said first plurality of light sources and said light sources of said second plurality of light sources being similarly arranged in rows and columns, a memory in which information can be stored, a processing means that can sense said information and provide data which can cause said light sources of said first plurality of light sources and said light sources of said second plurality of light sources to provide visual displays of said information, a keyboard that can supply new information to said memory, and a circuit which responds to information-supplying actuation of said keyboard to effect darkening of all of said light sources of said first plurality of light sources while permitting said light sources of said second plurality of light sources to become selectively illumined or darkened by data in response to said new information.

12. An illuminated changeable-display sign which has a plurality of selectively illuminable light sources, a temperature unit which responds to a predetermined temperature to develop a predetermined voltage, said temperature unit responding to a change of one degree of temperature to provide a predetermined change of voltage, and a digitizing circuit which generates a digital signal that has a predetermined relation between digital data and degrees of temperature, and means to enable said illuminable light sources to respond to said digital signal to display digits corresponding to the temperature sensed by said temperature unit, said predetermined temperature being minus forty degrees Fahrenheit.

13. An illuminated changeable-display sign which has a plurality of selectively illuminable light sources, a temperature unit which responds to a predetermined temperature to develop a predetermined voltage, said temperature unit responding to a change of one degree of temperature to provide a predetermined change of voltage, and a digitizing circuit which generates a digital signal that has a predetermined relation between digital data and degrees of temperature, and means to enable said illuminable light sources to respond to said digital signal to display digits corresponding to the temperature sensed by said temperature unit, said digital signal being directly addressed, whereby no coding and decoding of said digital signal is required to distinguish said digits.

* * * * *